US008641113B1

(12) United States Patent
Russell

(10) Patent No.: US 8,641,113 B1
(45) Date of Patent: Feb. 4, 2014

(54) GRIPPING DEVICE FOR TUBULAR OBJECTS

(76) Inventor: Larry Rayner Russell, Houston, TX (US)

( * ) Notice: Subject to any disclaimer, the term of this patent is extended or adjusted under 35 U.S.C. 154(b) by 1171 days.

(21) Appl. No.: 12/586,317

(22) Filed: Sep. 21, 2009

Related U.S. Application Data

(60) Provisional application No. 61/192,789, filed on Sep. 22, 2008, provisional application No. 61/208,335, filed on Feb. 22, 2009.

(51) Int. Cl.
*E21B 31/00* (2006.01)
*E21B 7/08* (2006.01)

(52) U.S. Cl.
USPC ..... 294/86.1; 294/86.24

(58) Field of Classification Search
USPC ..... 294/86.1, 86.15, 86.16, 86.21, 86.22, 294/86.24, 86.25; 175/57, 220; 166/301, 166/99, 75, 13
See application file for complete search history.

(56) References Cited

U.S. PATENT DOCUMENTS

| | | | | | |
|---|---|---|---|---|---|
| 2,962,096 | A * | 11/1960 | Knox | ..... | 166/341 |
| 3,211,222 | A * | 10/1965 | Myers | ..... | 294/86.1 |
| 4,105,262 | A * | 8/1978 | Richey | ..... | 175/325.2 |
| 4,438,822 | A * | 3/1984 | Russell | ..... | 175/325.5 |
| 4,728,125 | A * | 3/1988 | Reneau | ..... | 285/18 |
| 2004/0060701 | A1 * | 4/2004 | Harmon et al. | ..... | 294/86.1 |
| 2008/0115972 | A1 * | 5/2008 | Lynde et al. | ..... | 175/57 |

* cited by examiner

*Primary Examiner* — Paul T Chin
(74) *Attorney, Agent, or Firm* — Elizabeth R. Hall

(57) ABSTRACT

A selectably operable passive gripping device for gripping tubular materials has an elastomeric element which is provided with integrally bonded segmented end rings to prevent the extrusion of the elastomer when it is subjected to high compressive loads. The elastomeric element is molded so that its as-molded gripping surface interferes with the surface of tubular objects to be gripped. The elastomeric gripping element is mounted and supported by a structural element or housing and allows axial flow communication through the gripped tubular objects. The gripping device is used to lift tubular objects such as a tubular string used in oil field applications.

14 Claims, 24 Drawing Sheets

60

GRIPPING DEVICE FOR TUBULAR OBJECTS

CROSS REFERENCE TO RELATED APPLICATIONS

The present application, pursuant to 35 U.S.C. 111(b), claims the benefit of the earlier filing date of provisional application Ser. No. 61/192,789 filed Sep. 22, 2008 entitled "Stretchable Elastomeric Tubular Gripping Device with Anti-extrusion Means" and provisional application Ser. No. 61/208,335, filed Feb. 22, 2009 entitled "Rubber Gripper Tool for Tubular Well Casing."

BACKGROUND OF THE INVENTION

1. Field of the Invention

The present invention relates to a method and apparatus for selectably sealingly gripping and releasing tubular members. In particular, the present invention relates to a method and apparatus for gripping and releasing tubular members being lowered into and retrieved from a well.

2. Description of the Related Art

There are a number of devices used to grip shafts, pipes, and other objects, some of which have been in use for a number of years. Almost all of the gripping devices currently being used operate in an active manner. An "active" operating device is one that is normally not in a gripping configuration, but must be selectively and actively forced into gripping an object. In contrast, "passive" devices are in a gripping configuration when the device is "at rest." Such passive devices must be selectively operated to cause them to not grip an object.

Tubular collets or split rings which obtain their flexibility by provision of one or more slots in a metallic tube wall parallel to the tube axis and which change the gripping surface diameter by wedging on conical surfaces due to application of axial loads constitute a large, general class of gripping devices. Examples of this class of device are illustrated in several patents such as Knox U.S. Pat. No. 2,962,096; Richey U.S. Pat. No. 4,105,262; Russell U.S. Pat. No. 4,438,822; Reneau U.S. Pat. No. 4,728,125; and Nagano et al. West Germany Patent 24 39 100.

These collet or split ring devices are active devices, requiring the application of force to distort a normally non-gripping element into a gripping configuration. Such devices normally have a very limited range of diameters which they can grip. When such devices are forced to distort too much they undergo permanent deformation. For example, collets can normally provide only limited gripping without being permanently distorted.

A similar class of active device uses a solid metallic ring or tube extension which fits very closely to the surface to be gripped and wedges conically tapered surfaces under the action of axial loads to effect gripping an object. The solid metallic ring is forced against the gripped surface by the wedging action. Such devices require a careful control of diameters of the gripping and gripped surfaces in order to avoid permanent distortions to the gripping ring. Examples of such devices are the Amlok devices, obtainable from Advanced Machine and Engineering, Rockford, Ill. and devices obtainable from Hänchen Hydraulic Gmbh, Ostfildem, Germany.

The Mapeco shaft coupling (Mapeco Products, Locust Valley, N.Y.) operates with the same type of solid ring gripping mechanism as the Amlok and Hänchen devices. However, the Mapeco device must be actively actuated by hydraulic pressure to grip.

Another class of gripping devices produces metal-to-metal gripping engagement for shafts by means of active hydraulically induced bulging of a gripping sleeve to cause it to distort into engagement with the gripped object. The Amlok hydraulic squeeze bushing (Advanced Machine and Engineering, Rockford, Ill.) requires active maintenance of hydraulic pressure in order to maintain its grip. The ETP bushing (Zero-Max/Helland Motion Control Products, Minneapolis, Minn.) uses a permanently entrapped somewhat compressible fluid to induce clamping. Yet the fluid must be constantly pressurized by a piston actuated by screws. Both types of bulging sleeve can operate only over very small gripping diameter ranges. Similarly, Amlok clamp disks and rings operate by selectably applied active direct compression of the gripped object, thereby permitting development of friction on the contact interface.

Non-split mechanical ring gripping devices may be actively forced under application of axial loads into gripping by flexurally deforming into contact with the gripped surface. Speith hydraulic actuated clamping sleeves (Advanced Machine and Engineering, Rockford, Ill.) uses a circumferentially convoluted sleeve for a flexural gripping device, whereas Russell (U.S. Pat. No. 4,438,822) uses an array of Belleville springs for gripping. Both types of device have only a very limited range of gripping diameters without undergoing permanent deformation.

A very common type of gripping device termed a 'slip' is based upon wedging of one or more discrete wedges of either planar or arcuate construction. Examples of such gripping devices can be obtained from Stewart & Stevenson, Houston, Tex. and Morgrip Products, Walsall, England. The wedges of these devices are normally actively biased into engagement with the gripped object by gravity or springs. Such slips are unidirectional gripping devices which will resist motion in the direction which tightens the wedge, but will release for motions which will loosen the wedge.

Most slips have relatively steep wedge angles so that they are self-releasing when subjected to reversed axial loads. In addition, some slips come with separately operable release mechanisms which pull the wedges out of engagement. The Stewart & Stevenson slips for their conductor pipe connector are of a conventional construction, but are not readily releasable. Oilfield drill pipe slips are a more typical construction. The Morgrip Pipe Clamp uses wedged rolling balls as slips in a manner similar to a common type of one-way clutch. Slips are used to grip objects which have a relatively large size variation capability. One major disadvantage with many slips is the induced damage to the gripped surface from the teeth on the face of the slips or, for the Morgrip Pipe Clamp, from the balls.

Knox U.S. Pat. No. 2,962,096 and Russell U.S. Pat. No. 4,438,822 disclose rubber rings which are actively axially compressed to grip. The Knox rubber ring is intended to seal against a pipe, but in the process provides some level of gripping. Both devices function similarly to the expandable rubber bottle stoppers which are actively caused to expand to seal and grip by axial squeezing applied by a camming lever.

Nixon U.S. Pat. No. 4,121,675 works similarly to the Russell rubber gripper, but utilizes knitted metal instead of rubber. Rubber collets are commonly used in machine shops to grip drills or tool shanks. These devices use active axial compression of the rubber element against a cylindrical case with a self-releasing conically tapered back wall to cause the rubber to distort to induce gripping. Normally, radial steel inserts embedded in the rubber are used to grip the object, rather than using the rubber directly. Rubber collets accurately and effectively grip over a large diameter range.

Richey U.S. Pat. No. 4,131,167 discloses an active helical spring gripping mechanism which uses twisting of the spring to cause it to grip a cylinder. The gripping is through friction developed in a manner somewhat comparable to a wrap spring one-way clutch, but the spring ends must be actively held in a tightly wound condition to grip.

Russell U.S. Pat. No. 4,438,822 discloses a passive gripping device. However, this device has a passive torsional spring gripper which normally has an interference fit with the surface to be gripped. The spring is twisted to get it to release. Both this device and that of Richey can experience difficulty with the initial establishment of gripping due to a buildup of friction not permitting full engagement with the gripped object over the full length of the helix. Additionally, both devices are sensitive to vibrations and are not well suited for axial load resistance.

Another passive gripping device is disclosed in Russell U.S. Pat. No. 6,471,254. However, the disclosed gripping device does not provide sealing with the tubular member if it has an attached coupled casing. Furthermore, the extrusion of the elastomeric gripping means becomes problematic when it is significantly compressed.

Frank's Casing Crew and Rental Tools, Inc. in U.S. Pat. Nos. 6,431,626 B1 and 6,309,002 discloses a gripping device for tubulars which may be supported on a top drive. The Frank's device grips the tubular internally using a hydraulically operated axially reciprocable metallic wedging system, while a structurally separate sealing means is provided. The sealing means permits drilling fluid circulation through the gripped casing.

Tesco Corporation in U.S. Pat. No. 6,742,584 B1 discloses a gripping device for tubulars with a hydraulically operated axially reciprocal wedging system very similar to that of the Frank's patents. Tesco uses a separate inflatable annular sealing means so that circulation can be established through the casing.

The gripping means of these cited devices can mar the surface of the casing, thereby leading to major corrosion problems for sensitive alloys in corrosive environments. Furthermore, each of the cited gripping devices requires a sealing means separate from its gripping means.

There is a need for a passive preloaded gripping device that does not rely on applying external mechanical force to efficiently initiate or maintain the gripping action on an object.

There is a further need for a gripping device that will sealingly grip a tubular casing that is resistant to elastomer extrusion.

SUMMARY OF THE INVENTION

Embodiments of the present invention provide a selectably operable passive gripping device for gripping tubular oilfield materials. The gripping device has an annular elastomeric element which is provided with integrally bonded segmented end rings to prevent the extrusion of the elastomer when it is subjected to high compressive loads.

The elastomeric element is molded so that its as-molded gripping surface interferes with the surface of the casing to be gripped. The elastomeric gripping means is mounted and supported by a tubular body which also provides axial flow communication through the device. The gripping means is used to lift and to seal to a tubular string, such as is used in oil field applications.

The elastomeric gripping means is anchored on its lower end and on its upper end it is attached to a double-acting hydraulic cylinder which is integral to the device. The means of attaching the gripping element to both its anchorage and the double-acting hydraulic cylinder permits both relative axial and radial movement whenever the axial tension on the gripping element changes. Applying axial tension to the elastomeric gripping element by means of the double-acting hydraulic cylinder acting on the upper end of the gripping means causes the cross-sectional area of the elastomer to be moved out of potential interference with a tubular casing being placed coaxially with and adjacent to the elastomeric element. At the same time, the tension causes the integrally bonded segmented end rings to be moved out of potential interference with the casing or, for externally gripping, the casing's outer surface and any upset casing couplings.

Subsequent releasing of the axial tension on the elastomeric element causes it to attempt to return to its unstressed position. When this happens, the elastomeric element will tightly grip the surface of the casing, and also the segmented end rings thereby tightly engaging the surface of the casing to prevent elastomer extrusion. The sizing of the segmented end rings is chosen to provide a minimal elastomer extrusion gap between adjacent ring segments.

When the casing is then lifted with the engaged gripping element of the gripping device, axial frictional forces between the casing and the elastomer further compress the elastomer so that the elastomer grips the casing even more tightly. Accordingly, the actuator of the present invention is in part passively activated by downward tension.

In the event that additional gripping force is required, the elastomer is selectably compressed by the double-acting hydraulic cylinder to further increase its friction with the casing. Torsional forces arising from the friction between the gripping element of the gripping device and the casing surface are transmitted by friction from the gripping element to the structure of the gripping device.

The gripping means and its actuating cylinder are modularized so that multiple modules can be positioned in an axial series to increase gripping power. The gripping means can be made to simultaneously grip and seal on either external or internal surfaces of a casing.

One embodiment of the present invention is a gripping apparatus for gripping tubular objects, the apparatus comprising: (a) a structural element; (b) an elastomeric gripping element having (i) a first end of the gripping element bonded to a first end of a first circumferential array of segmented antiextrusion end rings, wherein each antiextrusion end ring of the first array is attached to the structural element, and (ii) a second end of the gripping element bonded to a first end of a second circumferential array of segmented antiextrusion end rings, wherein each antiextrusion end ring of the second array is attached to a reciprocably movable end assembly, and (c) means for reciprocably moving the movable end assembly axially relative to the structural element to a first position, wherein the elastomeric gripping element is stretched and is selectably coaxially positionable adjacent a tubular object to be gripped and wherein opposed adjacent faces of adjacent antiextrusion end rings of both the first and the second arrays are moved to a first relative position to each other, a second position wherein the elastomeric gripping element is untensioned and is loosely biased against the tubular object and wherein opposed adjacent faces of adjacent antiextrusion end rings of both the first and the second arrays are moved to a second relative position to each other, or a third position wherein the elastomeric gripping element is compressed such that the elastomeric gripping element is actively biased against the tubular object to tightly grip the tubular object and wherein opposed adjacent faces of adjacent antiextrusion end rings of both the first and the second arrays are moved to a third relative position to each other.

Another embodiment of the present invention is A gripping apparatus for gripping tubular objects, the apparatus comprising: (a) a structural element; (b) a tubular elastomeric gripping element having (i) a first end of the gripping element bonded to a first end of a first circumferential array of segmented antiextrusion end rings, wherein each antiextrusion end ring of the first array is attached to the structural element, and (ii) a second end of the gripping element bonded to a first end of a second circumferential array of segmented antiextrusion end rings, wherein each antiextrusion end ring of the second array is attached to a reciprocably movable end assembly; (c) a reciprocable piston connected to the movable end assembly wherein the piston moves the movable end assembly axially relative to the structural element to a first position, wherein the elastomeric gripping element is stretched and is selectably coaxially positionable adjacent a tubular object to be gripped and wherein opposed adjacent faces of adjacent antiextrusion end rings of both the first and the second arrays are moved to a first relative position to each other, a second position wherein the elastomeric gripping element is untensioned and is loosely biased against the tubular object and wherein opposed adjacent faces of adjacent antiextrusion end rings of both the first and the second arrays are moved to a second relative position to each other, or a third position wherein the elastomeric gripping element is compressed such that the elastomeric gripping element is actively biased against the tubular object to tightly grip the tubular object and wherein opposed adjacent faces of adjacent antiextrusion end rings of both the first and the second arrays are moved to a third relative position to each other, and (d) a hydraulic cylinder having a first and second hydraulic chamber, wherein when a hydraulic pressure is applied to the second hydraulic chamber the piston moves the movable end assembly to the first position thereby stretching the elastomeric gripping element, and when a first hydraulic pressure is applied to the first hydraulic chamber the piston moves the movable end assembly to the second position thereby easing the tension on the gripping element, and when a second hydraulic pressure is applied to the first hydraulic chamber the piston moves the movable end assembly to the third position thereby biasing the gripping element against the tubular object to tightly grip the tubular object.

Yet another embodiment of the present invention is A gripping apparatus for gripping tubular objects, the apparatus comprising: (a) a structural element; (b) a tubular elastomeric gripping element having (i) a first end of the gripping element bonded to a first end of a first circumferential array of segmented antiextrusion end rings, wherein each antiextrusion end ring of the first array is attached to a static first anchor ring, the first anchor ring being attached to the structural element, (ii) a second end of the gripping element bonded to a first end of a second circumferential array of segmented antiextrusion end rings, wherein each antiextrusion end ring of the second array is attached to a second anchor ring, the second anchor ring being attached to a reciprocably movable end assembly, and (iii) a gripping element bore coaxial with a first antiextrusion end ring bore of the first array and a second antiextrusion end ring bore of the second array, wherein the first and second antiextrusion end ring bores are coaxial and substantially identical; (c) a reciprocable piston connected to the movable end assembly wherein the piston moves the movable end assembly axially relative to the structural element to a first position, wherein the elastomeric gripping element is stretched and is selectably positionable coaxial with and adjacent a tubular object to be gripped and wherein an internal diameter of the gripping element bore and an internal diameter of the first and second antiextrusion ring bores are increased to avoid structural interference with an exterior surface of the tubular object, a second position wherein the elastomeric gripping element is untensioned and is passively biased by elastomeric stresses due to displacement of the elastomeric from an at-rest position against the tubular object and wherein the internal diameter of the gripping element bore and the internal diameter of the first and second antiextrusion ring bores are decreased from the respective internal diameters of the gripping element bore and the first and second antiextrusion ring bores when the end assembly is in the first position, or a third position wherein the elastomeric gripping element is compressed such that the elastomeric gripping element is actively biased against the tubular object to tightly grip the tubular object and wherein the internal diameter of the gripping element bore and the internal diameter of the first and second antiextrusion ring bores are decreased from the respective internal diameters of the gripping element bore and the first and second antiextrusion ring bores when the end assembly is in the first position or the second position; and (d) a hydraulic cylinder having a first and second hydraulic chamber, wherein when a hydraulic pressure is applied to the second hydraulic chamber the piston moves the movable end assembly to the first position thereby stretching the elastomeric gripping element, and when a first hydraulic pressure is applied to the first hydraulic chamber the piston moves the movable end assembly to the second position thereby easing the tension on the gripping element, and when a second hydraulic pressure is applied to the first hydraulic chamber the piston moves the movable end assembly to the third position thereby biasing the gripping element against the tubular object to tightly grip the tubular object.

The foregoing has outlined rather broadly several aspects of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed might be readily utilized as a basis for modifying or redesigning the structures for carrying out the same purposes as the invention. It should be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DESCRIPTION OF THE PREFERRED EMBODIMENTS

Embodiments of the present invention utilize an axially extensible annular elastomeric means for the gripping of and simultaneous sealing to a hollow tubular member, such as an oilfield casing. The apparatus also enhances extrusion resistance for the elastomeric gripping means. The apparatus is suitable for use as a casing drive system which may be attached to a top drive unit of a drilling rig for the purposes of drilling with casing.

The casing gripping device of the present invention relates to an apparatus and a method for selectably simultaneously gripping and releasing hollow tubular members, such as oilfield casings. The first and second embodiments of the gripping device illustrate the device configured for the external gripping of casing. Alternatively, the gripping device is arranged for the internal gripping of casing, as shown in the third embodiment. The gripping device is able to grip and simultaneously seal with a cylindrical surface of a casing by using the same elastomeric element to accomplish both.

When the gripping device is engaged with a casing, it is able to apply high axial and torsional loadings to the casing by means of friction, so that the device can be used for selectably lowering and lifting a string of casing from a well, as well as rotating the casing string. When connected to a casing, the simultaneous sealing of the gripping element with the casing permits fluid circulation from the Kelly or top drive of a drilling rig through the gripping device and into the casing.

The materials of construction for the casing gripping device are typically heat-treated high strength low-alloy steel, such as AISI 4130, 4140, or 4340 for the metallic parts. In some cases, a stainless steel such as 17-4PH may be used to minimize corrosion, while in situations where hydrogen sulphide may be encountered, softer steels may be utilized. An oil resistant rubber, such as nitrile (Buna-N) or Viton, is used for the elastomeric gripping unit and the other seals of the gripping device. The hydraulic fittings and tubing typically are stainless steel.

For the purpose of description, the downward direction in all figures is to the left, which is the direction in which the weight of the casings to be lifted by the present invention acts.

First Embodiment 10 of the Gripping Device.

Figure 1:
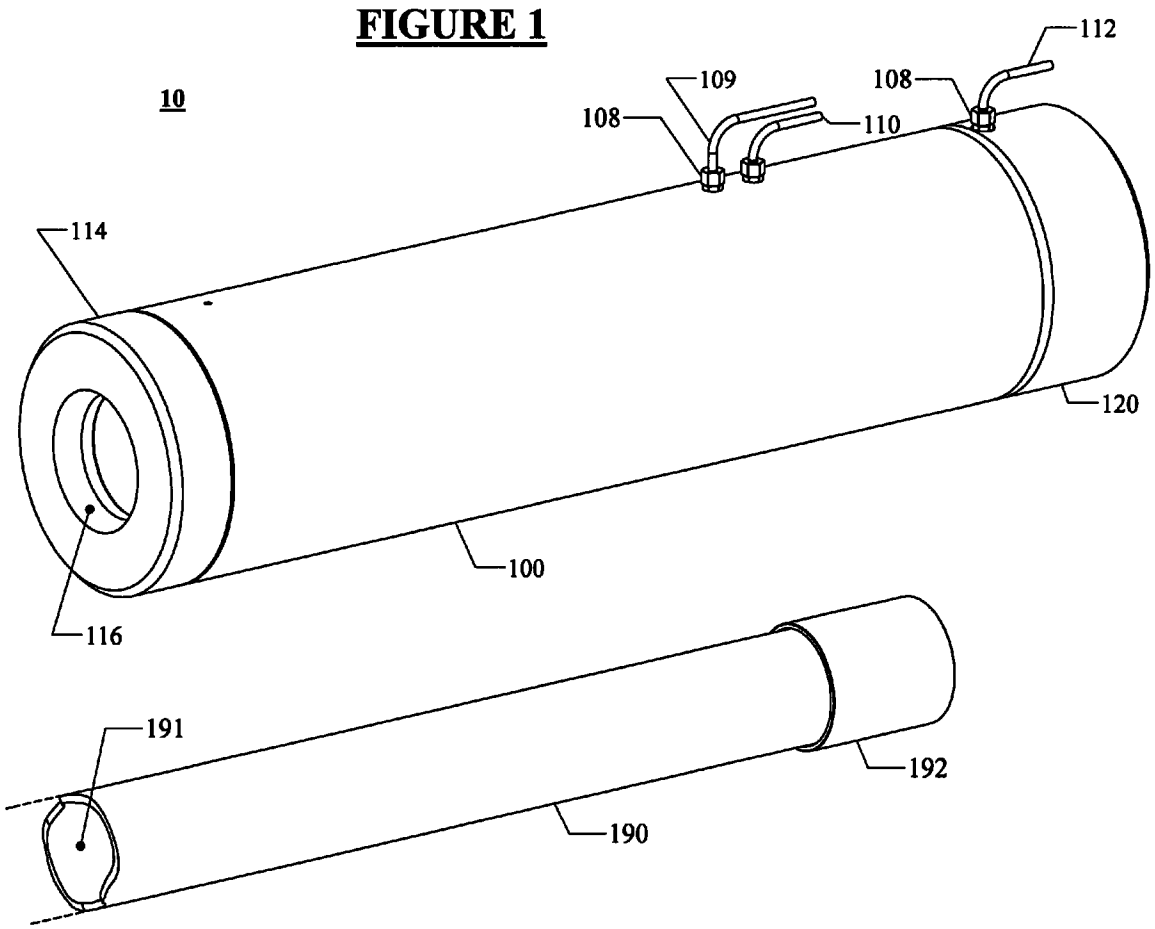
FIG. 1 is an oblique view of a first embodiment of the gripping device of the present invention at rest prior to activation. The gripping device of the first embodiment utilizes a single gripper module. By way of example, the gripping device is shown as configured for externally gripping and sealing to a 7 inch diameter oilfield casing which uses external couplings for connections between casing segments.
Figure 2:
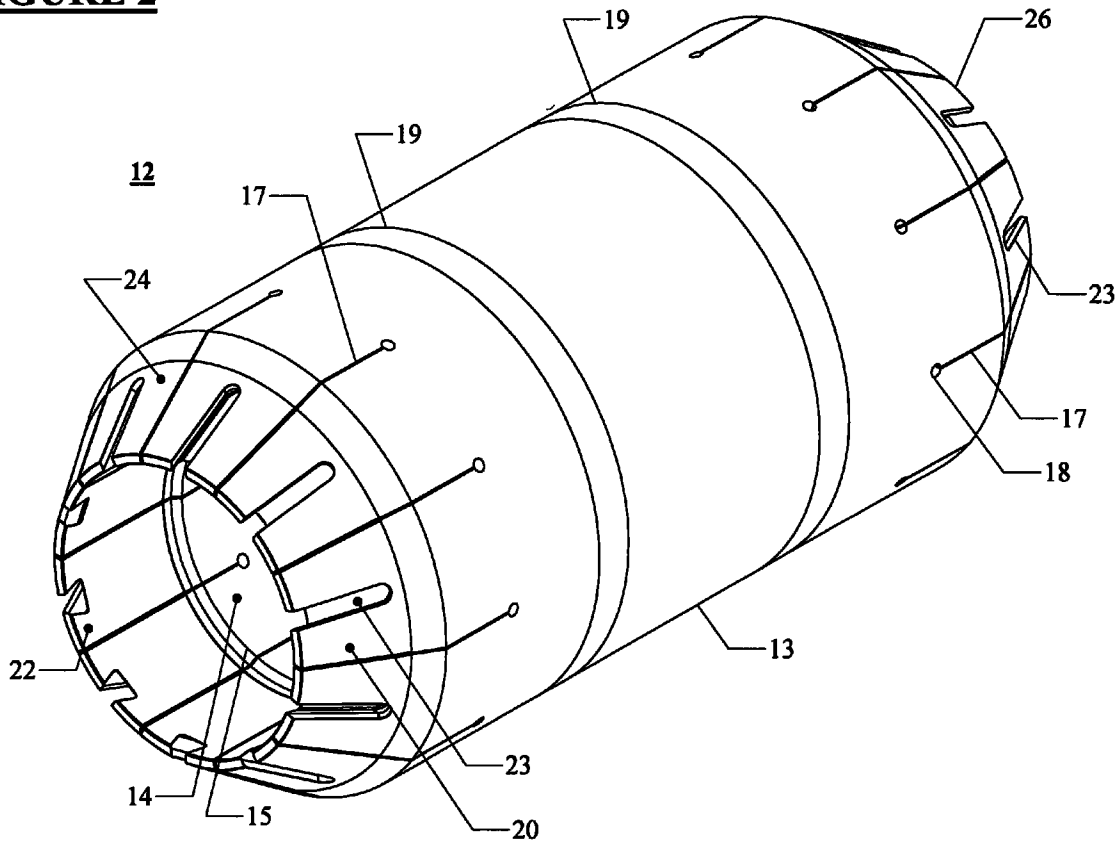
FIG. 2 is an oblique view of a gripping element of the gripping device of FIG. 1, wherein the gripping element is shown as molded with its integral segmented antiextrusion rings.

The first embodiment 10 of the present invention is shown in FIGS. 1 through 22. Referring to FIG. 1, an oblique side view of the first embodiment of the gripping device 10 of the present invention is shown in its relaxed, nongripping position, along with a casing 190 with an attached external coupling 192. By way of example, the gripping device of FIG. 1 is configured for external gripping of the upper ends of a nominal 7 inch casing having a threadedly attached external casing coupling of 7.656 inch nominal outer diameter at its upper, gripped end. The gripping device 10 of FIG. 1 has a generally tubular construction with a single gripping module 97 and its actuation means mounted within a tubular body assembly 99.

The gripping element 12 is an annular body of revolution, shown in detail in FIGS. 2 through 5, which performs the actual gripping of the casing 190. Each gripping element 12 and its gripping device 10 are sized for a particular pipe outer diameter and any casing coupling which may be attached to the upper end of a casing which the gripping device 10 must grip. The gripping device 10 is configured to pass freely over and by the casing coupling 192 before gripping the external surface of the casing 190 below the coupling. The gripping element 12 consists of an elastomeric sleeve 13 integrally bonded with one or more restraining rings 19, a set of lower end antiextrusion segments 20, and a set of upper end antiextrusion segments 26. The restraining rings 19 are located in the central portion of the elastomeric sleeve 13 on its exterior surface, while the lower antiextrusion segments 20 are located on the lower end and the upper antiextrusion segments 26 are located on the upper end. These elements may be molded as an integral assembly when the elastomer for the sleeve 13 is introduced into the mold and then the assembly 12 is cured.

The contraction restricting restraining rings 19 are axially short radially thin metallic annular rings having an outer diameter the same as that of the elastomeric sleeve 13. The interior edges of the restraining rings 19 are chamfered or radiused in order to minimize stress risers in the bonded elastomer sleeve 13.

Figure 4:
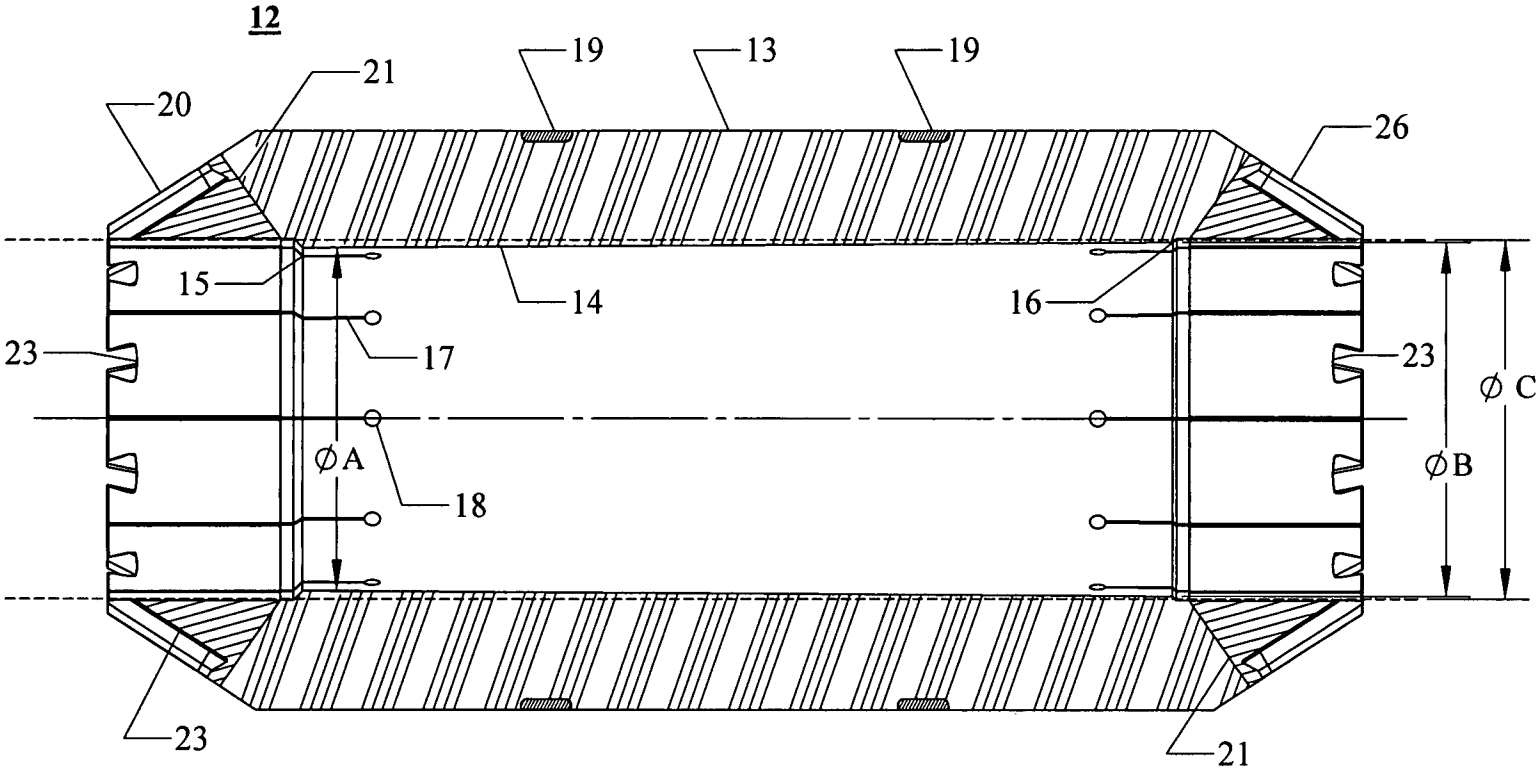
FIG. 4 is a longitudinal sectional view of the as-molded gripping element of FIG. 2.

The lower 20 and upper 26 antiextrusion segments are basically identical and are cut from source axisymmetric solid rings (not shown) having an inner diameter slightly larger than the minimum internal diameter $\phi A$ of the molded elastomeric sleeve 13, as seen in FIG. 4. In sequence moving around the external surfaces of a source solid ring, each solid ring has a radially short transverse exterior first end, a radially outwardly diverging first external frustroconical sliding contact surface 24 having a constant inclination of approximately 15° to 35° from the axis of symmetry of the solid ring, and a second radially inwardly converging external frustroconical bonding face 21 which intersects the straight right circular cylindrical through bore 22 of the ring. The second external frustroconical face 21 is inclined at an angle of approximately 45° to 60° from the axis of symmetry of the solid ring in the opposite direction to the slope of the first frustroconical sliding contact surface 24.

The solid rings are first turned on a lathe and then segmented into multiple substantially identical arcuate segments 20 and 26, as can be seen in FIGS. 2 through 5. The segmentation of the end rings is done by a saw or laser or other suitable means having a small kerf width cut. A sawn kerf will have parallel sides, but this is not a requirement. The equispaced segmentation cuts are made on radial planes of the solid rings.

Figure 20:
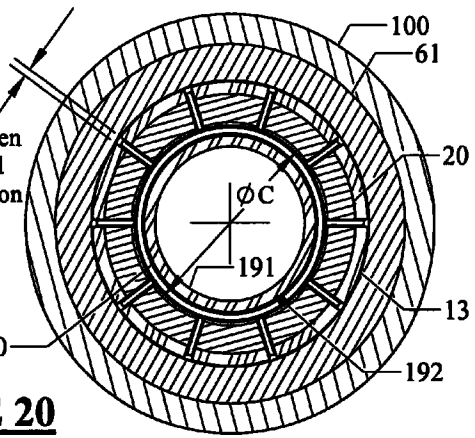
FIG. 20 is a transverse cross-sectional view of the gripping device of FIG. 16 taken along line 20-20, wherein the gripping element is shown in its fully axially stretched position. The location of the cross-section relative to the lower end of the tool is the same as in FIG. 18.
Figure 19:
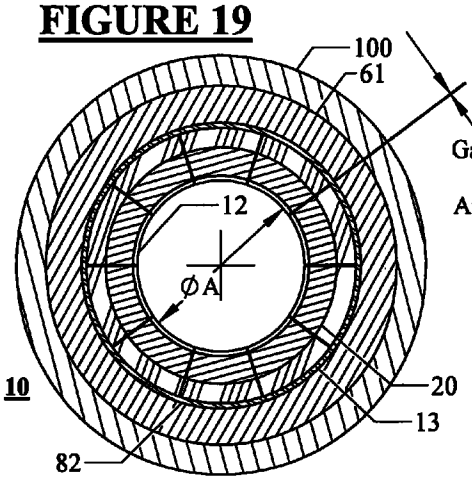
FIG. 19 is a transverse cross-sectional view of the at rest gripping device of FIG. 15, taken along line 19-19.
Figure 21:
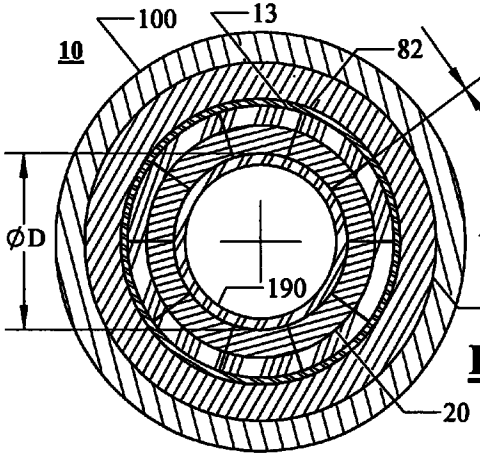
FIG. 21 is a transverse cross-sectional view of the gripping device of FIG. 18 taken along line 21-21, wherein the gripping element is shown gripping and sealing to the exterior of a casing with an external coupling. The location of the cross-section relative to the lower end of the tool is the same as in FIG. 18.
Figure 23:
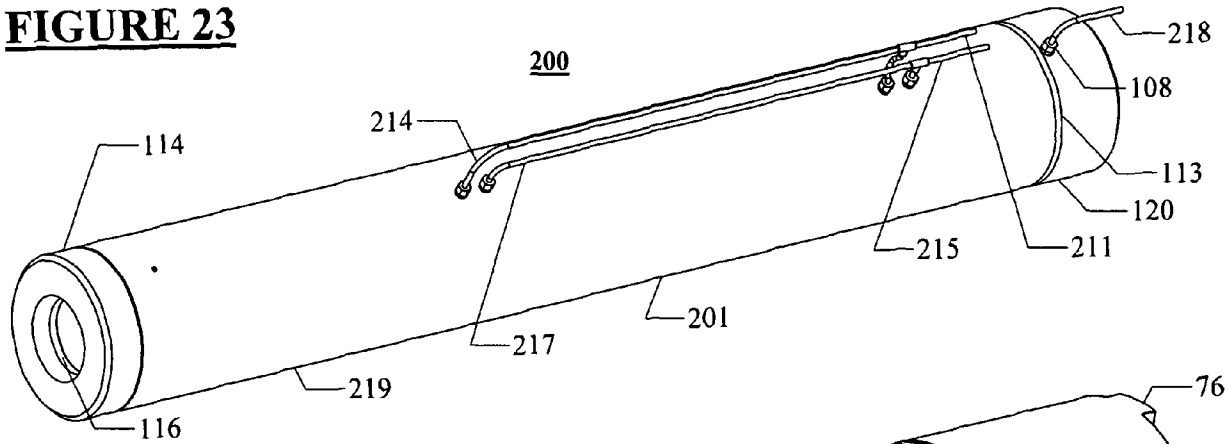
FIG. 23 is an oblique view of a second embodiment of the present invention, wherein multiple externally gripping modules are housed within a single body in order to increase capacity of the gripping device.

The combination of the inner diameter of the solid rings and the kerf width of the cuts separating the solid rings is selected according to the following criterion. When each of the resultant sets produced by the segmentation of the solid rings into lower 20 and upper 26 antiextrusion segments are grouped in circumferential arrays so that the adjoining segments abut on their lateral faces produced by the cuts, the minimum diameter of the circumferential array closely approximates the smallest expected radially externally compressed diameter of the casing 190 for which the elastomeric gripping element 12 is designed. FIGS. 19 to 21 show cross-sectional views of the positions of the lower antiextrusion segments 20 when the gripping device 10 is respectively relaxed, stretched, and gripping. FIG. 21 shows how the adjacent antiextrusion segments 20 substantially abut laterally to minimize elastomer 13 extrusion during gripping. The behavior of the upper antiextusion segments 26 is substantially the same as that for the segments 20.

After the solid rings are segmented, each resultant antiextrusion segment 20 or 26 is provided with an elongated external dovetail groove slot 23 located with its midplane on the central radial plane of the segment. The dovetail grooves 23 of the antiextrusion segments 20 and 26 are symmetrical about the radial midplanes of the segments and have a constant cross-section. The dovetail grooves 23 are cut parallel to the sliding contact face 24 and are both undercut and open at the external ends of the segments. The radially outer portion of the dovetail grooves 23 has parallel opposed sides, while the interior portion increases in width with distance from the sliding contact face 24. Thus, the outer parallel sides of the slots 23 are narrower than the inner parallel corners of the slots; the interior ends of the slots are rounded. A typical angle between the opposed inclined sides of the slots 23 is 60°.

The centrally positioned elastomeric sleeve 13 portion of the gripping element 12 is formed by compression molding the elastomer so that it is bonded to the respective bonding faces 21 of the lower 20 and upper 26 distally located and axially opposed antiextrusion segments. The restraining rings 19 are molded and bonded into the outer cylindrical surface of the elastomeric sleeve 13 during the molding process.

When the gripping element 12 is constructed, the antiextrusion segments 20 and 26 are placed in the mold (not shown) so that their respective bonded faces 21 are opposed and facing inwardly. The respective bores 22 of the segments 20 and 26 are coaxially located in the mold with the segment inner bore surfaces abutting a cylindrical pin or pins coaxial to the mold and having a local outer diameter equal to the turned bore diameter of the source solid ring for the antiextrusion segments.

Thin temporary planar filler pieces (not shown) having widths equal to the kerf widths of the cuts between the ring segments may used during the molding to ensure that the individual segments 20 are equally spaced from each other. The same approach may be used for the segments 26. Such filler pieces (not shown), inserted in the radial planes between the segments, may be made of polytetrafluoroethylene or some other similar material which will not bond to the elastomer. The function of the filler pieces is to prevent bonding from occurring between the circumferentially adjacent end ring segments 20 and 26 on their radially cut faces.

The extension of the filler pieces into the elastomeric sleeve 13 produces multiple stress relief slots 17 in radial planes in the distal ends of the elastomer and thereby permits the molded gripping element to be axially stretched without tearing occurring near the bonded interface between the elastomer 13 and the segmented end rings 20 and 26. These stress relief slots 17 are best seen in FIGS. 2 through 5. The slot ends are rounded in order to produce stress relief grooves 18 which reduce tearing tendencies at the ends of the slots in the elastomeric sleeve 13 when it undergoes hoop tension or axial tension. The filler pieces may extend into the body of the elastomer sleeve 13 and have enlarged, rounded ends which extend in a radial direction in order to produce the stress relief grooves 18. Alternatively, the elastomer sleeve 13 may be cut by waterjet or other means to produce the stress relief slots 17 and the slot radially oriented terminal stress relief grooves 18.

As best seen in FIG. 4, the cross-sectional profile of the relaxed elastomeric sleeve 13 portion of the gripping element 12 has a symmetrical axially outwardly diverging frustroconical bonding face at each distal end. These faces are bonded onto the respective bonded faces 21 of the antiextrusion segments 20 and 26 during the compression molding process for the elastomer. At the outer end of these bonding faces are located symmetrical axially axially inwardly converging and radially outwardly diverging frustroconical faces which are inclined and sized to smoothly match the frustroconical sliding contact surfaces 24 of the of the antiextrusion segments 20 and 26, respectively.

Cojoining these distal axially inwardly converging and radially outwardly diverging exterior frustroconical surfaces of the elastomeric sleeve 13 is an elongated constant outer diameter central section in which one or more of the thin walled right circular cylindrical contraction restraining rings 19 are axially spaced apart and bonded and embedded with their outer surfaces flush with the outer diameter of the elastomer. The axial length of the contraction restraining rings 19 is small relative to the length of the gripping element. The contraction restriction rings are spaced apart from the segmented end rings and, if multiple rings are used, from each other. The purpose of the restraining rings 19 is to minimize the tendency of the body of the stretched elastomeric sleeve 13 to reduce its internal diameter when axially stretched.

The through bore 14 of the molded elastomeric element 13 has a complex configuration with a short right circular cylindrical section on each of its distal ends, with the diameter of these cylindrical sections equal to that of the as-molded bore 22 positions of the antiextrusion segments 20 and 26, respectively. On the upper end of the lower cylindrical section of the inner face is located a short upwardly and radially inwardly converging first frustroconical face inclined to the axis of the gripping element by approximately 45°. Adjoining the upper end of this short inwardly converging first frustroconical face is an elongated radially outwardly and upwardly diverging second frustroconical face having a very small angle with the gripping element axis. This second frustroconical face extends most of the length of the elastomer through bore 14 from the upper end of the short lower first frustroconical face to a very short upwardly and outwardly diverging third frustroconical face adjoining the lower end of the upper short cylindrical segment of the inner face.

The minimum diameter at the intersection of the first and second frustroconical interior faces of the molded elastomeric sleeve is referred to as the first end of the bore 15, while the intersection of the second and third interior frustroconical faces is referred to as the second end of the bore 16. The first end of the bore 15 has a diameter shown in FIG. 4 as $\phi A$, while the second end of the bore 16 is shown in FIG. 4 as $\phi B$, with $\phi B > \phi A$. Diameters $\phi A$ and $\phi B$ are less than the outer diameter of the casing 190 to be gripped.

Figure 5:
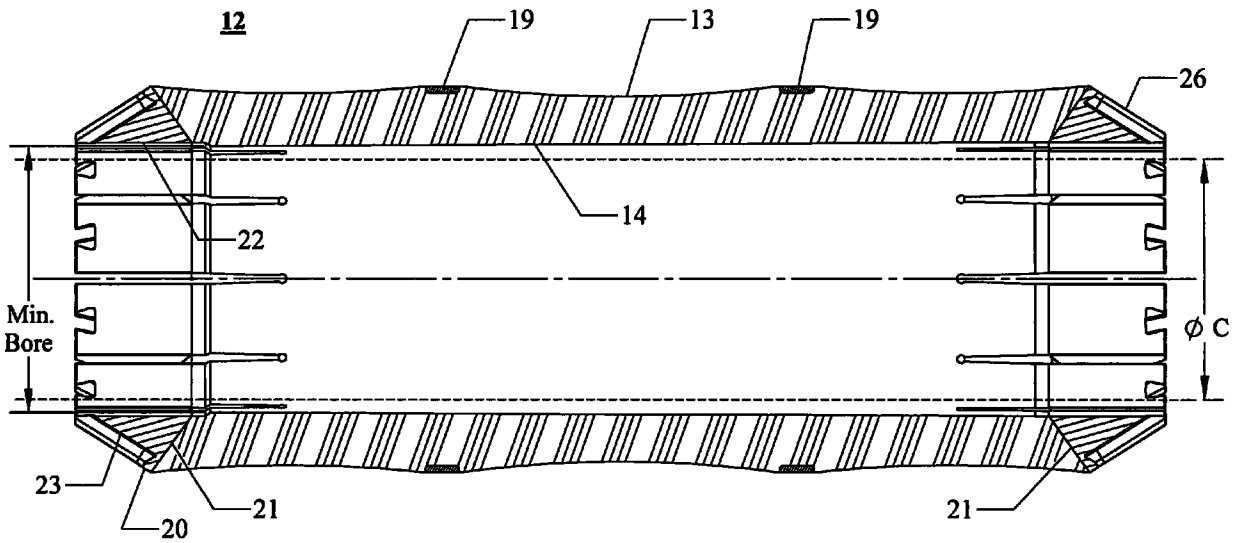
FIG. 5 is a longitudinal sectional view of the gripping element of FIG. 3, with the gripping element axially stretched in order to enable it to pass by a casing coupling and to be installed coaxially over a tubular casing. The outer periphery of a tubular casing to be gripped is indicated by dashed lines.

This configuration of the relaxed gripping element 12 shown in FIG. 4 thus would have radial interference with the outer diameter of a casing 190 (without its coupling 192) inserted into the through bore 14 in the central portion of the gripping element 12 between the first 15 and second 16 ends of the bore 14. This interference of the elastomeric sleeve 13 in the relaxed state with the example nominal 7 inch casing is indicated by the dashed lines in FIG. 4 showing the outer surface position of an axially located casing. When the gripping element 12 is axially stretched, as shown in FIG. 5, the minimum bore of the gripping element 12 is increased so that it is sufficiently larger than ϕC, the casing diameter, and the maximum diameter of the casing coupling 192, in order to permit axial passage of the casing and its coupling.

Figure 7:
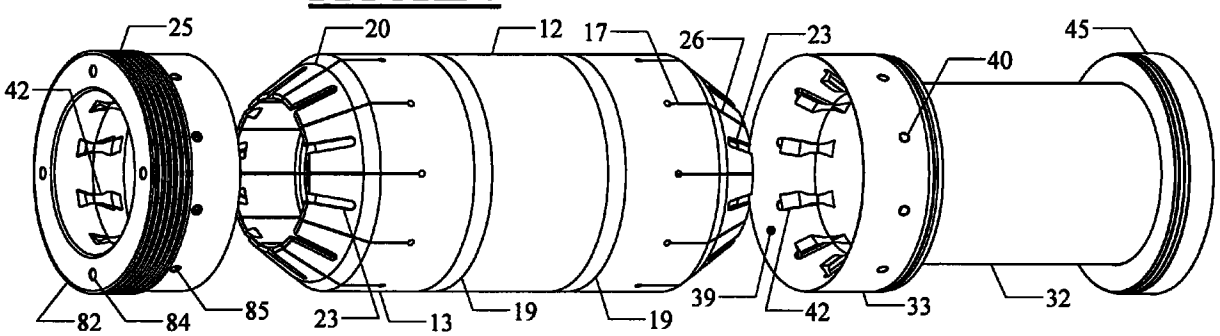
FIG. 7 is an oblique partially exploded view of a gripper anchor ring, a gripping element, and a puller sleeve with its attached piston head. These elements are installed as a unit in the body assembly of the first embodiment of the gripping device.
Figure 8:
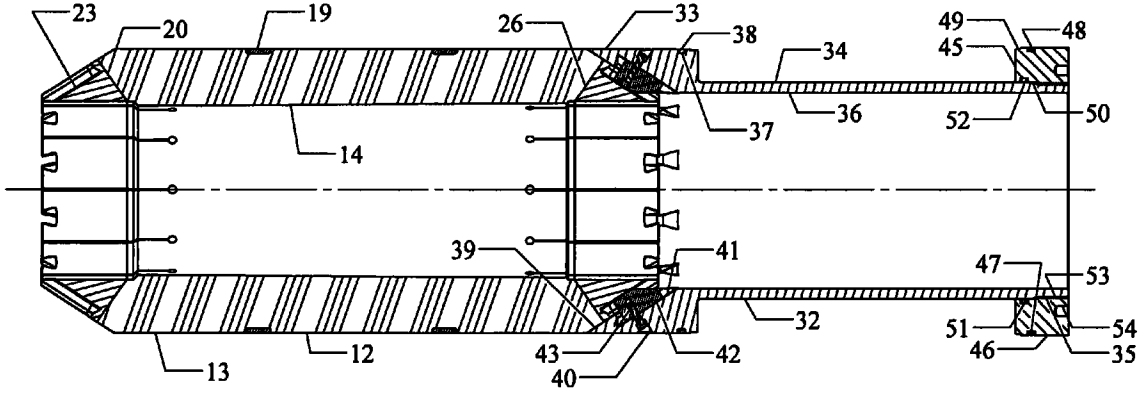
FIG. 8 is a longitudinal sectional view of the unstressed gripping element of FIG. 2 attached to the puller sleeve and piston head of its tensioning means, previously shown in the exploded view of FIG. 7.

As best seen in FIGS. 7 and 8, the gripping element 12 at its upper end is attached to an annular puller sleeve 32. This attachment is effected by using guides 42, each of which is engaged in opposed adjacent dovetail grooves 23 of the upper antiextrusion segment 26 and 41 of the puller sleeve 32. The puller sleeve 32 has, sequentially from its upper end, a long straight through bore 36 sufficiently large to freely clear a casing coupling 192 and an adjacent downwardly and radially outwardly diverging frustroconical sliding contact face 39. The frustroconical sliding contact face 39 has the same conical angle relative to its axis of symmetry as that of the sliding contact faces 24 of the upper antiextrusion segments 26, so that the two frustroconical surfaces 39 and 24 are comatable when the parts are axially aligned.

The frustroconical sliding contact face 39 of the puller sleeve 32 is provided with a regularly spaced concentric array of internal dovetail grooves 41, each of which is symmetrical about its central plane which passes through the longitudinal axis of the puller sleeve 32. The number of dovetail grooves 41 is the same as the number of dovetail grooves 23 in the set of upper antiextrusion segments 26. The dovetail grooves 41 of the puller sleeve 32 have a constant cross-section. The dovetail grooves 41 are symmetrically cut parallel to the sliding contact face 39 so that they are undercut and open into the bore 36 of the puller sleeve 32, similarly to the external dovetail grooves 23 of the antiextrusion segments 20 and 26.

The radially inward portion of the dovetail groove 41 cross-sections adjacent the sliding contact face 39 has opposed parallel sides, while the radially outward interior portion of the grooves increases in width with distance from the sliding contact face 39. Thus, the radially inward parallel sides of the slots 41 are narrower than the interior parallel corners of the slots. The interior ends of the slots, opposed to where the slots 41 intersect the through bore 36 of the puller sleeve 32, are rounded. A typical angle between the opposed inclined sides of the slots 41 is 60°. The angle between the opposed inclined sides of the slots 41 is the same as the angle between the opposed inclined sides of the dovetail groove 23 of the upper antiextrusion segment 26.

A constant diameter external cylindrical upset lower head 33 adjoins the lower end of the sliding contact face 39 and has a length equal to about one fourth of the total length of the puller sleeve 32. The upset lower head 33 has an intermediate male O-ring groove 37 containing an O-ring 38 and backup ring. At the upper end of the upset lower head 33 is a chamfer and an adjacent short reduced diameter segment which is connected to an adjoining upwardly facing intermediate transverse shoulder by a small chamfer.

A countersunk screw hole 40 penetrating the upset lower head 33 is positioned on the midplane of each dovetail groove 41 so that it is perpendicular to the floor of its individual slot and located at approximately midlength of the groove. Sequentially in the upward direction above the upwardly facing transverse shoulder of the puller sleeve 32 are located an elongated cylindrical reduced shank 34 having a male thread 35 at its distal upper end and a transverse upper end shoulder adjoining the through bore 36.

The guides 42 have a short body having a prismatic constant cross-section which is symmetrical about two planes. The top and bottom surfaces of the cross-section are parallel and flat. From the top side of the cross-section, the upper opposed lateral faces of the guide 42 converge downwardly at the same angle as the inclined walls of the dovetail grooves 41 of the puller head 32 and then meet parallel opposed vertical middle faces. From the lower edge of the parallel vertical middle faces of the cross-section of the guide 42, the lower faces of the cross-section then diverge outwardly and downwardly at the same angle as the sides of the dovetail grooves 23 of the upper antiextrusion segments 26.

The size of the cross-section of the guide 42 is such that it is a close slip fit into both a dovetail groove 23 of the upper antiextrusion segment 26 and also a dovetail groove 41 of the puller sleeve 32. A drilled and tapped hole penetrates the top surface of the guide 42 perpendicular to that surface and located in its center. Viewed from the side normal to the vertical longitudinal midplane of the guide 42, one end of the lower portion of the guide is machined off at an angle to the bottom surface equal to the angle of the sliding contact face 39 of the puller sleeve 32. Approximately half of the length of the bottom face is removed. This cut is made so that the guide 42 will not protrude into the through bore 36 of the puller sleeve 32 when installed in the dovetail groove 41.

As seen in FIG. 8, a guide 42 is installed in dovetail groove 41 by inserting a retainer screw 43 in the screw hole 40 of the puller sleeve 32 and then threadedly engaging the screw with the threads of the central hole in the top surface of the guide. The head of the screw 43 is recessed in its countersunk screw hole 40. When the sliding contact face 39 of the puller sleeve 32 is abutted against the sliding contact faces 24 of the upper antiextrusion segments, the guides 42 may be inserted into their operating positions through the bore of the puller sleeve 32. For this to occur, the pairs of dovetail grooves 23 of the upper antiextrusion segments 26 and the dovetail grooves 41 of the puller sleeve 32 are aligned to be coplanar. At that point, the position of the individual guides 42 along the length of their respective dovetail grooves can be shifted until their retainer screws 43 can be inserted from the outside through holes 40 of the puller sleeve 32 and the tapped holes of the guides to ensure retention.

Figure 47:
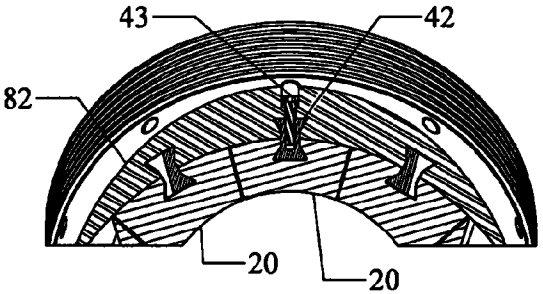
FIG. 47 is a cross-sectional view of the engaged gripping element and the gripper anchor ring taken along the line 47-47 of FIG. 45.
Figure 46:
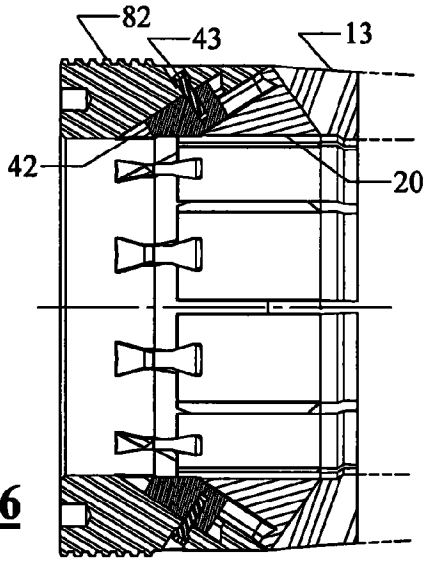
FIG. 46 is a longitudinal cross-sectional view of the stretched gripping element of FIGS. 3 and 5 attached to the gripper anchor ring of FIG. 6, showing how the interconnection of the two elements by means of the guides constrains the movement of the lower antiextrusion segments of the gripping element.
Figure 45:
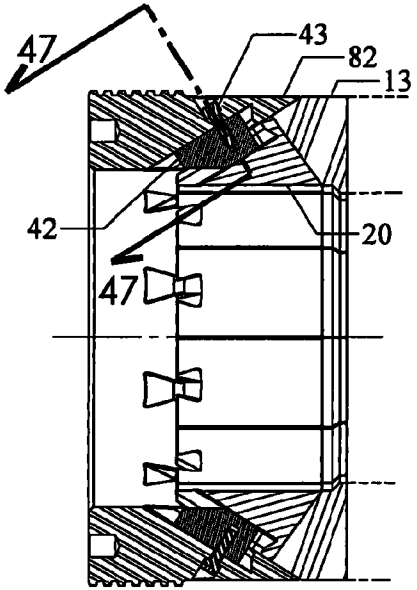
FIG. 45 is a longitudinal cross-sectional view of the at-rest gripping element of FIGS. 2 and 4 attached to the gripper anchor ring of FIG. 6 showing details of the interconnection of the two elements by means of the guides.

The guides 42 are also used to interconnect the gripper anchor ring 82 and the lower antiextrusion segments 20. The interrelationships between the guides 42 and their mounting pieces 32 and 82 are identical, as are the interrelationships between the guides 42 and both the upper 26 and lower 20 antiextrusion segments. Referring to FIGS. 45 through 47, the mutual engagement between the interior dovetail grooves 86 of the gripper anchor ring 82 and the comating guides 42 mounted therein by their retainer screws 43 may be seen.

Likewise, the comating arrangement of the guides 42 with the internal dovetail grooves 41 of the puller sleeve 32 is substantially the same as that for the internal dovetail grooves 83 of the gripper anchor ring 82. The enlarged upper sides of the cross-section of the guides 42 are entrapped within the internal dovetail grooves 41 and 83 of the puller sleeve 32 and the gripper anchor ring 82, respectively. This permits the guides 42 to resist tension loads acting in the radial planes of the guides and tending to pull the guides out of their respective dovetail grooves.

For both the upper 26 and lower 20 antiextrusion segments, the lower sides of the cross-section of the guides 42 are also entrapped within their respective external dovetail grooves 24. The guides 42 thus can resist tension loads acting in the radial planes of the guides and tending to pull them out of the dovetail grooves 24 of the upper and lower 20 antiextrursion segments. The guides 42 have a slip fit with the dovetail grooves 24 of their respective engaged upper 26 and lower 20 antiextrusion segments. This permits the individual antiextrusion segments 26 to move in the radial midplane of their engaged guide 42 tangentially to the frustroconical sliding contact face 39 of the puller sleeve 32. Similarly, the individual antiextrusion segments 20 can move in the radial midplane of their engaged guide 42 tangentially to the frustroconical support face 83 of the gripper anchor ring 82.

An annular piston head 45 is threadedly attached to the male threads 35 at the upper end of the puller sleeve 32. The piston head 45 is an axially short annular ring having transverse upper and lower ends. At its upper interior end, the piston head 45 has an upper female straight thread 53 comatable with the male thread 35 at the upper end of the puller sleeve 32. Adjoining and below the female thread 53 is a slightly larger cylindrical inner bore 50 having a female O-ring groove 51 intermediate to its length and containing an O-ring 52 with backup rings. The diameter of the cylindrical bore segment 50 with the female O-ring groove 51 is a close fit to the elongated reduced shank 36 of the puller sleeve 34, so that the O-ring 52 installed in its groove 51 can seal the gap between the two parts 32 and 45.

On its exterior, the piston head 45 has a short reduced diameter cylindrical section 49 at its lower end and then a longer enlarged cylindrical portion 46 with an intermediate O-ring groove 47 containing O-ring 48 with backup rings. The upper transverse face of the piston head 45 has a regular array of spanner holes 54 parallel to and equispaced from the piston head axis. The O-ring 48 provides a seal between the piston head 45 and the primary bore 62 of the cylinder body 61.

Figure 9:
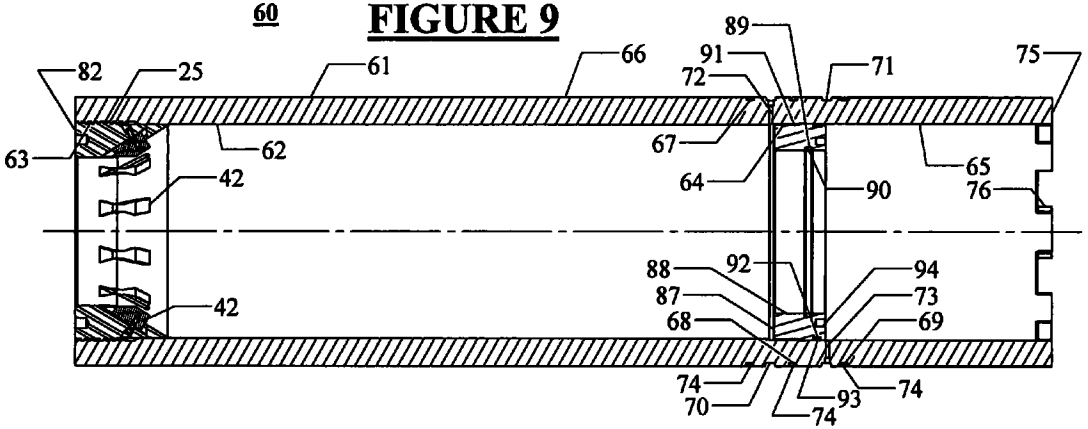
FIG. 9 is a longitudinal sectional view of the cylinder assembly for housing the elements shown in FIGS. 7 and 8. The elements of the cylinder assembly comprise the static portion of the internals of the gripping device.

The cylinder assembly 60, shown in FIG. 9, consists of cylinder body 61, a gripper anchor ring 82, and a static bulkhead 87. The cylinder assembly 60 houses the assembled combination of the gripping element 12, the puller sleeve 32, and the piston head 45 and also anchors the lower end of the gripping element 12. Additionally, the cylinder assembly 60 is arranged to provide two separate hydraulic fluid communication channels to axially reciprocate the puller sleeve 32 and its attached piston head 45 so that the gripping element 12 can be selectably stretched and relaxed.

The cylinder body 61 is a right circular cylindrical tube having transverse ends, an exterior cylindrical surface 66, and an interior stepped bore having a lower end female thread 63 and an upper female thread 64 which is intermediate to the length of the cylinder body. The lower 63 and upper 64 female threads are cut from opposed directions with thread reliefs on their interior ends. The lower female thread 63 is a stub acme thread for mounting the gripper anchor ring 82. The upper female thread 64 is used to mount the static bulkhead 87. The cylindrical primary bore 62, located between the lower female thread 63 and the upper female thread 64, has a diameter equal to or smaller than the minor diameter of threads 63 and 64. The primary bore 62 has a close slip fit to gripping element 12 and the upset lower head 33 of the puller sleeve 32. The upper bore 65, located above the upper female thread 64, has a diameter larger than the major diameter of the upper female thread 64. Upper bore 65 has a close slip fit with the outer cylindrical surface 46 of the piston head 45.

On its outer cylindrical surface 66, intermediate to its length and sequentially positioned from its lower end, the cylinder body 61 three O-ring grooves 67, 68, and 69, with each containing an O-ring 74 with backup rings. The outer cylindrical surface 66 is a close slip fit to the main bore 101 of the housing 100 of the body assembly 99 of the gripping device 10. On the exterior cylindrical surface 66 of cylinder body 61 between the O-ring grooves 67 and 68 is located a first external annular fluid channel 70. Above and adjacent to the fluid channel 70, a second similar annular fluid channel 71 is located between the O-ring grooves 68 and 69.

When housed in the main bore 101 of the housing 100 which will mount the cylinder assembly, the middle O-ring 74 isolates the substantially identical fluid channels 70 and 71 from each other. The lower O-ring 74 isolates the fluid channel 70 from the lower annulus between the cylinder body 61 and the main bore 101 of the housing 100. The upper O-ring 74 isolates the fluid channel 71 from the upper annulus between the cylinder body 61 and the main bore 101 of the housing 100. The cross-section of the annular fluid channels 70 and 71 is approximately rectangular.

A radially drilled through hole having a counterdrilled and reamed enlarged outer end forms first radial fluid channel 72, while a similar hole forms a second radial fluid channel 73. The first radial fluid channel 72 is centered in the first annular fluid channel 70, while the second radial fluid channel 73 is centered in the second annular fluid channel 71. The first radial fluid channel 72 penetrates the wall of the cylinder body 61 just below the upper female thread 64, while the second radial fluid channel 73 similarly penetrates a short distance above the upper female thread 64.

The location of the second radial fluid channel 73 is sufficiently removed from the upper female thread 64 that there is room for O-ring 93 housed in the male O-ring groove 92 of the installed static bulkhead 87 to seal to the upper bore 65 of the cylinder body 61 between the thread 64 and the radial fluid channel 73. As shown herein, the radial fluid channels 72 and 73 are on opposite sides of the cylinder body 61, but their relative alignment is not critical.

As seen in FIG. 9, at its upper transverse end 75 the cylinder body 61 has a regular pattern of substantially identical male dog clutch teeth 76. By way of example, eight dog clutch teeth 76 are shown. The sides of the cuts to create the dog clutch teeth 158 are approximately radial, but the cuts are slightly wider than the uncut portion. This is so that the male dog clutch teeth 126 of the top drive adaptor 120 of the body assembly 99 can be comated in between the teeth 76 of the cylinder body 61. This comating of dog clutch teeth permits any torque transmitted between the gripping element 12 and the casing 190 and then from the gripping element to the primary bore 62 of the cylinder body 61 to be transferred into the top drive adaptor 120 and then into the top drive (not shown), which supports the gripping device 10.

Figure 6:
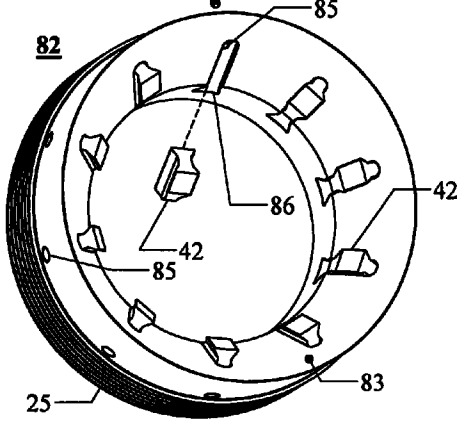
FIG. 6 is an oblique partially exploded view of the gripper anchor ring, showing the arrangement of dovetailed guide pieces which constrain the relative motion of the antiextrusion elements bonded to the ends of the elastomeric gripping element.

The gripping element 12 is mounted at its lower end to a gripper anchor ring 82, which is best seen in FIGS. 6 and 7. The gripper anchor ring 82 has a short through bore sufficiently large to freely clear a casing coupling 192, an adjoining transverse lower face, an external male helical stub acme thread 25 adjacent the lower transverse face, a slightly reduced diameter cylindrical outer face adjacent to and above the thread 25, and an interior frustroconical sliding contact support face 83 converging downwardly toward the lower end of the gripper anchor ring 82 from the intersection of the support face 83 and the cylindrical outer face.

The support face 83 intersects the upper end of the through bore. The male thread 25 is threadedly comatable with the lower female thread 63 of the cylinder body 61 of the cylinder assembly 60. The exterior cylindrical face, located above the male thread 25, is a close slip fit to the primary bore 62 of the cylinder body 61.

The angle of the sliding contact support face 83 of the gripper anchor ring 82 corresponds to that of the sliding contact face 24 of the lower antiextrusion segments 20, so that these adjoining pieces are axially comatable and able to readily transmit contact loads under axial compression. A regular array of spanner wrench holes 84 parallel to and offset from the axis of the anchor ring 82, is provided in the lower transverse face of the anchor ring 82. Externally countersunk keeper screw holes 85 penetrate the sliding contact support face 83 of the gripper anchor ring 82 in a regular pattern corresponding to the pattern of dovetail grooves 86 in the lower antiextrusion segments 20 of the gripping element 12. The screw holes 82 are in radial planes and are perpendicular to the sliding contact support face 83 at their point of penetration.

The frustroconical sliding contact support face 83 of gripper anchor ring 82 is provided with a regularly spaced concentric array of internal dovetail grooves 86, each of which is symmetrical about its central plane which passes through the longitudinal axis of the gripper anchor ring 82. The number of dovetail grooves 86 is the same as the number of dovetail grooves 23 in the set of lower antiextrusion segments 20, and the dovetail grooves 86 of the gripper anchor ring 82 have a constant cross-section. Because the same guides 42 are used both for the upper 26 and lower 20 antiextrusion segments, the profile of the dovetail grooves 86 in the gripper anchor ring 82 is substantially identical to that of the grooves 41 in the puller sleeve 32. The dovetail grooves 86 are cut parallel to the sliding contact support face 83 and are undercut and open into the through bore of the gripper anchor ring 82.

The radially inward portion of each dovetail groove cross-section adjacent the sliding contact support face 83 has parallel sides, while the radially outward interior portion of the groove increases in width with distance from the support face. Thus, the radially inward parallel sides of the dovetail grooves 86 are narrower than the interior parallel corners of the grooves. The interior ends of the dovetail grooves 86, opposed to where the slots 86 intersect the through bore of the gripper anchor ring 82, are rounded. A typical angle between the opposed inclined sides of the dovetail grooves 86 is 66 The angle between the opposed inclined sides of the dovetail grooves 86 is the same as the angle between the opposed inclined sides of the dovetail groove 23 of the lower antiextrusion segment 20.

Each dovetail groove 86 of the gripper anchor ring 82 has a guide 42 installed in the groove with a close slip fit, as indicated in FIGS. 6, 7, and 8. The guides 42 are positioned so that they do not intrude into the bore of the gripper anchor ring 82. Each of the guides 42 are retained in position in their respective grooves 86 by a keeper screw 43 inserted into the appropriate countersunk keeper screw hole 85 and then threadedly engaged with the central tapped hole in the top surface of the guide.

Figure 10:
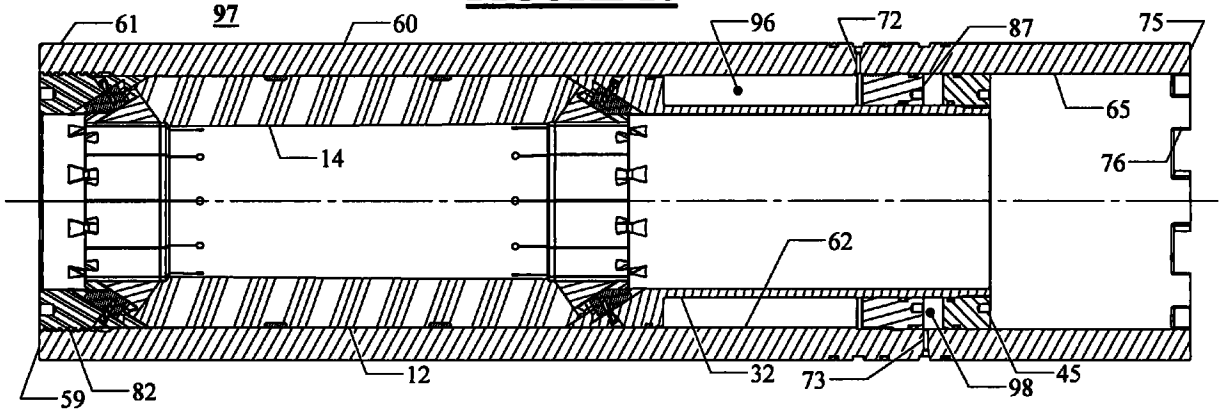
FIG. 10 is a longitudinal sectional view of the combined gripper anchor ring, gripping element, and puller sleeve with its attached piston head of FIG. 8 housed within the bore of the cylinder housing of FIG. 9, wherein the elements of FIG. 8 cooperate to engage, grip, and disengage from a casing. The components shown in FIG. 10 constitute a gripper module.

Similarly to the installation of the guides 42 between the upper antiextrusion segments 26 and the puller sleeve 32, when the sliding support face 83 of the gripper anchor ring 82 is abutted against the sliding contact faces 24 of the lower antiextrusion segments 20 as seen in FIG. 10, the guides 42 may be inserted into their operating positions through the bore of the gripper anchor ring 82. For this to occur, the pairs of dovetail grooves 23 of the lower antiextrusion segments 20 and the dovetail grooves 83 of the gripper anchor ring 82 are aligned to be coplanar. At that point, the position of the individual guides 42 along the length of the dovetail grooves can be shifted until their retainer screws 43 can be inserted from the outside through the holes 85 of the gripper anchor ring 82 and the tapped holes of the guides to ensure retention.

The static bulkhead 87, best seen in FIG. 9, is threadedly attached by means of its external male thread 91 to the upper female thread 64 in the intermediate portion of the bore of the cylinder body 61 of the cylinder assembly 60. The static bulkhead 87 is an axially short annular ring having transverse ends. At its lower exterior end, the static bulkhead 87 has a male thread 91 threadedly comatable and engaged with the upper female thread 64 of the cylinder body 61. Adjoining the threaded exterior portion at its upper end is a slightly larger cylindrical segment with a male O-ring groove 92 located between the thread 91 and the upper end of the static bulkhead 87. The diameter of the O-ring grooved exterior cylindrical segment is a close fit to the upper bore 65 of the cylinder body 61, so that an O-ring 93 with backup rings installed in its groove 92 can seal the gap between the static bulkhead 87 and the cylinder body 61.

On its interior cylindrical side, the static bulkhead 87 has a constant diameter cylindrical through bore section 88 with an intermediate female O-ring groove 89 containing O-ring 90 with backup rings. The bore 88 of the static bulkhead 87 is a close sliding fit to the elongated cylindrical reduced shank 36 of the puller sleeve 32, so that O-ring 90 is able to seal therebetween. The upper transverse face of the static bulkhead 87 head has a regular array of spanner holes 94 parallel to and equispaced from the axis of the static bulkhead.

FIG. 10 shows the gripping element 12 with its attached puller sleeve 32 and piston head 45 mounted within the primary bore 62 of the cylinder body 61 of the cylinder assembly 60. This arrangement of components constitutes a gripper module 97. The puller sleeve 32 and the gripping element 12 are reciprocable within the primary bore 62 of the cylinder body 61, while the piston head 45 is reciprocable within the upper bore 65 of the cylinder body.

The set of guides 42 are engaged both in the dovetail grooves 23 of the lower antiextrusion segments 20 and are also engaged into the dovetail grooves 86 of the gripper anchor ring 82 for starting the assembly of the gripper module 97. The upper end of the gripper 12 is also attached to the puller sleeve 32, but without the piston head 45. The subassembly of the gripper 12, puller sleeve 32, and the gripper anchor ring 82 is then inserted into the lower end of the cylinder body 61. Following this, the male thread 25 of the gripper anchor ring 82 is engaged with the lower female thread 63 until the lower transverse end of the gripper anchor ring is flush with the lower transverse end 59 of the cylinder body.

Continuing the assembly of the gripper module 97, the static bulkhead 87 is inserted into the upper bore of the cylinder body 61 and its male thread 91 is threadedly engaged with the upper female thread 64 of the cylinder body. At this point, the upper end male thread 35 of the puller sleeve 32 is exposed above the static bulkhead 87. The female thread 53 of the piston head 45 is then threadedly engaged with the upper end male thread of the puller sleeve 32 to complete the assembly of the gripper module 97.

For the gripper module 97, the gripper anchor ring 82 retains the gripping element 12 within the cylinder assembly 60 when the puller sleeve 32 is upwardly pulled to stretch the gripping element as shown in FIG. 5. When the gripping element 12 with its attached puller sleeve 32 and piston head 45 are thus mounted within the interior of the cylinder assembly 60, a first pressure chamber 96 is formed between the puller sleeve 32, the static bulkhead 87, and the primary bore 62 of the cylinder body 61. This chamber 96 is isolated except through fluid connection through the first radial fluid channel 72 of the cylinder body 61.

Likewise, a second pressure chamber 98 is formed between the reduced diameter outer cylindrical surface 49 of the puller sleeve 32, the lower end of the piston head 45, the upper bore 65 of the cylinder body 61, and the upper end of the static bulkhead 87. This chamber 98 is isolated except through fluid connection through the second radial fluid channel 73. Thus the gripper module 97 constitutes a double acting hydraulic cylinder having hydraulic connections through the first 72 and second 73 radial fluid channels.

Figure 11:
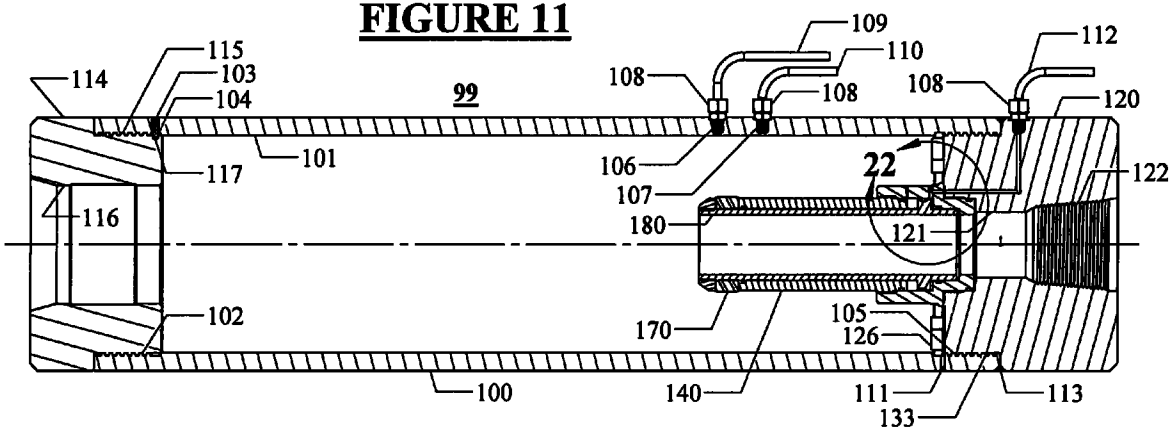
FIG. 11 is a longitudinal sectional view of the body assembly of the gripping device. The body assembly houses the components shown in FIG. 10.

The major components of the body assembly 99 of the first embodiment gripping device 10 of the present invention, shown in FIG. 11, include a housing 100, a lower cap 114, a top drive adaptor 120, and a casing stinger 140. The tubular housing 100 for the body assembly 99 has an uniform outer diameter with a large external chamfer serving as a groove weld preparation at the upper outer end, transverse ends, and a straight through bore 101 having female stub acme threads 102 and 105 at its distal ends. At the thread relief for the lower thread 102 of the housing 100, multiple regularly spaced drilled and tapped radial set screw holes 103 house radial set screws 104. The set screws 104 have half-dog points and their outer ends do not extend beyond the outer diameter of the housing 100.

A radial vent port 111 is drilled slightly below the upper female thread 105 so that when the top drive adaptor 120 is in place, as shown in FIG. 11, the vent port 111 is below and adjacent the lower transverse face of the top drive adaptor. First 106 and second 107 radial pressure ports are drilled through the body wall of housing 100 at locations so that they will intersect the first 70 and the second 71 annular fluid channels, respectively on the outer cylindrical surface 66 of the cylinder body 61 of the installed cylinder assembly 60.

The outer ends of these ports 106 and 107 in the wall of the housing 100 are profiled and tapped to sealingly accommodate commercially available straight-thread O-ring tube fittings 108. The tube fitting 108 in the first radial pressure port 106 is connected to a first hydraulic supply tube 109, while the tube fitting in the second radial pressure port 107 is connected to a second hydraulic supply tube 110. Hydraulic pressure and flow can be selectably applied to either of ports 106 and 107 by a conventional hydraulic power unit, as can be well understood by those skilled in the art.

The thick walled lower cap 114 of the body assembly 99 has transverse upper and lower ends joined on its outer surface by, from the lower end, a lower right circular cylindrical section adjoining an upwardly facing transverse shoulder, a reduced diameter stub acme male thread 115, and a short cylindrical section having a diameter slightly less than the minor diameter of the male thread. A large chamfer interconnects the lower transverse face of the lower cap 114 and the lower external cylindrical section.

When the male thread 115 of the lower cap 114 is threadedly engaged with the lower female thread 102 of the housing 100, the upper short cylindrical section of the lower cap is match drilled through the radial set screw holes 103 of the housing to form set screw detents 117. This permits the tips of radial set screws 104 threadedly engaged in the holes 103 to also be engaged in the resulting shallow detent holes 117 to prevent inadvertent loosening the connection of the lower cap 114 and the housing 100. The guidance bore 116 of the lower cap 114 has from its lower end a large entry bevel, a first straight bore, a slightly enlarged middle bore, and a second straight bore having the same diameter as that of the first straight bore. The diameter of the first and second straight bores of the guidance bore 116 is slightly larger than the outer diameter of the casing coupling 192.

Figure 13:
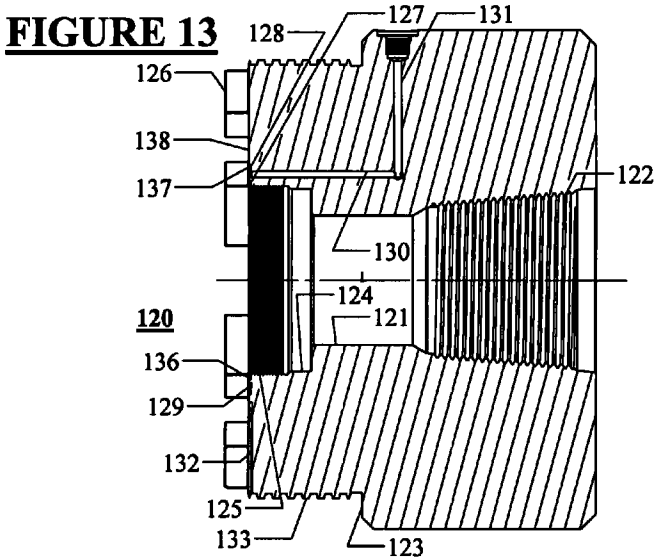
FIG. 13 is a longitudinal sectional view of the top drive adaptor of FIG. 12.
Figure 12:
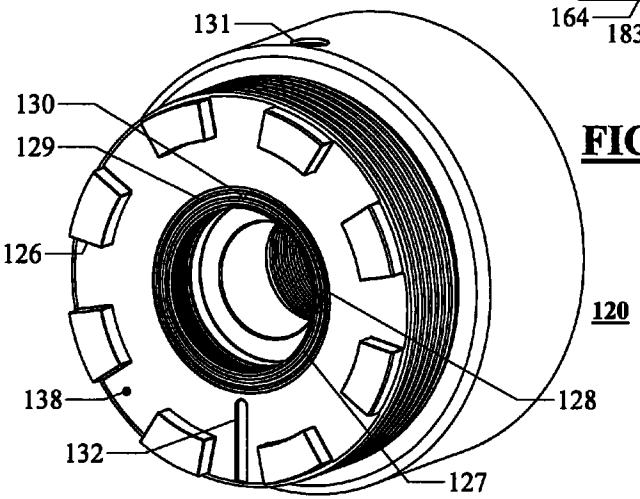
FIG. 12 is an oblique view showing the lower side of the top drive adaptor of the body assembly.

The top drive adaptor 120, shown in longitudinal cross-section in FIG. 13 and an oblique view in FIG. 12, is a thick wall right circular cylindrical annular element having a female API (American Petroleum Institute) tapered mounting thread 122 at its upper end. This thread is chosen to mate with a corresponding male thread on the bottom of either a top drive unit, a lower Kelly cock valve, or a saver sub (not shown). The mating thread supports the gripping device 10 and through the bore of the mating piece, drilling fluid may be selectably induced into a string of casing suspended from the gripping device 10.

In the through hole of the top drive adaptor 120 immediately below the thread 122 is a short straight through bore section 121 having a diameter smaller than that of thread 122. Adjoining bore 121 on its lower end is a downwardly facing transverse shoulder 123 and a counterbore 124, with the lower end of the counterbore having a slightly enlarged female straight thread 125 which serves as a mount for the casing stinger 140.

From the upper end of the top drive adaptor 120, its exterior cylindrical surface has a large chamfer, a straight right circular cylindrical section somewhat longer than half the length of the part, an external chamfer serving as a groove weld preparation adjoining a downwardly facing transverse shoulder 123, a thread relief, a male stub acme thread 133, and a short cylindrical surface having a diameter slightly less than the minor diameter of the thread 133. The male stub acme thread 133 is comatable with the upper female thread 105 of the housing 100. The lower transverse end of the top drive adaptor 120 has a central counterbore creating a transverse downwardly facing flat face 138 containing three concentric shallow annular grooves 127, 128, and 129, each having a rectangular cross-section. Inner face groove 127 and outer face groove 128 are face seal O-ring grooves.

The downwardly facing outer portion of the lower transverse end of top drive adaptor 120 is provided with a regularly spaced array of cuts to the depth of the counterbored face in order to create a set of basically identical downwardly facing male dog clutch teeth 126. The sides of the cuts to create the dog clutch teeth 126 are approximately radial, but the cuts are slightly wider than the uncut portion. This permits the upper male dog clutch teeth 76 of the cylinder body 61 to be comated with the downwardly facing male teeth 126. A radial vent face groove 132 extends radially outwardly across lower transverse flat face 138 from outside the outer face groove 128 of the dog clutch teeth 126 to the outer cylindrical surface on the lower transverse face of the part. The radial face groove 132 is approximately 0.25 inch (6 mm) deep and wide.

Figure 22:
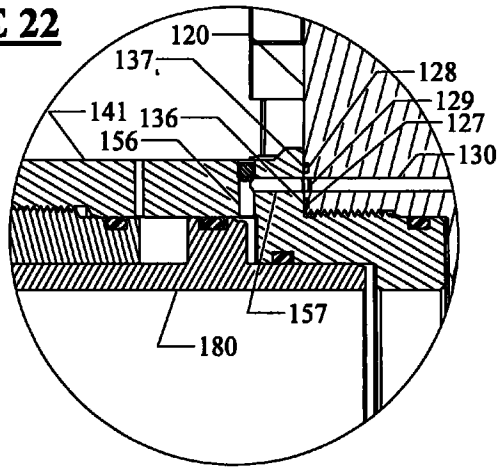
FIG. 22 is a detail view of the connection of the casing stinger to the top drive adaptor of the body assembly of the first embodiment. The view of FIG. 22 is enclosed by the circle 22 shown in FIG. 11.

The inner face groove 127 and the outer face groove 128 respectively house O-rings 136 and 137, as seen in the detail view of FIG. 22. The flow distribution groove 129 is another face groove located on the lower transverse face 138 intermediate between grooves 127 and 128 of the top drive adaptor 120. Flow distribution groove 129 is intersected by an off-axis flow port 130 which is drilled parallel to and spaced apart from the axis of the top drive adaptor 120. The length of flow port 130 is approximately half of the length of the top drive adaptor 120. Radial flow port 131 is drilled from the exterior of the top drive adaptor 120 to intersect off-axis flow port 130. On its outer end, radial flow port 131 is formed and tapped for a straight thread O-ring fitting. A straight thread O-ring fitting 108 is sealingly engaged with the outer end of radial flow port 131 and is in turn connected to third hydraulic supply tube 112 so that hydraulic flow can be delivered to and from flow distribution groove 129.

Male thread 133 of the top drive adaptor 120 is threadedly engaged with upper female thread 105 of the housing 100 of the body assembly 99. Following assembly of thread 133 with thread 105, circumferential groove weld 113 is made between the external chamfer at the upper end of housing 100 and the chamfer at the intermediate external transverse shoulder 123 of the top drive adaptor 120. The function of weld 113 is to prevent inadvertent disconnection of the threaded joint between the housing 100 and the top drive adaptor 120 whenever the gripping device 10 applies torque to the casing 190.

Figure 14:
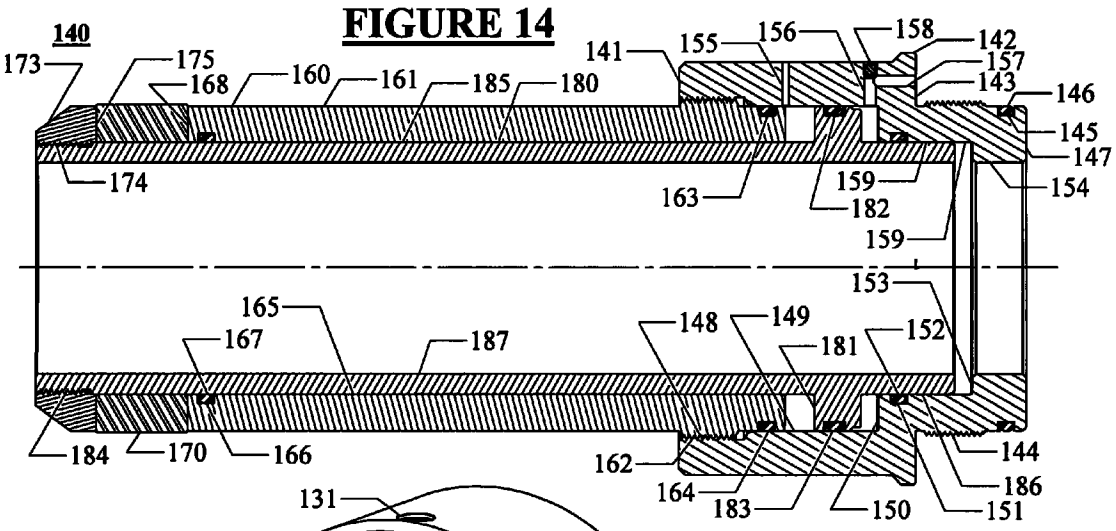
FIG. 14 is a longitudinal sectional view of the casing stinger of the gripping device.

The casing stinger assembly 140, shown in FIG. 14, is an assembly of a stinger base housing 141, a static tube 160, an end cap 173, a bonded annular seal 170 interconnecting the static tube and the end cap, and an actuator piston 180. The stinger base housing 141 is a stepped right circular cylindrical tube which mounts to the top drive adaptor 120. From its exterior lower end, the exterior of the stinger base housing 141 has a straight cylindrical section with an outwardly extending flange 142 at its upper end, an upwardly facing transverse flange 143, and an upwardly extending cylindrical section having a male thread 144 with a thread relief and a male O-ring groove 145 containing an O-ring 146 with a backup ring. The diameter of the straight cylindrical section below the flange 142 is approximately as large as the outer diameter of the coupling 192 of the casing 190. When male thread 144 is comated with thread 125 of the top drive adaptor 120, the O-ring 146 seals between the stinger base housing 141 and the counterbore 124 of the top drive adaptor.

The upper 147 and lower ends of the stinger base housing 141 are transverse shoulders. From its lower end, the bore of the stinger base housing 141 has a female thread 148 with a thread relief, an inwardly and upwardly extending bevel, a straight bore 149, an inwardly extending transverse shoulder 150, a shorter straight bore having a female O-ring groove 151 containing an O-ring 152 with a backup ring, another inwardly extending transverse shoulder 153, and an upper end straight bore 154.

At approximately midlength of the straight bore 149, a radially outwardly extending drilled vent hole 155 penetrates the wall of the stinger base housing 141. At the upper end of the straight bore 149, another radially extending drilled hole 156 having an exterior counterbore sealingly mounting a Sherex sealing plug 158 penetrates through to the outer cylindrical surface of the stinger base housing 141 just below the outwardly extending flange 142. Hole 157, which penetrates from the middle of transverse upwardly facing flange 143 to intersect hole 156, is parallel to and offset from the axis of the stinger base housing 141. Hole 157 is positioned to have the same offset from the axis of the stinger base housing 141 as the center of the flow distribution groove 129 has from the axis of the top drive adaptor 120.

From its lower end, the static tube 160 is an elongated right circular cylindrical element having a long constant diameter outer face 161 which has at its upper end a slightly upset male thread 162 followed straight cylindrical segment with a central male O-ring groove 163 holding an O-ring 164 with a backup ring. The diameter of outer cylindrical face 161 is a close slip fit to the minimum inner diameter 191 of the casing 190 into which the casing stinger 140 will be inserted. The diameter of the straight cylindrical segment at the upper exterior end of the static tube 160 has the same diameter as outer face 161.

The static tube 160 has a straight through bore 165 having a female O-ring groove 166 containing O-ring 167 with a backup ring adjacent its lower end. Both the upper and lower transverse ends of the static tube 160 are transverse, with the lower end 168 serving as a face for bonding to stretchable seal element 170. Thread 162 is threadedly engagable with female thread 148 of the stinger base housing 141, while O-ring 164 seals between the static tube 160 and the lower end of the straight bore 149 of the stinger base housing.

End cap 173 is a short cylindrical piece with a short transverse lower shoulder, a female thread 174 at the lower end of its bore, followed by a short inclined shoulder and a slightly enlarged short straight bore at the upper interior end of the part. The upper transverse face 175 serves as a bonding face connecting to stretchable seal element 170. The exterior of the end cap 173 has a large chamfer at its lower end between the lower transverse face and a straight cylindrical section extending to transverse face 175 at its upper end. The outer diameter of the end cap 173 is the same as that of the outer cylindrical surface 161 of the static tube 160.

Stretchable seal element 170 is an oil-resistant elastomer molded as a right circular cylindrical element which is bonded during molding to both the lower transverse end 168 of the static tube 160 and the upper transverse end 175 of the end cap 173. The bore of stretchable seal element 170 is the same as bore 165 of the static tube 160 and the short upper bore of the end cap 173. The outer diameter of stretchable seal element 170 is approximately 0.125 to 0.190 inch larger than both the outer cylindrical surface 161 of the static tube 160 and the exterior right circular cylindrical face of the end cap 173. The outer diameter of the stretchable seal element 170 is larger than the bore of any casing which might be gripped by the gripping device 10 of the present invention. The exterior corners of the stretchable seal element 170 may be slightly chamfered or radiused. When engaged with a casing bore 191 in a scaling relationship, bonded annular seal 170 simultaneously seals with the lower rod surface 185 of the actuator piston 180.

The actuator piston 180 of the casing stinger 140 has an elongated right circular cylindrical form with transverse upper and lower ends and a straight through bore 187. On its outer side from its upper end, the actuator piston 180 has a cylindrical upper rod surface 186 with a length equal to about 10 percent of the overall part length and an outwardly upset axially short piston head 181 having an O-ring groove 182 containing male O-ring 183 and a pair of backup rings centrally located on its outer cylindrical surface. The outer diameter of the piston head 181 is slightly relieved for a short length on the upper side of the piston head. Below the piston head 181 are long cylindrical lower rod surface 185 and male thread 184 at the lower end of the actuator piston 180. Male thread 184 is threadedly engagable with the female thread 174 of the end cap 173.

The diameter of the upper 186 and lower 185 rod surfaces are they same. Upper rod surface 186 has a close slip fit to second straight bore 159 of the stinger base housing 141, and lower rod surface 185 has a close slip fit to bore 165 of the static tube 160. The outer diameter of piston head 181 of the actuator piston 180 has a close slip fit to the seal bore 149 of the stinger base housing 141. O-ring 183 seals between the piston head 181 of the actuator piston and the first straight bore 169 of the stinger base housing. The O-ring 152 of the stinger base housing 141 seals to upper rod surface 186, while O-ring 167 of the static tube 160 seals to the lower rod surface 185.

Referring to FIG. 14, it can be seen that a vented chamber is formed between the lower side of the piston head 181 of the actuator piston 180 and the upper end of the static rod 160. Another chamber is formed between the upper end of the piston head 181 of the actuator piston 180 and the downwardly facing shoulder 150 of the stinger base housing 141. This second chamber is connected by way of radial flow passage 156 and off-axis flow passage 157 of the stinger base housing to the flow distribution groove 129, the off-axis flow port 130, and the radial flow port 131 of the top drive adaptor 120.

The casing stinger 140 thus forms a single-acting hydraulic cylinder. Downward extension of the casing stinger 140 is caused by introducing fluid into the upper chamber of the assembly. Upward retraction of the casing stinger 140 is caused by venting the upper chamber and elastomeric forces from the stretching of the bonded annular seal 170.

The face seal O-rings 136 and 137 in face seal grooves 127 and 128, respectively, of the top drive adaptor 120 isolate the flow distribution groove 129 when the upwardly oriented transverse shoulder 143 of the stinger base housing 141 is abutted against the lower transverse flat face 138 of the top drive adaptor 130. This abutment of the two faces is produced by fully screwing the thread 144 of the stinger base housing 141 of the casing stinger 140 into the female thread 125 of the top drive adaptor 130. At that time, O-ring 146 of the casing stinger 140 seals with the counterbore 124 of the top drive adaptor to isolate the flow passage through the casing stinger and top drive adaptor. Straight thread/O-ring fitting 108 sealingly interconnects third hydraulic line 112 and radial flow port 131 of the top drive adaptor 120 so that hydraulic fluid can be selectably supplied or vented from the upper second chamber of the casing stinger 140.

Second Embodiment 200 of the Gripping Device.

For the second embodiment of the gripping device 200, shown in FIGS. 23 through 30, two coacting axially abutting gripper modules 230 and 97 are shown by way of example to illustrate that multiple gripper modules can be used in the event a single module is insufficient to apply the desired tension and torsional loads to a casing 190. By way of example, the gripping device of the second embodiment 200 is configured for simultaneous external gripping by both gripper modules of the upper ends of a nominal 7 inch 29 lb/foot casing 190 having a threadedly attached external casing coupling 192 of 7.656 inch nominal outer diameter at its upper, gripped end.

The second embodiment 200 utilizes most of the components of the first embodiment 10, with the primary differences between the two embodiments 10 and 200 related to the hydraulic circuit arrangements for the tensioning cylinders of the gripper modules 97 and 230 and the length of the dual gripper housing 201 for mounting dual gripper modules.

Figure 24:
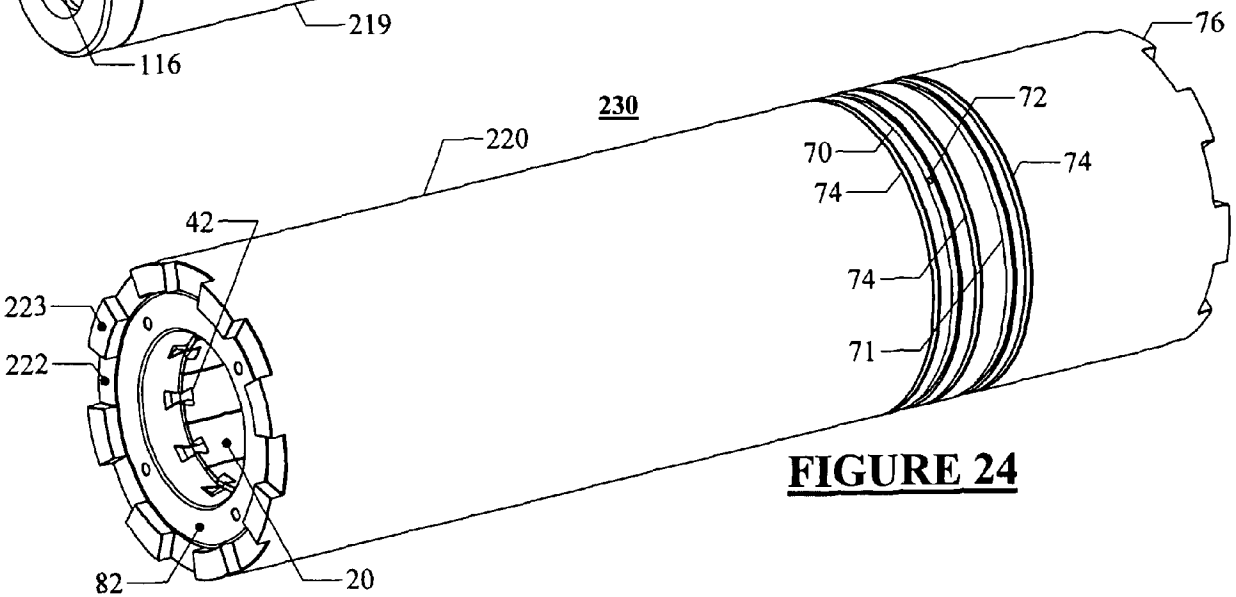
FIG. 24 is an oblique view of the upper gripper module of the second embodiment gripping device shown in FIG. 23.
Figure 25:
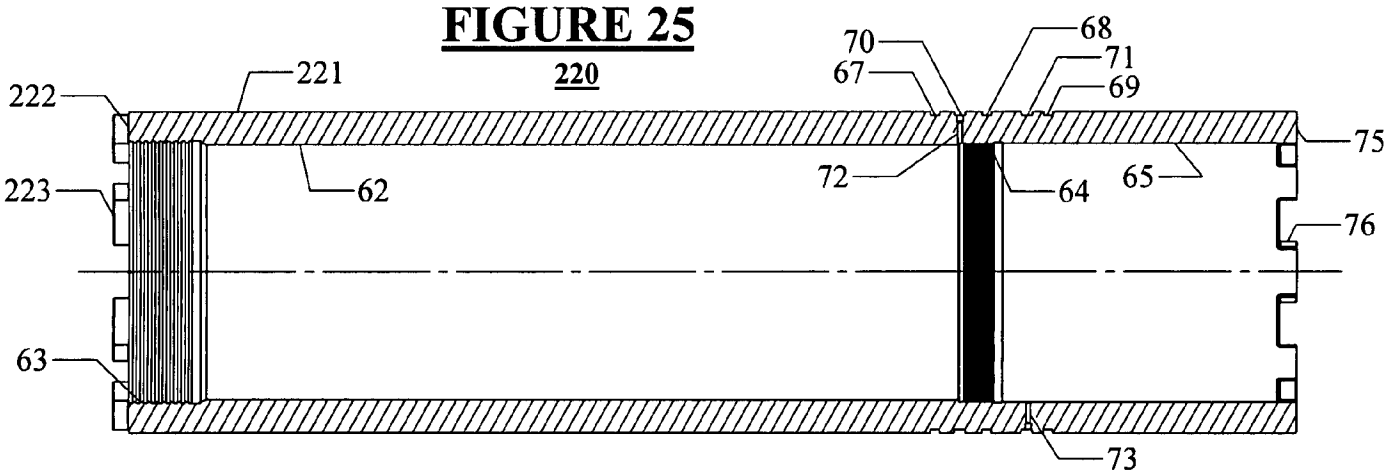
FIG. 25 is a longitudinal sectional view of the cylinder body of the upper gripper module of FIG. 24.
Figure 27:
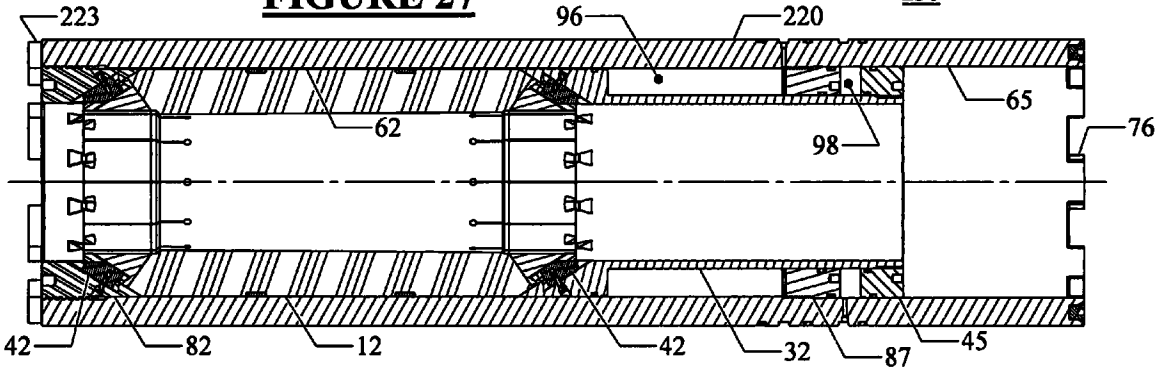
FIG. 27 is a longitudinal sectional view of the upper gripper module of FIG. 24.

The upper gripper module 230 is shown in FIGS. 24 and 27, whiles its upper cylinder body 220 is shown in FIG. 25. The upper and lower gripper modules 230 and 97 of the second embodiment gripping device 200 each are provided with a cylinder body 220 or 61, respectively. Additionally, each gripper module 230 and 97 has a gripper anchor ring 82 attached internal to its cylinder body at the lower end, an intermediately located static bulkhead 87, and an elastomeric gripping element 12 with its attached puller sleeve 32 and piston head 45.

The arrangement of these internal components within both the upper and lower gripper modules 230 and 97, respectively, relative to each other is the same as for the first embodiment gripping device 10. Other than the minor change of adding lower end dog clutch teeth 223 to the lower end of upper cylinder body 220 of the upper gripper module 230, as seen in FIGS. 24, 25, and 27, the gripping modules 230 and 97 are substantially the same as the gripping module 97 of the first embodiment gripping device 10 shown in FIG. 10. The other differences between the gripping modules for the first 10 and second 200 embodiments of the gripping device are described below.

The arrangement shown in FIG. 27 in the gripping module 230 of the gripping element 12 with its attached puller sleeve 32 and piston head 45 is substantially identical to that of the gripping module 97 of the first embodiment 10 shown in FIG. 8 for the second embodiment gripping device 200. As shown in FIGS. 2 through 5 describing the first embodiment gripping device 10, the elastomeric gripping element 12 has an integral elastomeric sleeve 13, restraining rings 19, and lower 20 and upper 26 antiextrusion segments. The elastomeric gripping element 12 is attached with a slip fit with its comating frustroconical sliding contact face surface 24 connected by means of guides 42 to the corresponding sliding contact face 41 of a puller sleeve 32 with its threadedly attached piston head 45. The guides 42 permit motion tangential to the sliding contact face 41 in their own radial planes for each of the upper antiextrusion segments 26. The puller sleeve 32 with its attached piston head 45 for the upper gripper module 230 is reciprocable within the primary bore 62 of an upper cylinder body 220 of an upper gripper module 230.

The gripping element 12 of the upper gripping module 230 with its attached puller sleeve 32 and piston head 45 is mounted on its lower end by means of guides 42 to a gripper anchor ring 82 threadedly attached to the lower female thread 63 of an upper gripper module 230 upper cylinder body 220. The guides 42 permit motion tangential to the sliding contact support face 83 of the gripper anchor ring 82 of the antiextrusion segments 20 in the radial midplane of each segment 20.

The dual gripper housing 201 for the second embodiment gripping device 200 has most of its features substantially identical to those of the housing 100 of the first embodiment gripping device 10. The only significant differences relate to the length of the through bore 202, the overall housing body length, and the addition of third 209 and fourth 210 pressure ports to the first and second pressure ports 207 and 208.

Figure 26:
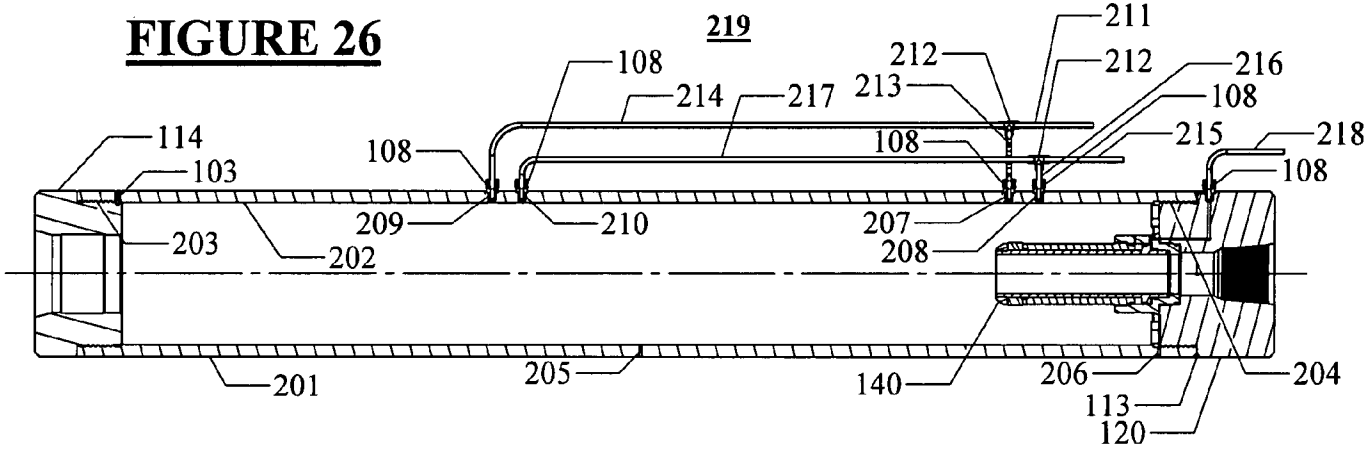
FIG. 26 is a longitudinal sectional view of the body assembly of the second embodiment gripping device shown in FIG. 23.

The housing 201 of the dual gripper body assembly 219 for the second embodiment gripping device 200, seen in FIGS. 26 to 26, is a tube with an uniform outer diameter, transverse lower and upper ends, and a central through bore 202 which is a close slip fit to the exterior of the lower 97 and upper 230 gripping modules.

The major components of the body assembly 219 of the second embodiment gripping device 200 of the present invention, shown in FIGS. 26 and 28 to 30, include a housing 201, a lower cap 114, a top drive adaptor 120, and a casing stinger 140. The tubular housing 201 for the body assembly 219 has an uniform outer diameter with a large external chamfer serving as a groove weld preparation at the upper outer end, transverse ends, and a straight through bore 202 having female stub acme threads 203 and 204 at its lower and upper distal ends, respectively. At the thread relief for the lower thread 203 of the housing 201, multiple regularly spaced drilled and tapped radial set screw holes 103 house radial set screws 104. The set screws 104 have half-dog points and their outer ends do not extend beyond the outer diameter of the housing 201.

A lower radial first vent port 205 is drilled through the wall of the housing 201 at approximately the location of the upper end of the installed lower gripper module 97. An upper second vent port 206 is slightly below the upper end female thread 204 so that when the top drive adaptor 120 is in place, as shown in FIG. 26, the second vent port 206 is below and adjacent the lower transverse face of the top drive adaptor 120. First 207 and second 208 radial pressure ports are drilled through the body wall of housing 201 at locations so that they will intersect the first 70 and the second 71 annular fluid channels, respectively, on the outer cylindrical surface 66 of the upper cylinder body 220 of the installed upper gripper module 230. Third 209 and fourth 210 radial pressure ports are drilled through the body wall of housing 201 at locations so that they will intersect the first 70 and second 71 annular fluid channels, respectively, on the outer cylindrical surface of the lower cylinder body 61 of the installed lower gripper module 97.

The outer ends of these pressure ports 207, 208, 209, and 210 in the wall of the housing 201 are profiled and tapped to sealingly accommodate commercially available straight-thread O-ring tube fittings 108. As seen in FIG. 26, the tube fitting 108 in the first radial pressure port 207 is connected to a first hydraulic supply tube 211 through a first brazed tubing tee connector 212 and offset jumper tube 213. The first hydraulic supply tube 211 is also connected to the third radial pressure port 209 through the same tee 212 and outer tube jumper 214.

The tube fitting 108 in the second radial pressure port 208 is connected to a second hydraulic supply tube 215 through a second brazed tubing tee connector 212 and radial tube jumper 216. Second hydraulic supply tube 215 is also connected to the fourth radial pressure port 210 through the same second tee connector 212 and inner tube jumper 217. Hydraulic pressure and flow can be selectably applied to either pair of ports 207 and 209 or pair 208 and 210 by a conventional hydraulic power unit with selectably operable four way valving (not shown), as can be well understood by those skilled in the art. Ports 207, 208, 209, and 210 are all vented when the gripping device 200 is idle.

The dual gripper housing 201 may be threadedly connected at its lower end to a lower cap 114 by engaging the upper male thread 115 of the lower cap 114 with the lower female end thread 203 of the housing 201. The connection is secured radial set screws 104 engaged in both the tapped radial holes 103 of the housing 201 and the set screw detents 117 of the lower cap 114. A top drive adaptor 120 is threadedly connected by its lower male thread 133 to the upper end female thread 204 of the housing 201 and secured there by circumferential weld 113 between the two parts. A casing stinger 140 is threadedly mounted by its thread 144 in the lower female thread 125 of the top drive adaptor 120. Third hydraulic supply tube 218 is connected to radial flow port 131 of the top drive adaptor 120 by straight thread/O-ring fitting 108 and thence to the casing stinger 140.

First the upper gripper module 230 and then the lower gripper module 97 are loaded into the through bore of the dual gripper housing 201 from the lower end and retained therein by the lower cap 114. The upper dog clutch teeth 76 of the upper gripper module 230 are engaged with the comating downward facing dog clutch teeth 126 of the top drive adaptor 120 at this time. Likewise, the lower dog clutch teeth 223 of the upper gripper module 230 are engaged with the upper dog clutch teeth 76 of the lower gripper module 97.

Both the upper gripper module 230 and the lower gripper module 97 have close slip fits to the through bore 202 of the dual gripper housing 202, and their external O-rings 74 with backup rings seal the gap between the gripper modules and the dual gripper housing 201 when the gripper modules are positioned in the through bore 202. When this insertion is done, the first 207 and third 209 radial pressure ports of the housing 201 are in communication both with the first hydraulic supply tube 211 and both the first annular flow channels 70 and the first radial flow channels 72 of the gripper modules 230 and 97.

At the same time, the second 208 and fourth 210 radial pressure ports of the housing 201 are in communication with the second hydraulic supply tube 215 as well as both the second annular flow channels 71 and the second radial flow channels 73 of the gripper modules 230 and 97. Accordingly, the first hydraulic chamber 96 of the upper gripper module 230 is in communication with the first hydraulic supply line 211. Likewise, the second hydraulic chamber 98 of the upper gripper module 230 is in communication with the second hydraulic supply line 215.

Figure 28:
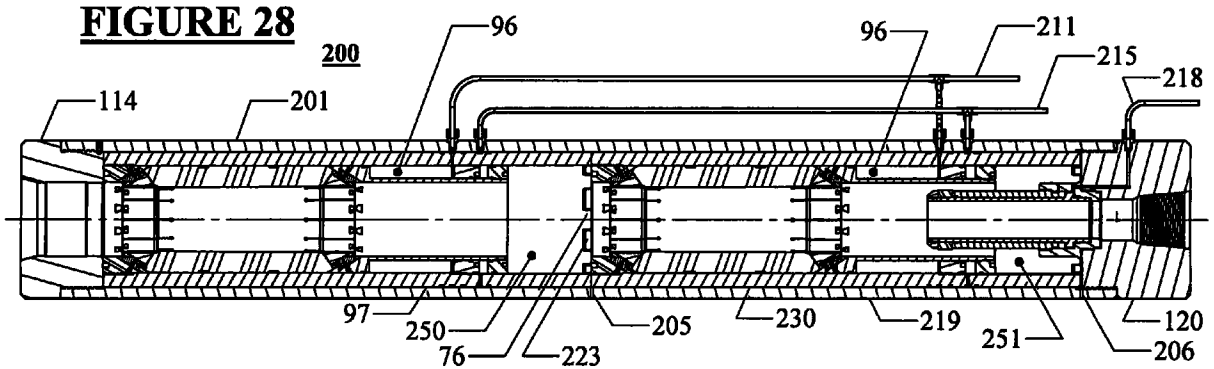
FIG. 28 is a longitudinal sectional view of the at-rest second embodiment gripping device of the present invention.

After assembly, the void space 250 between the piston head 45 and the upper end of the lower gripper module 97 is in communication with the exterior of the second embodiment 200 of the gripping device through the vent port 205, as may be seen in FIG. 28. Likewise, the void space 251 between the piston head 45 and the upper end of the upper gripper module 230 is in communication with the exterior of the second embodiment 200 of the gripping device through the vent port 206, as also may be seen in FIG. 28.

In the event that more than two gripper modules are desired for a gripping device embodiment which is to externally grip a casing, the lower gripping module would be the gripping module 97, while all of the multiple upper gripping modules would be upper gripping modules 230. The housing for three or more gripper modules would necessarily be longer and would have more radial pressure ports and more vent ports, but otherwise would be substantially similar to that shown for the second embodiment gripping device 200.

Third Embodiment 300 of the Gripping Device.

The third embodiment of the gripping device 300 of the present invention is configured for internally gripping a casing 470 which may possibly have either an internal upset for integrally threaded connections or a threadedly attached coupling. The third embodiment 300 is shown in FIGS. 31 to 44. In general, the third embodiment gripping device 300 is suitable for use with larger diameter casings than either the first 10 or second 200 embodiment gripping devices due to the spatial requirements for fitting the components of the gripping device within the bore of the casing. The basic principles of construction and operation for all the embodiments of the present invention are the same, but the third embodiment 300 elements are typically everted compared to the components for externally gripping tubular casings of the first 10 and second 200 embodiments.

As seen best in FIGS. 31 and 39 to 41, the third gripping device 300 is provided with a tubular backbone assembly 360, a nose piece 335 which serves as a gripper anchor attached to the backbone assembly 360, and a gripper module 301 utilizing an elastomeric gripping element 302 with axially reciprocable gripping element tensioning means. The gripper module 301 consists of the gripping element 302, the puller sleeve 324 with its attached piston head 345, and the nose piece 335 which serves to anchor the lower end of the gripper module 301 to the backbone tube 361 of the backbone assembly 360.

The gripping element 302 with its lower 315 and upper 321 sliding contact faces is attached by means of screws 483 to both the nose piece 335 and to a puller sleeve 324 on their respectively comating frustroconical sliding contact faces 331 and 340. The screws 483 are engaged in elongated slots 313, 314 and 319, 320 located in central radial planes of each of the antiextrusion segments 310 and 316 of the gripping element 302, thereby permitting relative motion in the central radial plane of each individual antiextrusion segment 310 and 316, wherein the relative motion is tangential to their respective contact faces 331 or 340 between the antiextrusion segment and its cojoined nose piece 335 or puller sleeve 324.

The puller sleeve 324 of each gripper module 301 is attached to a piston head 345, while a static bulkhead 420 is attached to the backbone tube 361 of the backbone assembly 360 so that an axially reciprocable double acting hydraulic cylinder is formed from the two coaxial subassemblies to permit selectably actuating the reciprocation of the tensioning means for the gripping element 302. This can be seen in FIGS. 39 to 41.

Figure 32:
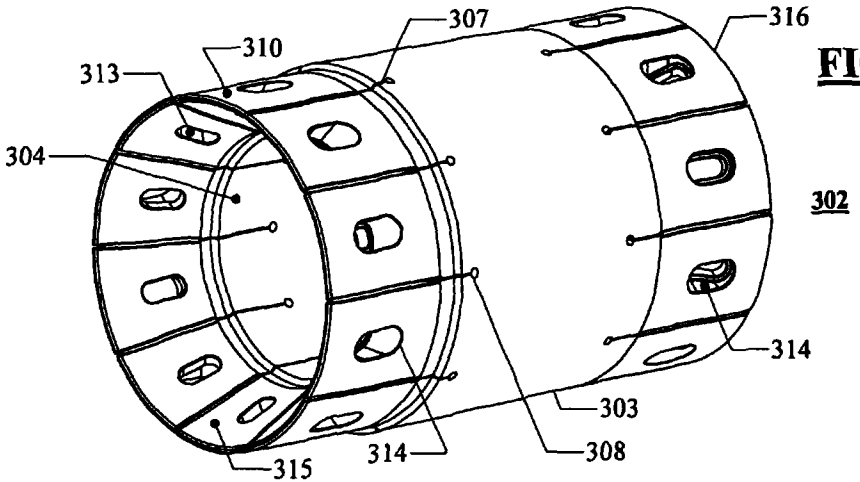
FIG. 32 is an oblique view of the gripping element for the gripping device of FIG. 31, wherein the gripper element is shown in its condition as molded with its integral segmented end rings.
Figure 33:
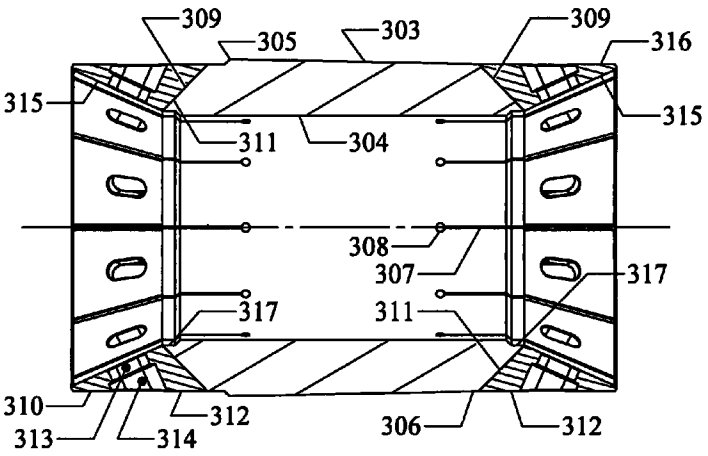
FIG. 33 is a longitudinal sectional view of the gripper element of FIG. 32 as molded.
Figure 34:
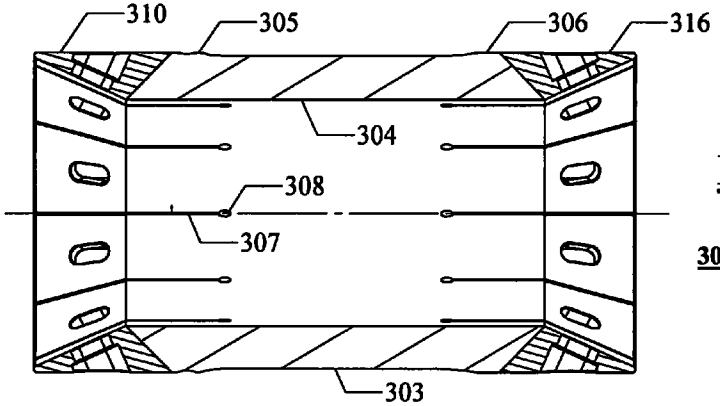
FIG. 34 is a longitudinal sectional view of the gripper element corresponding to FIG. 33, but showing the gripper element under axial tension.

The gripping element 302 for the internal gripping device 300 is shown in FIGS. 32, 33, and 34. The gripping element 302 uses an elastomeric sleeve 303 which is an axially symmetric annular cylinder attached by bonding on its lower end during molding onto a lower set of multiple antiextrusion segments 310 and similarly is attached on its upper end to a basically identical but oppositely facing coaxial upper set of multiple antiextrusion segments 316.

Starting from its lower interior end, the elastomeric sleeve 303 has a very short straight first bore 317, a radially inwardly and upwardly converging short frustroconical transition, a long constant through bore 304, a radially outwardly and upwardly diverging short frustroconical transition, and another short straight third bore 317. The first and third bores have the same diameter and length. This interior surface is symmetrical about its transverse midplane. The through bore 304 is a slip fit to the lower cylindrical surface 368 of the backbone tube 361. The frustroconical bonding faces 309 on the distal ends of the elastomeric sleeve 304 are mirror images symmetrical about the transverse midplane of the part, with both converging radially outwardly towards the midplane of the part.

The exterior face of the elastomeric sleeve 304 is its gripping surface and has, from its lower end, a short cylindrical segment, a short upwardly and radially outwardly diverging frustroconical face, and a very shallow angle frustroconical face radially inwardly and upwardly converging to its intersection with the upper frustroconical bonding face 309. The maximum diameter of the exterior face of the elastomeric sleeve 304 is at 305 adjacent the lower end of the gripping surface, while the upper end of the gripping surface 306 has a smaller diameter. When relaxed, the elastomeric sleeve 304 would have extensive radial interference with the bore 471 of the casing 470 which it is intended to grip.

The substantially identical antiextrusion segments 310 and 316 are fabricated from solid rings which are first turned on a lathe and then segmented into multiple basically identical arcuate segments, similar to the antiextrusion segments 20 and 26 of the first 10 and second 200 embodiments of the gripping device. The radial plane sectional view of a solid ring is the same as that for a finished antiextrusion segment 310 or 316. Prior to segmentation, the cross-section of a source solid ring for the antiextrusion segments 310 and 316 has, as best seen from FIGS. 33 and 34, four sides with an uniform outer diameter 312, an outer transverse distal end of short radial width, an adjoining radially inwardly converging frustroconical sliding contact face 315, and another adjoining radially outwardly diverging frustroconical end bonding face 311. The sliding contact face 315 has a constant inclination of approximately 15° to 30° from the axis of symmetry of the solid ring, while the bonding face 311 is inclined at an angle of approximately 45° from the axis of symmetry of the solid ring in the opposite direction to the slope of the sliding contact face 315. The segmentation of the source solid rings is done by a saw or laser or other suitable means having a small kerf width cut. The equispaced cuts are made on radial planes of the solid rings. The combination of the inner diameter of the solid rings and the kerf width of the cuts separating the solid rings is selected according to the following criterion. When each of the resultant sets of lower 310 and upper 316 antiextrusion segments produced by the segmentation are grouped in circumferential arrays so that the adjoining segments abut with a line contact on their lateral faces produced by the cuts, the maximum diameter of the circumferential array is slightly less than the smallest expected inner bore 471 diameter of the casing 470 for which the elastomeric gripping element 302 is designed. This may be seen in FIGS. 43 and 44.

After the solid rings are segmented, each antiextrusion segment 310 or 316 is provided with a pair of elongated slots located in the central radial plane of the segment. The slots have parallel central sides and rounded ends, with the smaller slot serving as a screw shank slot 313 and the larger slot 314 serving as a screw head slot. The screw head slots 314 open outwardly through the outer cylindrical face 312 of their antiextrusion segment 310, while the screw shank slots 313 open respectively into their frustroconical sliding contact faces 315. The slots are normal to the sliding contact face 315 or 321 of their segment and have flat lateral sides with semicircular ends. The rounded ends of the slots 313 and 314 are coaxial.

The outer width of the slots 313 is sufficient to provide clearance for the shank of a high strength machine screw 483, while the interior width of the slots 314 is sufficient to provide clearance for the head of a machine screw 483. Typically, a low head socket cap screw 483 having a cylindrical head is engaged through the stepped slot of each segment so that the transverse bearing shoulder of its head has a slip fit with the transverse interior shoulder of the slot. The screws 483 are not fully tightened so that motion tangential to the sliding contact face 331 in its own radial plane is possible for each of the antiextrusion segments 310 and 316.

The centrally positioned elastomeric sleeve 303 portion of the gripping element 302 is formed by compression molding the elastomer so that it is bonded on its bonding faces 309 to the respective bonding faces 311 of the lower 310 and upper 316 distally located antiextrusion segments. The antiextrusion segments 310 and 316 are placed in the mold so that their respective bonding faces 311 are opposed and facing inwardly. The respective outer cylindrical faces 312 of the segments 310 and 316 are located in the mold with a comating interior cylindrical surface having an inner diameter adjacent to the segment equal to the turned outer diameter of the source solid ring.

Thin temporary planar filler pieces (not shown) having widths equal to the kerf widths of the cuts between the ring segments may be used during the molding. The filler pieces, inserted in the radial planes between the antiextrusion segments, are made of polytetrafluoroethylene or some other similar material which will not bond to the elastomer. The function of the filler pieces is to prevent bonding from occurring between the circumferentially adjacent antiextrusion segments 310 and 316 on their radially cut faces. The filler pieces extend into the body of the elastomer sleeve 303 and have enlarged, rounded ends which extend in a radial direction.

The extension of the filler pieces into the elastomeric sleeve 303 produces multiple stress relief slots 307 in radial planes in the distal ends of the elastomer and thereby permits the molded gripping element 302 to be reduced in diameter by stretching without tearing occurring near the bonded interface between the elastomer and the antiextrusion segments. These slots are best seen in FIGS. 32 through 34. The slot ends are rounded in order to produce stress relief grooves 308 which reduce tearing tendencies at the ends of the slots in the elastomeric sleeve 303 when it undergoes axial tension.

As seen in FIG. 33, the radial plane sectional profile of the relaxed elastomeric sleeve portion 303 of the gripping element 302 has a symmetrical axially inwardly and radially outwardly diverging frustroconical bonding face 309 at each distal end which matches the corresponding frustroconical bonding face 311 of the comated antiextrusion segments 310 or 316. These faces are bonded onto the bonding faces of the antiextrusion segments during the compression molding process.

The gripping element 302 is mounted at its lower end to a solid ring nose piece 335. The nose piece 335 has two narrow opposed transverse ends. From its lower end, the inner side of the nose piece 335 has a short bore with an accessory female O-ring groove 336 intermediate to its length, a female accessory thread 337 which is threadedly comateable to cementing equipment (not shown), a thread relief, an inwardly extending downwardly facing transverse shoulder, a short reduced diameter through bore, an upwardly facing transverse shoulder, a short straight bore for sealing engagement with an O-ring 452 carried by the backbone tube 361, a thread relief, and a stub acme female connector thread 338 for attachment to the backbone tube 361.

The exterior side of the nose ring 335 has, from its lower end, a long frustroconical axially upwardly and radially outwardly diverging section having an angle with the part axis of about 30° (which serves as a lower exterior guidance face 339, a short constant diameter middle section, and an upwardly facing and inwardly converging exterior sliding contact face 340. The angle of the nose piece sliding contact face 340 corresponds to that of the sliding contact faces 315 of the antiextrusion segments 310, so that the two pieces 335 and 310 are comatable.

Drilled and tapped holes 341 penetrate the contact face of the nose piece 335 in a regular pattern corresponding to the slot pattern of the antiextrusion segments 310 of the gripping element 302. The drilled and tapped holes 341 are located in the radial plane and are normal to the sliding contact face 340. These holes are threadedly engaged by low head socket cap screws 483 which are extended through the slots of the lower antiextusion segments 310 of the gripping element 302. The screws 56 are not fully tightened so that motion tangential to the sliding contact face 340 is possible in its own radial plane for each of the lower antiextrusion segments 310.

Figure 35:
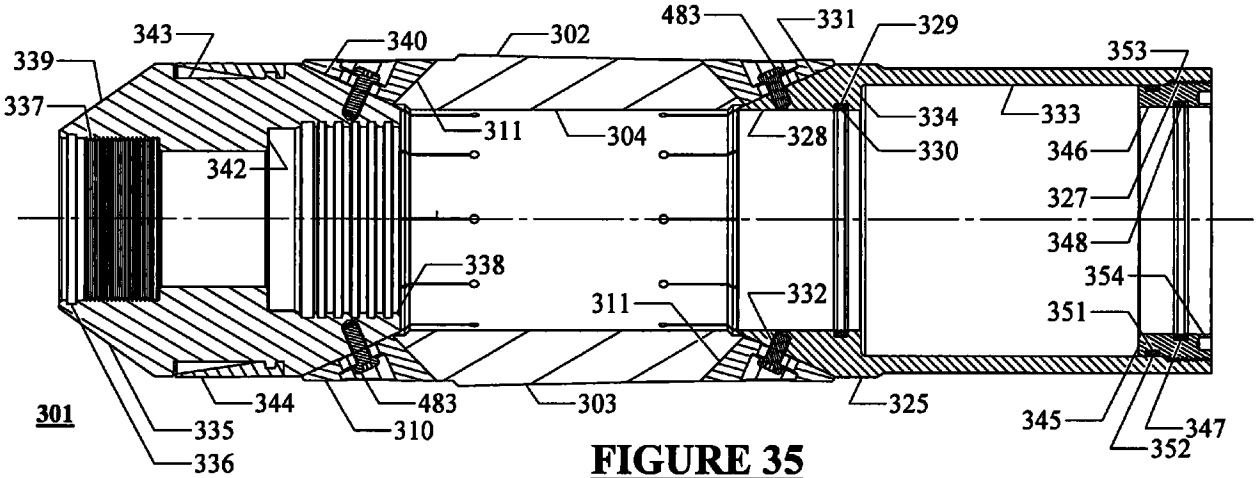
FIG. 35 is a longitudinal sectional view of the gripper module of the third embodiment of the gripping device of FIG. 31. The gripper module for this embodiment consists of the gripping element with its attached puller sleeve and piston head.

At its upper end, the gripping element 302 is attached to an annular puller sleeve 324, as seen in FIG. 35. The puller sleeve 324 has, from its upper end, a long external constant diameter cylindrical shank 326, a short radially outwardly and downwardly extending frustroconical shoulder, and a short cylindrical upset head 325 having a slip fit into the smallest casing bore suitable for the gripping device 300. Adjoining the upset head 325 is a downwardly and radially inwardly converging frustroconical sliding contact surface 331 having the same angle as the sliding contact surfaces 315 of the antiextrusion segments 316 and comateable therewith.

A straight through bore 328 of the puller sleeve 324 intersects the sliding contact surface 331 and has an intermediate female O-ring groove 329 containing O-ring 330. The through bore 328 of the puller sleeve 324 has a slip fit to lower portion of the backbone tube 361, and O-ring 330 seals between the puller sleeve 324 and the backbone tube 361. The through bore 328 has a length of about one fourth of the total length of the puller sleeve 324. An upwardly facing interior transverse shoulder 334 adjoins the through bore 328 of the puller sleeve 324 and is in turned joined by, in sequential position, a long enlarged upper counterbore 333, a thread relief, a distal upper end female thread 327, and a narrow annular transverse upper shoulder. The upper counterbore 333 is a slip to the outer diameter of static bulkhead 420, while the upper end female thread 327 is threadedly comateable with male thread 353 of the piston head 345.

Drilled and tapped holes 332 penetrate the sliding contact face 331 of the puller sleeve 324 in a regular pattern corresponding to the slot pattern of the antiextrusion segments 316 of the gripping element 302. The drilled and tapped holes 332 are located in the radial plane and are normal to the sliding contact face 331. These holes 332 are threadedly engaged by low head socket cap screws 483 which are extended through the slots 313, 314 of the upper antiextrusion segments of the gripping element 302. The screws 483 are not fully tightened so that relative motion tangential to the sliding contact face 331 is possible in its own radial plane for each of the upper antiextrusion segments 316.

As seen in FIG. 35, a piston head 345 is threadedly attached to the female thread 327 at the upper end of the puller sleeve 324. The piston head 345 is an axially short annular ring having transverse ends. At its upper exterior end, the piston head 345 has its male thread 353 comatable with the female thread 327 at the upper end of the puller sleeve 324. Adjoining the threaded exterior portion 353 on its lower side is a slightly reduced diameter cylindrical segment 349 having a male O-ring groove 351 containing O-ring 352 located between the thread 353 and the lower end of the piston head 345. The diameter of the cylindrical segment with O-ring groove 351 is a close fit to the upper counterbore 333 of the puller sleeve 324 so that the O-ring 352 can seal the gap between the two parts.

On its interior cylindrical face 346, the piston head 345 has a constant diameter inner cylindrical surface with an intermediate female O-ring groove 347 containing O-ring 348. The upper transverse face of the piston head 345 has a regular array of spanner holes 354 parallel to and equispaced from the piston head axis.

The backbone tube 361, together with the bore liner tube 380 and the static bulkhead 420, constitute the backbone assembly 360. The backbone tube 361, shown in FIG. 37 along with its comating bore liner tube 380, provides both structural support for the other components of the third embodiment gripping device 300 and a fluid conduit through its interior so that through circulation can be maintained when the gripper module 301 is sealingly engaged with a casing 470. The backbone tube 361 has transverse ends with a straight main bore 362 starting at its lower end and extending upwardly approximately half of the length of the backbone tube. The main bore 362 is adjoined by an upwardly facing transverse shoulder 363 followed by an enlarged straight upper counterbore 364 at its upper end.

Sequentially from its lower end, the exterior side of the backbone tube 361 has short cylindrical section with a central male lower O-ring groove 365 mounting an O-ring 452, a slightly larger major diameter male stub acme thread 366 threadedly comateable with the female thread 338 in the nose piece 335, and an outwardly extending downwardly facing transverse shoulder 367. The transverse shoulder 367 is followed by a long lower cylindrical section 368. Sequentially above the lower cylindrical section 368, there is a short intermediate male thread 376 having its minor diameter larger than the lower cylindrical section, a thread relief, a beveled shoulder, and a constant diameter intermediate cylindrical section 377 having a diameter larger than that of the lower cylindrical section 368.

A thick outwardly extending transverse external flange 369 adjoins the upper end of the intermediate cylindrical section 377, followed by an enlarged upper end cylindrical section of the backbone tube 361. At its upper exterior end, the backbone tube 361 has a radially short upwardly facing transverse shoulder followed by a male stub acme thread 370 and a reduced diameter short cylindrical section with an intermediate male upper O-ring groove 371 mounting an O-ring 451.

The short exterior cylindrical section with O-ring groove 365 at the lower end of the backbone tube 361 is a close slip fit to the bore of the nose piece 335 located between its female connector thread 338 and its upwardly facing intermediate internal transverse shoulder, so that the O-ring 452 at the lower end of the backbone can seal between the mated parts. The short exterior cylindrical section at the upper end of the backbone tube 361 is a close slip fit to the lower end bore of the top drive adaptor 440 located between its female thread and its downwardly facing transverse shoulder, so that the O-ring at the lower end of the backbone tube 361 can seal between the mated parts. The nose piece is sealingly attached to the lower end of the backbone tube 361, and the top drive adaptor 440 is also sealingly attached to the upper end of the backbone tube.

The exterior intermediately positioned male thread 376 is used to threadedly attach the static bulkhead 420 to the backbone tube 361. The lower cylindrical surface 368 of the backbone tube 361 is able to seal to the through bore 304 of the engaged elastomeric gripping element 302 when the elastomeric element is compressed, the female O-ring 330 of the puller sleeve 324, and the female O-ring 427 of the static bulkhead 420. The intermediate cylindrical section 377 of the backbone tube 361 is able to seal to the female O-ring 348 of the piston head 345. The O-rings 330, 427, and 348 also respectively seal to their respective O-ring grooves 329, 426, and 347.

A first 372 and second 373 radial threaded port are drilled through the body wall of the backbone tube 361 intermediate to the length of its enlarged upper exterior cylindrical section 378 so that each intersects a separate annular flow communication groove 389 or 392 on the exterior of the bore liner tube 380 when the bore liner tube is in place. The outer ends of these ports are profiled and tapped to sealingly accommodate straight-thread O-ring tube fittings 108. First 374 and second 375 radial through ports are located near the lower end of the enlarged upper counterbore 364 of the backbone tube 361. These ports 374 and 375 are positioned so that first will be slightly below and second slightly above the static bulkhead 420 when it is installed onto the intermediate male thread 376 of the backbone tube 361 between the lower 368 and intermediate 377 cylindrical sections.

Figure 36:
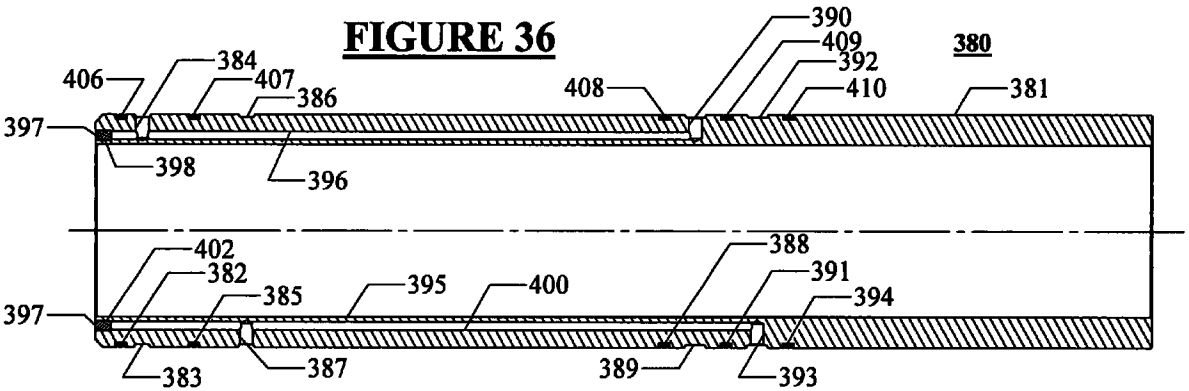
FIG. 36 is an oblique view of liner tube for the backbone assembly, shown in FIG. 37, with the O-rings of the assembly shown for clarity.
Figure 37:
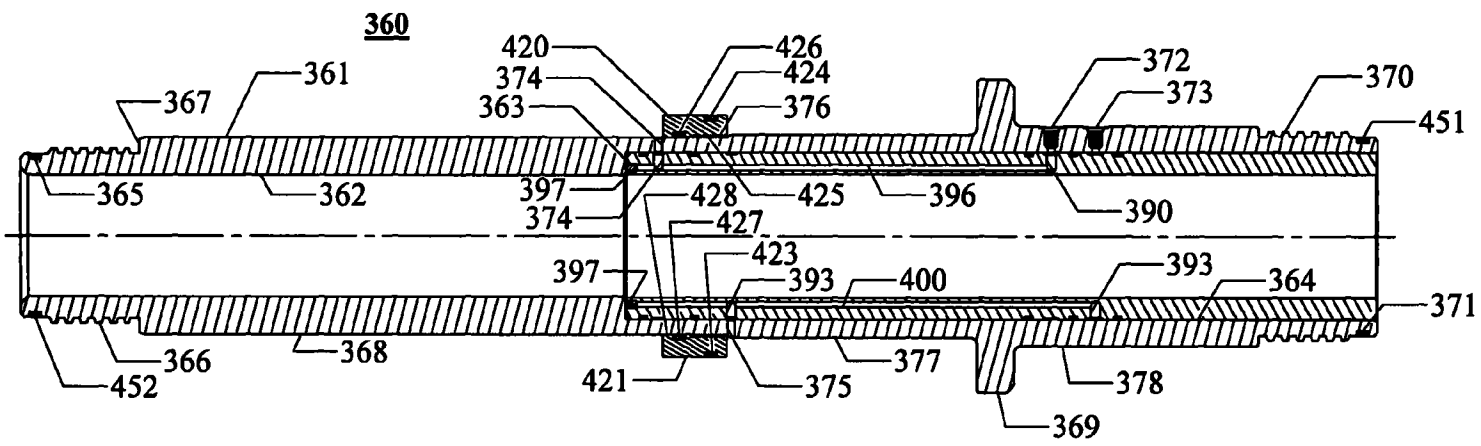
FIG. 37 is a longitudinal sectional view of the backbone assembly of the gripping device of FIG. 31.
Figure 38:
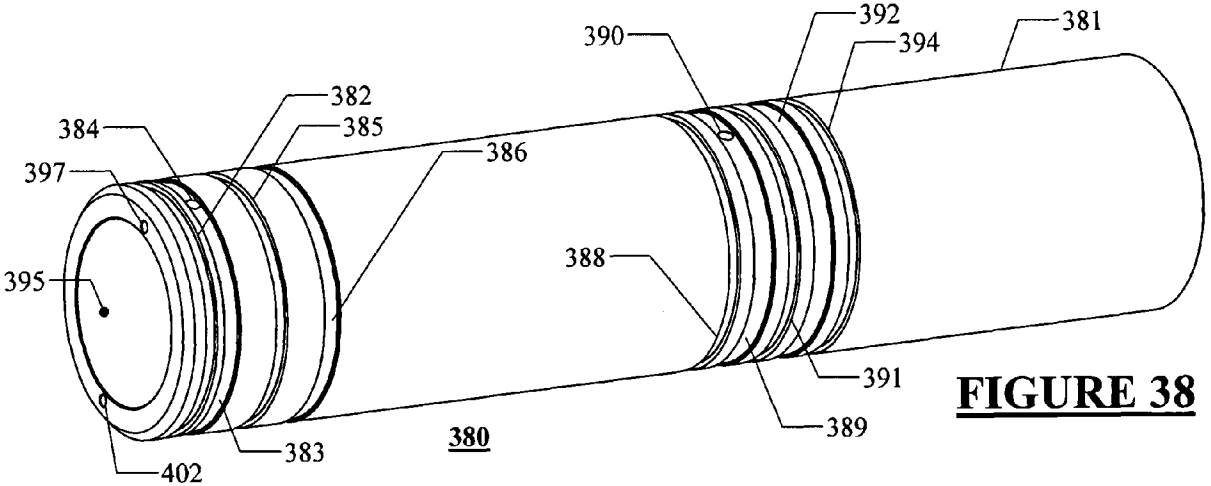
FIG. 38 is an oblique view of the liner tube of FIG. 36.
Figure 39:
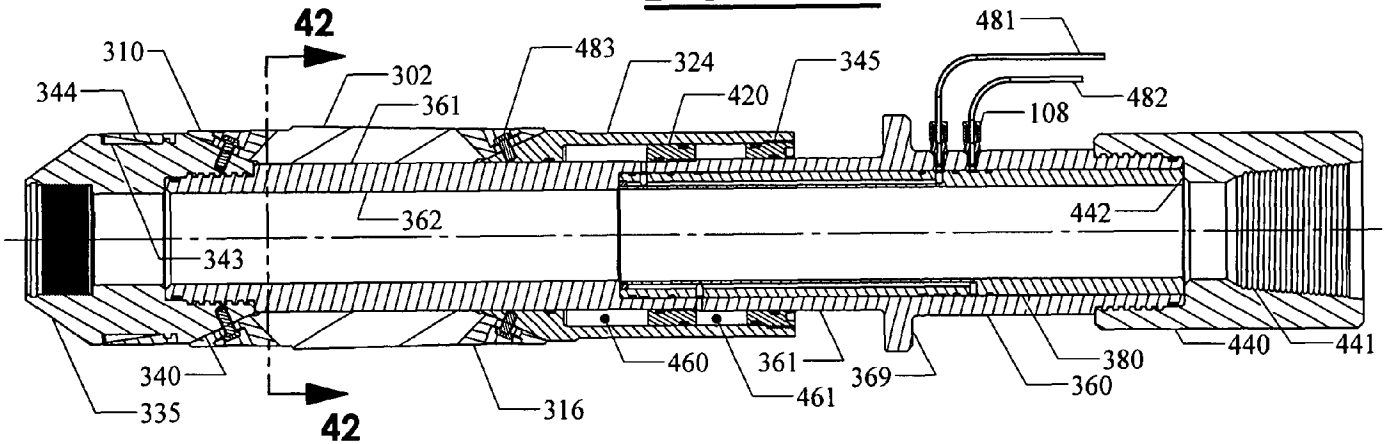
FIG. 39 is a longitudinal sectional view of the whole gripping device of FIG. 31, wherein the gripper module is shown in its relaxed position.
Figure 40:
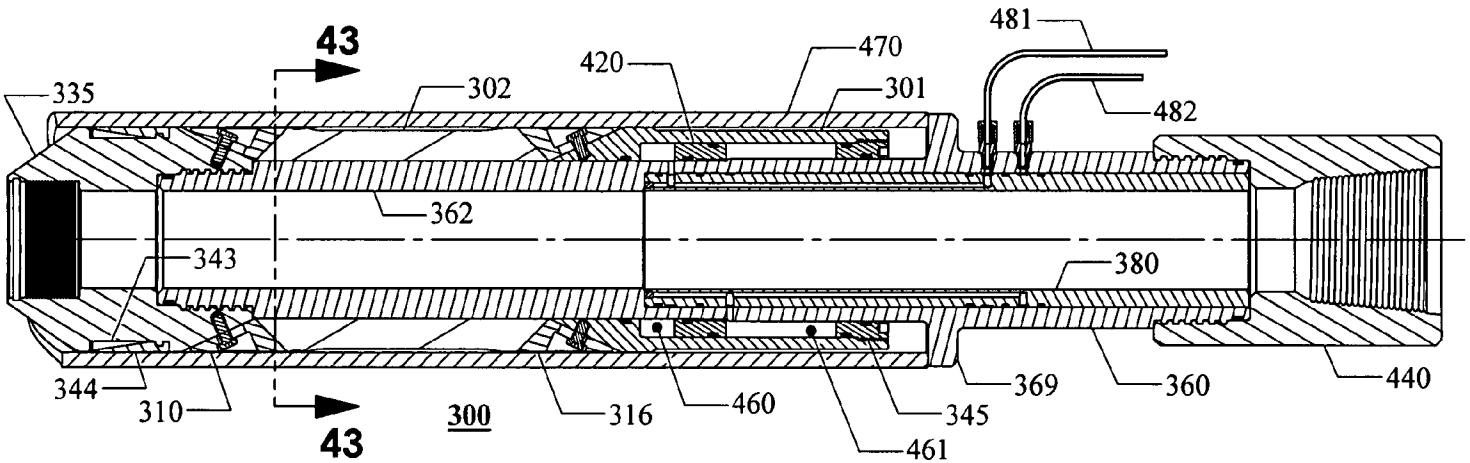
FIG. 40 is a view corresponding to FIG. 39, but with the gripper module shown in axial tension and the device is entered into a casing prior to actuating it to grip the casing.
Figure 41:
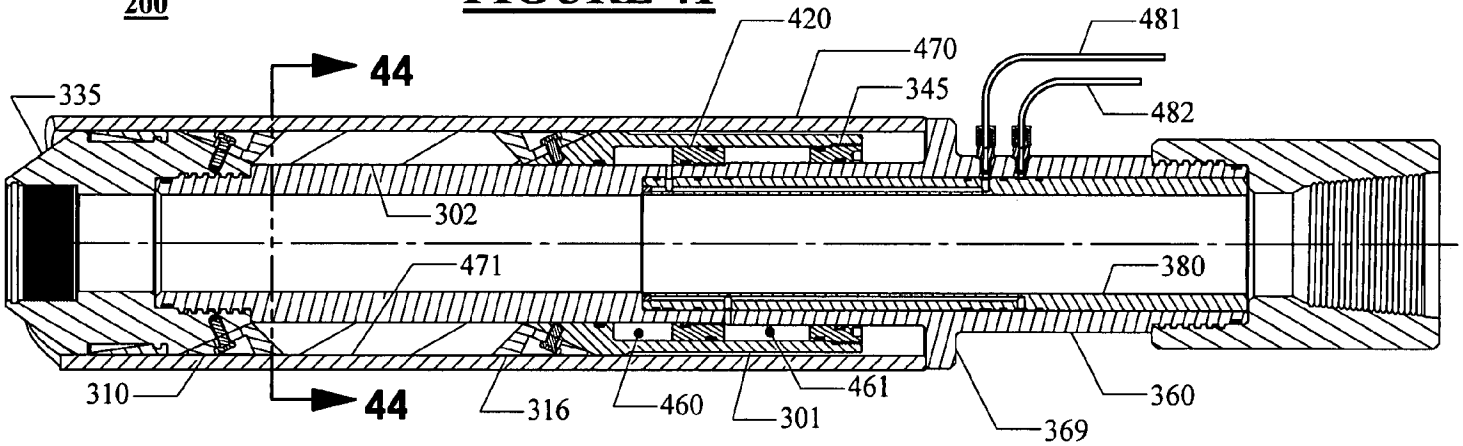
FIG. 41 is a view corresponding to FIGS. 39 and 40, but with the gripper module shown after tension has been released from the gripper module so that the gripping device is gripping the casing.
Figure 42:
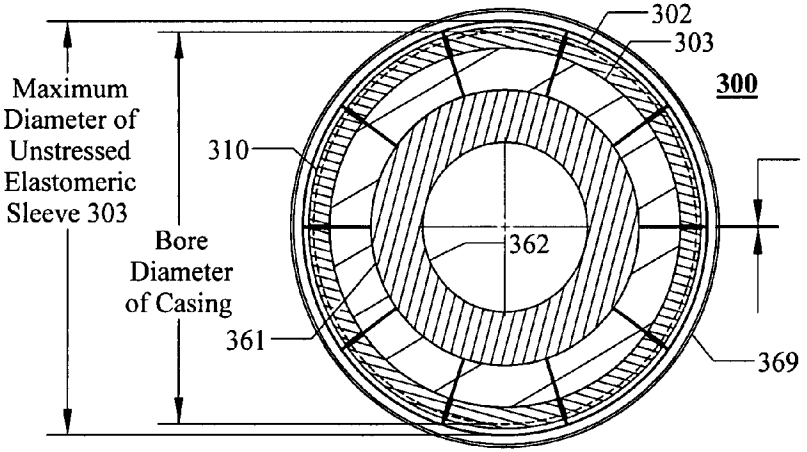
FIG. 42 is a transverse cross-sectional view taken along line 42-42 of FIG. 39 showing the gripping element of the third embodiment gripping device in its relaxed position.
Figure 44:
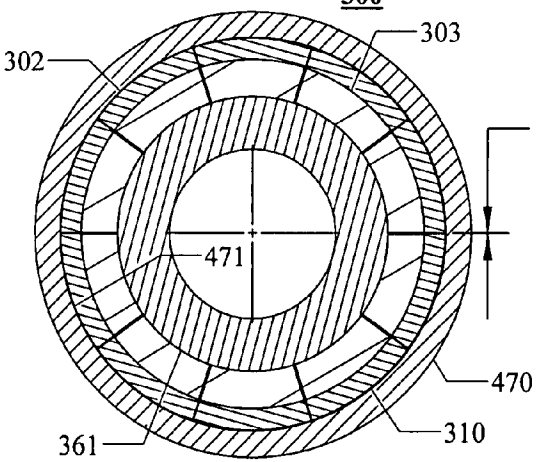
FIG. 44 is a transverse cross-sectional view taken along line 44-44 of FIG. 41 showing the gripping element of the third embodiment gripping in its gripping position.
Figure 43:
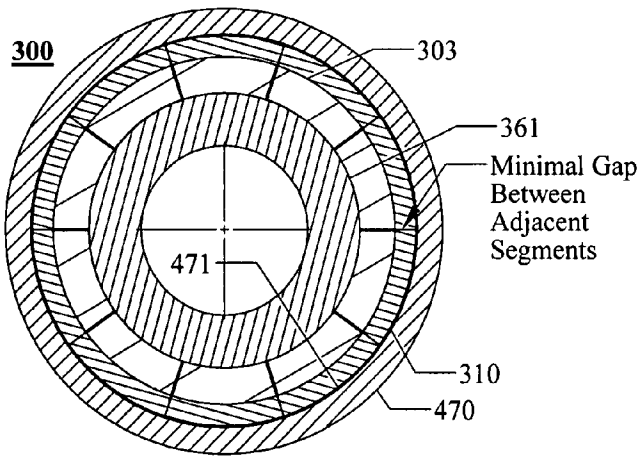
FIG. 43 is a transverse cross-sectional view taken along line 43-43 of FIG. 40 showing the gripping element of the third embodiment gripping in its stretched position.

The bore liner tube 380, seen in FIGS. 36 and 37, is an elongated right circular cylindrical tube which has constant inner and outer diameters. On its exterior cylindrical surface 381 adjacent the lower transverse tube end, the bore liner tube 380 has sequentially from its lower end first 382 and second 385 lower male O-ring grooves holding O-rings 406 and 407, respectively. At approximately the middle of bore liner tube 380 and sequentially from its lower end, three upper male O-ring grooves 388, 391, and 394 respectively containing O-rings 408, 409, and 410 are located. The through bore 395 of the bore liner tube 380 is continuous without grooves, while the outer diameter is a close slip fit to the enlarged upper counterbore 364 of the backbone tube 361 so that the O-rings can seal between the main bore 362 of the backbone tube 361 and the bore liner tube 380. The length of the liner tube 380 is equal to or slightly less than the length of the upper counterbore 364 of the backbone tube 361.

For the bore liner tube 380, a first external circumferential flow communication distribution groove 383 is located intermediately between O-ring grooves 382 and 385. A second distribution groove 386 similar to the groove 383 is located adjacent the upper side of O-ring groove 385. A similar third distribution groove 389 is located between O-ring grooves 388 and 391, while a fourth similar distribution groove 392 is located between O-ring grooves 391 and 394.

Two diametrically opposed flow channel holes 396 and 400 parallel to the cylinder axis are gundrilled from the lower transverse end of bore liner tube 380 to the vicinity of the central O-ring grooves 388, 391, 394. Upper flow channel 396 and lower flow channel 400 both have short counterbored and reamed sections on their lower ends to form the upper 398 and lower plug housing counterbores 402, respectively, at their external ends. Sherex plugs 397 are sealingly installed in the upper 398 and lower 402 plug housing counterbores.

The upper 396 and lower 400 flow channels are located at approximate midthickness of the cross-section of the bore liner tube 380. First 384 and third 390 radial ports are drilled in the center of first 383 and third 389 distribution grooves, respectively, to intersect the upper flow channel 396. Second 387 and fourth 393 radial ports are drilled in the center of second 386 and fourth 392 distribution grooves, respectively, to intersect the lower flow channel 400.

The bore liner tube 380 with its O-rings and Sherex® plugs 397 is installed in the backbone tube 361. The positioning of the O-ring grooves 382, 385, 388, 391, and 394 and the circumferential flow communication grooves 383, 386, 389, and 392 of the installed bore liner tube 380 is such that the first flow communication distribution groove 383 is aligned and in communication with the first radial port 374 of the backbone tube 361. The second distribution groove 386 is aligned and in communication with the second radial port 375 in the backbone tube 361. The third distribution groove 389 is aligned and in communication with the first threaded port 372 of the backbone tube 361, and the fourth distribution groove 392 is aligned and in communication with the second threaded port 373 of backbone tube 361.

A static bulkhead 420 is threadedly attached to the intermediate male thread 376 in the intermediate portion of the exterior of the backbone tube 361. The static bulkhead 420 is an axially short annular ring having transverse ends. At its upper interior end, the static bulkhead 420 has a female thread 425 comatable with the intermediate male thread 376 of the backbone tube 361. Adjoining the lower end of thread 425 is a slightly smaller diameter inner cylindrical surface 428 having a central female O-ring groove 426 containing O-ring 427. The diameter of the O-ring grooved inner cylindrical surface 428 is a close sliding fit to the lower cylindrical surface 368 of the backbone tube 361 so that O-ring 427 can seal the gap between the two parts.

On its outer cylindrical surface 421, the static bulkhead 420 has a constant diameter cylindrical section with an intermediate male O-ring groove 423 containing O-ring 424. The outer cylindrical surface 421 of the static bulkhead 420 is a close sliding fit to the counterbore 333 of the puller sleeve 324 so that O-ring 424 can seal between the two parts.

The combination of the backbone tube 361, the bore liner tube 380, and the static bulkhead 420, along with their associated O-rings and Sherex® plugs, constitutes the backbone assembly 360. The backbone assembly 360 provides flow communication and structural continuity for the third embodiment gripping device 300, so that it can function under selectable hydraulic control and at the same time support the high tensions and torsions for the device while simultaneously sealing to the bore of a casing 470.

The final component of the third embodiment gripping device is a threaded cross-over piece, the top drive adaptor 440. The top drive adaptor 440 has a cylindrical outer diameter which is approximately the same diameter or larger than a top drive output spindle (not shown). A female straight stub acme thread 443 comateable with the upper male thread 370 at the upper end of the backbone tube 361 is located in the lower end of the through hole of the top drive adaptor 440. A short cylindrical counterbored section at the upper interior end of the female thread 443 of the top drive adaptor 440 is a close slip fit to the short external cylindrical section at the upper end of the backbone tube 361 above the thread 370, thereby permitting the O-ring 451 at the upper O-ring groove 371 on the backbone tube 361 to seal between the two parts. The top drive adaptor 440 has transverse ends and a female API tool joint thread 441 located at the upper end of its through hole so that the adaptor 440 can be threadedly and sealingly engaged with the threads at the lower end of a top drive spindle (not shown).

Operation of the Invention

Operation of the First Embodiment 10 of the Gripping Device.

Figure 15:
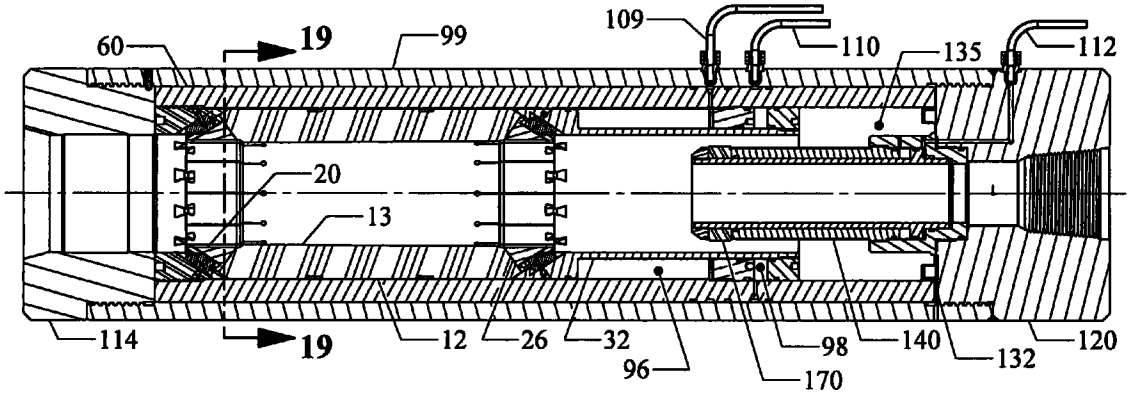
FIG. 15 is a longitudinal sectional view of the fully assembled gripping device of FIG. 1, wherein the gripper module is shown in its relaxed position.
Figure 16:
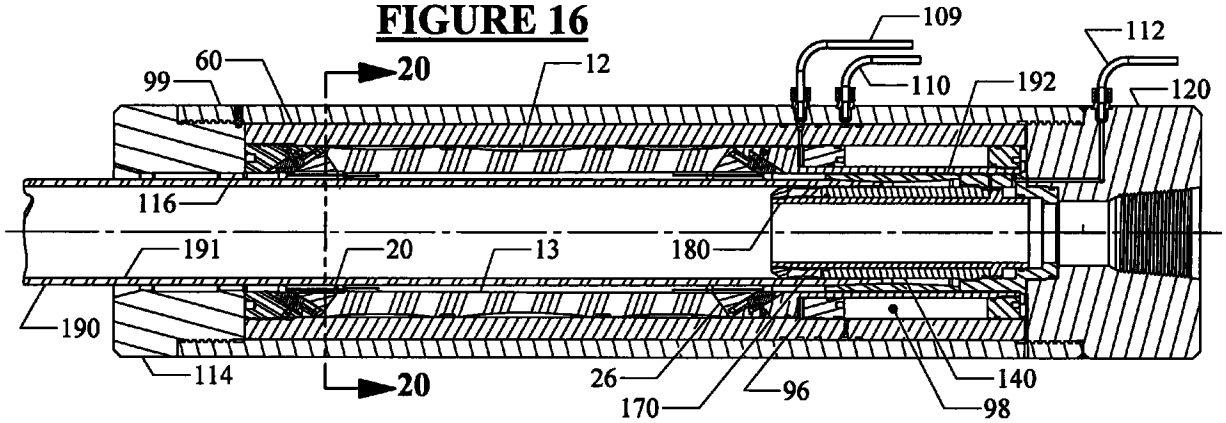
FIG. 16 is a longitudinal sectional view of the gripping device of FIG. 1, wherein the gripper module and the seal of the casing stinger are shown in their axially stretched positions and a casing has been stabbed into the bore of the gripping device.
Figure 17:
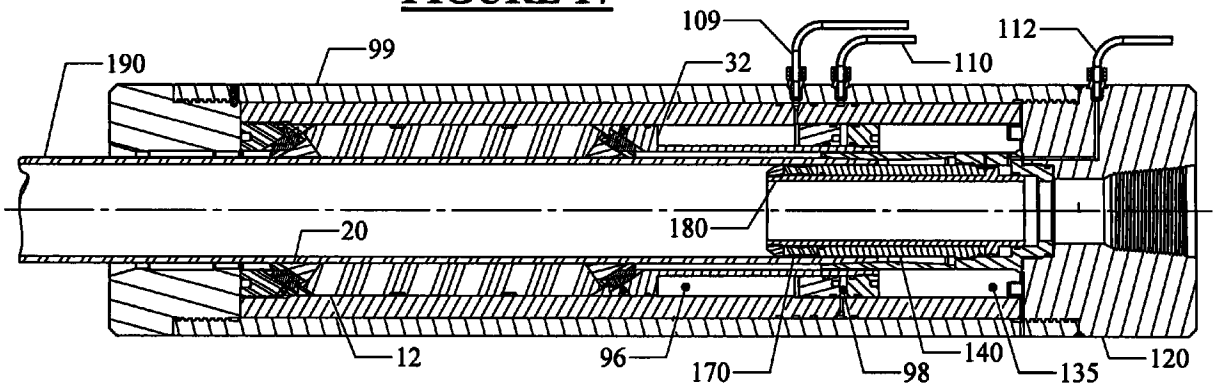
FIG. 17 is a longitudinal sectional view of the gripping device of FIG. 1, wherein the gripper module is gripping a casing, but the seal of the casing stinger is still stretched and not sealing.

In the drawings describing the first embodiment 10 of the gripping device, FIGS. 15 and 19 show the device in its at-rest configuration. FIGS. 16 and 20 show the gripping device 10 when its gripping element 12 and the annular seal 170 of its casing stinger 140 are axially stretched in order to permit axial entry of a casing 190 and its coupling 192 into the bore of the gripping device. FIG. 17 shows a casing 190 with its upper end coupling 192 entered into the bore of the gripping device 10 and gripped by the gripping element 12, while the casing stinger 140 still has its bonded annular seal 170 stretched so that it is not sealing to the bore 191 of the casing.

Figure 18:
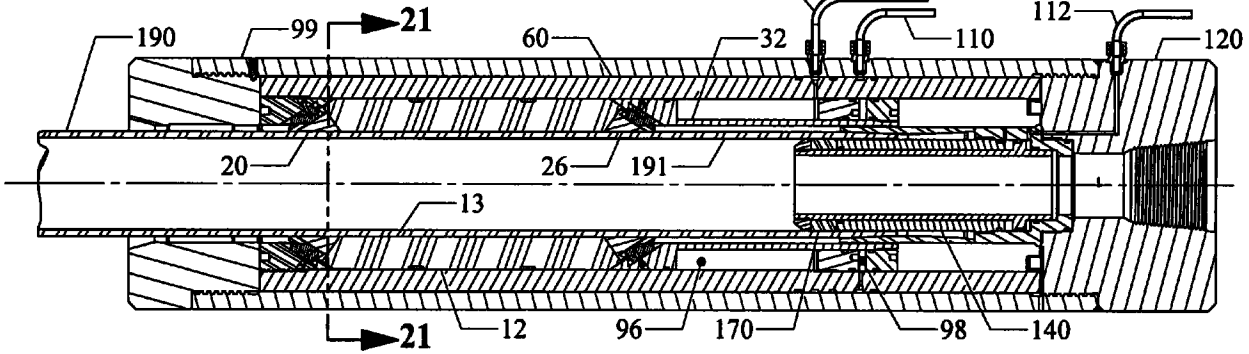
FIG. 18 is a longitudinal sectional view of gripping device of FIG. 1, wherein the gripper module is shown gripping and sealing to a casing below a coupling and the seal of the casing stinger is shown sealing to the bore of a gripped casing.

FIGS. 18 and 21 show the casing 190 being fully gripped externally and sealed both internally and externally for permitting fluid flow through the casing. FIGS. 19 through 21 specifically show the changes in the circumferential spacing of the lower antiextrusion segments 20 as the axial loadings on the gripping element 12 are changed.

The completely assembled first embodiment gripping device 10 in service is attached to the lower end of a top drive unit or a drilling Kelly (not shown) of a drilling rig. In most cases, a lower Kelly valve or a saver sub may be positioned between the gripping device and the top drive or Kelly. The top drive or Kelly provides the lifting force and torque which are transmitted to the tubular casing 190 being gripped by the gripping device 10, as well as any fluids which are to be pumped through the bore of the gripped casing.

The gripper module 60 of the gripping device 10 is actuated by means of selectably operated four-way hydraulic valving (not shown) connected to the first 109 and second 110 hydraulic supply tubes, which respectively are in communication with the first chamber 96 and the second chamber 98.*of* the gripper module. These interconnections are as follows. For the first chamber 96, the first hydraulic supply tube 109 is connected to its tube fitting 108, the first pressure port 106 of the housing 100, the first annular fluid channel 70, and the first radial fluid channel 72 of gripping module 60. The first radial fluid channel 72 leads directly the first chamber 96.

For the second chamber 98, the second hydraulic supply tube 110 is connected to its tube fitting 108, the second pressure port 107 of the housing 100, the second annular fluid channel 71, and the second radial fluid channel 73 of gripping module 60. The second radial fluid channel 73 of gripping module 60 leads directly the second chamber 98.

The preparation for engagement of a casing 190 by the gripping device 10 may be understood by referring both to the at-rest gripping device 10 shown in FIG. 15 and the gripping device configured by stretching the gripping element 12 for the positioning of a casing in its bore shown in FIG. 16. In order to grip and seal to the exterior of a casing 190, the first step is to apply hydraulic pressure through the second hydraulic supply tube 110 to the second chamber 98 while simultaneously venting the first chamber 96 through the first hydraulic supply tube 109. When this is done, the piston head 45 with its attached puller sleeve 32 is moved upwardly, thereby stretching the gripping element 12. This movement continues until either the combination of the axial resistance of the elastomer and friction balance the hydraulic forces on the piston head 45 or until puller sleeve 32 abuts the static bulkhead 87.

As the gripping element 12 is being axially tensioned, its geometry changes both by lengthening and in response to the radially outward component of relative motion between the gripping element and its end attachments imparted by means of the guides 42 to the gripper anchor ring 82 and the puller sleeve 32. When the gripping element 12 is tensioned, each of the lower antiextrusion segments 20 are constrained by engagement of a guide 42 in their external dovetail groove 23 to only move parallel to the axis of the adjacent interior dovetail groove 86 of the gripper anchor ring 82.

Figure 3:
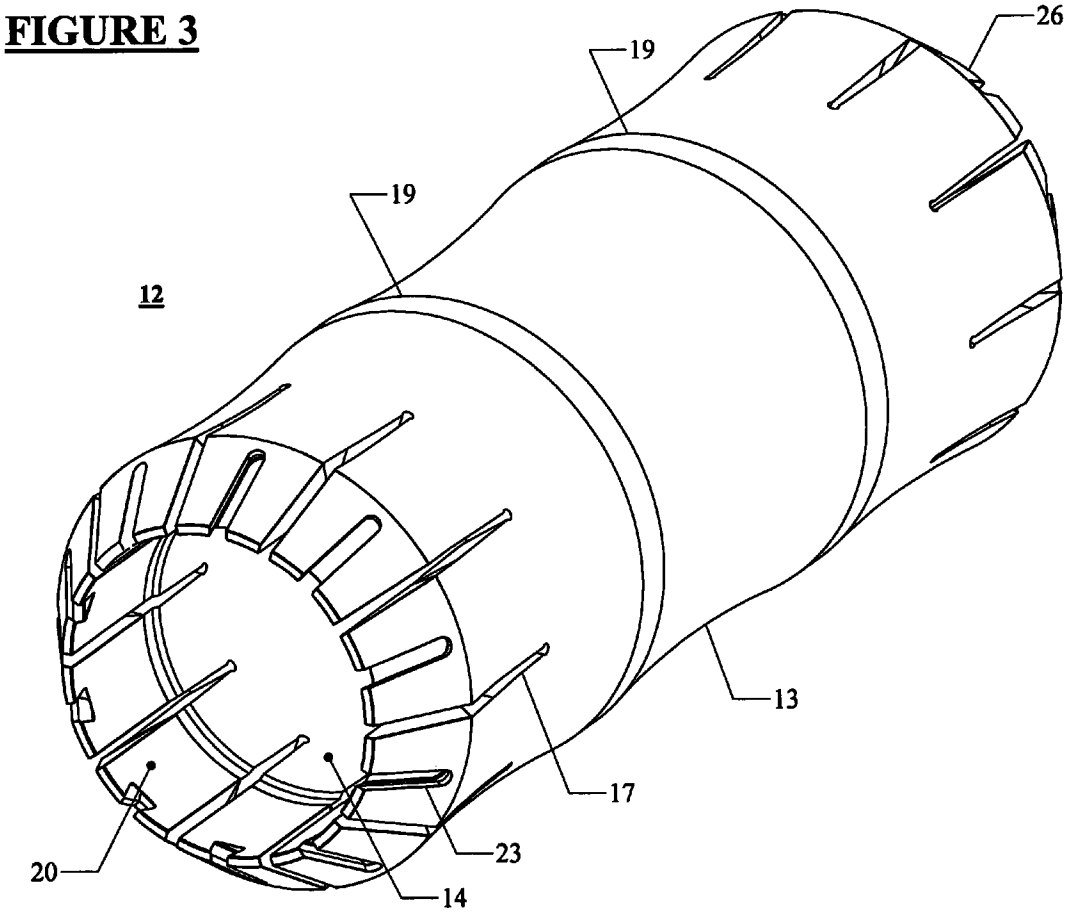
FIG. 3 is an oblique view of the gripping element of FIG. 2, but with the gripping element in its configuration which it assumes under axial tension in the gripping device.

The vector component of the axial tension acting on the individual lower antiextrusion segments 20 causes the segment to move both radially outwardly and upwardly. This movement leads to a local increase of the inner diameter of the lower end of the gripping element 12. The resultant changes in the circumferential spacings of the lower antiextrusion segments 20 can be seen by comparing FIGS. 19 and 20. These relative movements between the antiextrusion segments 20 also widen the stress relief slots 17 in the elastomeric sleeve 13, as can be seen in FIG. 3. Having the stress relief grooves 18 at the inner ends of the stress relief slots 17 minimizes the tendency of the elastomeric sleeve 13 to tear during its stretching.

Likewise, when the gripping element 12 is tensioned, each of the upper antiextrusion segments 26 are constrained by engagement of a guide 42 in their external dovetail groove 23 to only move parallel to the axis of the adjacent interior dovetail groove 41 of the puller sleeve 32. The vector component of the axial tension acting on the individual upper antiextrusion segments 26 causes the segment to move both radially outwardly and upwardly. This movement leads to a local increase of the inner diameter of the upper end of the gripping element 12.

At the same time, the restraining rings 19 bonded to the outer diameter of the elastomeric sleeve 13 of the gripping element 12 prevent the reduction in diameter of the central bore portion of the gripping element. Accordingly, the central cross-section of the gripping element 12 is thinned by axial stretching while its outer diameter is constrained to remain substantially constant. Consequentially, the entire through bore 14 of the stretched gripper element is sufficiently enlarged to permit the clear axial passage of a casing 190 and its coupling 192.

In order for the casing stinger 140 to enter the bore 191 of the casing 190, it is necessary to axially stretch the bonded annular seal 170 so that its interference with the casing is removed. This is done by supplying hydraulic fluid through the third hydraulic supply line 112 through the fitting 108, the set of the radial flow port 131, the off axis flow port 130, and the flow distribution groove 129, all in the top drive adaptor, and into the stinger base housing 141 of the casing stinger 140 via off axis flow passage 157 and radial flow passage 156.

When the hydraulic fluid enters on the upper side of the piston head 181 of the actuator piston 180, air is exhausted from the other side of the piston head through vent port 155 of the stinger base housing 141. Downward movement of the actuator piston 180 also moves the end cap 173 attached to the lower end of the actuator piston, thereby axially stretching the bonded annular seal 170, so that the potential interference between the seal and the casing bore 191 is removed. Downward movement of the end cap 173 stretches the annular seal 170 because the seal is bonded both to the upper transverse end 175 of the end cap 173 and the lower transverse end 168 of the static tube 160.

In order to get the casing stinger 140 to seal to the bore 191 of the casing 190, all that is required is to relieve the pressure on the third hydraulic supply tube 112. Doing this permits the actuator piston 180 to move upwardly as the bonded annular seal 170 attempts to relieve its previously induced axial tension. As the seal 170 attempts to resume its unstressed state, its outer cylindrical surface will begin to abut against the adjacent bore 191 of the casing 190, producing an initial sealing action. Whenever fluid pressure is present within the bore of the casing stinger 140, the resultant pressures induce an upward load on the end cap 173 of the casing stinger, thereby further enhancing the sealing between seal 170 and the casing bore 191.

During stabbing of the gripping device 10 over the upper end of a casing 190, the coupling 192 of the casing 190 first enters through the guidance bore 116 of the lower cap 114. Because the guidance bore 116 is a relatively close fit to the outer diameter of the coupling 192, fairly good axial alignment results from the passage of the coupling past the lower cap. While the outer surface of the casing 190 is smaller than the guidance bore 116 and hence not directly aligned as readily as the coupling 192, the alignment improves as the upper end of the casing nears the upper end of the interior of the gripping device 10. The large external lower end chamfer of the end cap 173 of the casing stinger 140 also contributes to the axial alignment of the casing 190 as the casing stinger enters the upper end of the casing.

When the upper end of the coupling 192 of the casing has been moved to abut or nearly abut against the lower transverse end of the stinger base housing 141 of the casing stinger 140, as shown in FIG. 16, the gripping of the outer diameter of the casing can be initiated. The resulting configuration of the gripping device 10 is shown in FIG. 17, where the casing 190 is externally gripped, but the casing bore 191 is not yet sealed by the casing stinger 140. The casing stinger 140 has its seal 170 left in a stretched position as the casing gripping is initiated so that any axial shifting of the gripping device 10 relative to the casing 190 will not lead to scuffing of the seal 170.

Referring to FIG. 16 for the starting condition for engaging the gripping element 12 and FIG. 17 for the end condition, releasing the axial tension on the gripping element 12 permits the gripping of the casing 190. Thus, the gripping element 12 is relaxed from its axially stretched position by applying pressure to the first chamber 96 through first hydraulic supply tube 109 while venting pressure from the second chamber 98 through second hydraulic supply tube 110.

As the gripping element 12 has its tension released from the state shown in FIG. 16, the relative movement between the lower 20 and upper 26 antiextrusion segments and their guides 42 connecting them respectively to the gripper anchor ring 82 and the puller sleeve 32 is the reverse of that described for the tensioning of the gripping element. Likewise, the changes in the cross-section of the elastomeric sleeve 13 of the gripping element 12 as tension is released are reversed from those during tensioning.

Because the bore 14 of the unstressed elastomeric sleeve 13 enlarges upwardly between the first end of the bore 15 and the second end of the bore 16, the first end of the bore 15 contacts the outer diameter of the casing 190 first. Contact then progressively moves upwardly from the first end of the bore 15 as more tension is released. The application of pressure to the first chamber 96 is desirable to overcome any frictional resistance to the movement of the components on the gripper module 97. In particular, frictional resistance between the elastomeric sleeve 13 of the gripping element 12 and the outer surface of the casing 190 must necessarily be overcome in order to ensure full engagement between the two.

Since the released elastomeric sleeve 13 in its attempt to return to its original unstressed configuration now would tend to interfere with the outer surface of the casing 190, it will tend to passively grip the casing tightly. The gripping action is due to the development of elastomeric normal forces on the interface between the elastomer and the casing.

While the casing is being gripped, the primary bore 62 of the cylinder body 61 of the cylinder assembly of the gripper module 97 is similarly subject to normal compressive forces from the outer surface of the elastomeric sleeve 13. In the description below, enhancement of compressive normal forces on the casing surface is always accompanied by corresponding enhancement of compressive normal forces on the primary bore 62 of the cylinder body 61.

As the elastomeric sleeve 13 of the gripping element 12 begins to make contact with the outer surface of the casing 190, it also begins to seal. The vent port 111 in the housing 100 ensures that the upper end of the piston head 45 of the gripper module 97 is exposed to atmospheric pressure, rather than vacuum.

Some relative axial movement may occur between the casing 190 and the gripping device 10 as the gripping element moves into full engagement bearing against the casing. For this reason, it is desirable to leave the casing stinger 140 disengaged from the bore 191 of the casing during this time.

The movement of the lower antiextrusion segments 20 tends to close the circumferential gaps between adjacent antiextrusion segments 20 and also bridges the radial gap between the gripper anchor ring 82 and the casing 190, thereby minimizing extrusion tendencies for the elastomeric sleeve 13. The resultant position of the lower antiextrusion segments 20 can be seen in FIG. 21, where the segments 20 are substantially abutting on their adjacent lateral sides and are also bearing on the casing 190. The smooth through bores 22 of the lower antiextrusion segments 20 merely abut the outer surface of the casing, rather than deforming that outer surface. The same situation also is the case for the upper antiextrusion segments 26.

When tension is applied to the upper end of the casing 190, downward frictional forces acting on the elastomeric sleeve 13 will tend to pull the elastomer downwardly against its lower antiextrusion segments 20, thereby increasing the compression of the elastomer and, hence, its lateral pressure against the outer surface of the casing. This in turn permits the development of higher frictional forces, with an attendant increase in gripping power. The axial tension in the tool 10 is transmitted from the elastomeric sleeve 13 to the primary bore 62 of the cylinder body 61 and thence into the gripper housing 100 and the top drive adaptor 140 and ultimately to the top drive or kelly which supports the gripping device 10.

This same normal contact pressure between the elastomer and the outer surface of the casing which results from axial tension in the tool 10 also permits the development of torsional loads due to the frictional shear possible between the elastomeric sleeve 13 and the outer surface of the casing 190. This resultant torsional shear permits the transfer of torque by the gripping device 10. The path through the gripper module 97 of the gripping device 10 for transmitted torque from the casing 190 is different from that for transmitted tension. The shear loads carried by the gripping element 12 are transmitted into the cylinder body 61 by interfacial loads between the elastomeric sleeve 13 and the primary bore 62 of the cylinder 60. The intermeshing of the dog clutch teeth 76 of the cylinder 60 with the dog clutch teeth 126 of the top drive adaptor 120 permits torque to be transferred to the top drive adaptor 120 and then to the top drive.

Downward axial load transferred from the casing 190 to the gripping element 12 again is transferred into the cylinder body 61 by interfacial loads between the elastomeric sleeve 13 and the primary bore 62 of the cylinder 60. The axial loads are then transferred by bearing through the lower transverse end 59 of the cylinder body 61 into the lower cap 114 and then to the top drive adaptor 120 by way of the housing 100 of the body assembly 99.

Thus, the first embodiment of the gripping device 10 of the present invention is able to support high loadings in tension and torsion in a passive manner. Release from the casing 190 is effected simply by repressurizing the second hydraulic supply tube 110 and venting the first hydraulic supply tube 109, so that the second chamber 98 is pressurized and the puller sleeve 32 is moved upwardly. This restretches the elastomeric sleeve 13 so that gripping element 12 of the gripper module 97 is retracted radially outwardly and disengaged from the outer surface of the casing 190, thereby permitting disengagement of the gripping device 10.

In the event that gripping is impaired by fluids on the interface between the elastomeric sleeve 13 and the casing 190 or is otherwise limited, maintenance of hydraulic pressure on the first chamber 96 with simultaneous venting of the second chamber 98 can increase the compression on the elastomeric sleeve 13 so that gripping will be further enhanced. This approach is much facilitated by the presence of the antiextrusion segments 20 and 26 for preventing elastomer extrusion. Hydraulic pressure in the first chamber 96 will induce compression between the puller sleeve 32 and the upper antiextrusion segments 26, as well as the rest of the gripping element 12. Under axial compression of the gripping element 12 by the puller sleeve 32, the upper antiextrusion segments 26 will move radially inwardly in the same manner as the lower antiextrusion segments 20 to minimize extrusion tendencies for the elastomeric sleeve 13.

Fluid flow from the top drive into the bore of the casing 190 can be accomplished in the usual manner because of the isolation of the main portion of the bore of the gripping device 10 from the circulating fluid by the casing stinger 140 and its bonded annular seal 170. If desired, the lower bore of the casing stinger 140 can be threaded to accept cementing tools or a mudsaver valve.

Operation of the Second Embodiment 200 of the Gripping Device.

Figure 29:
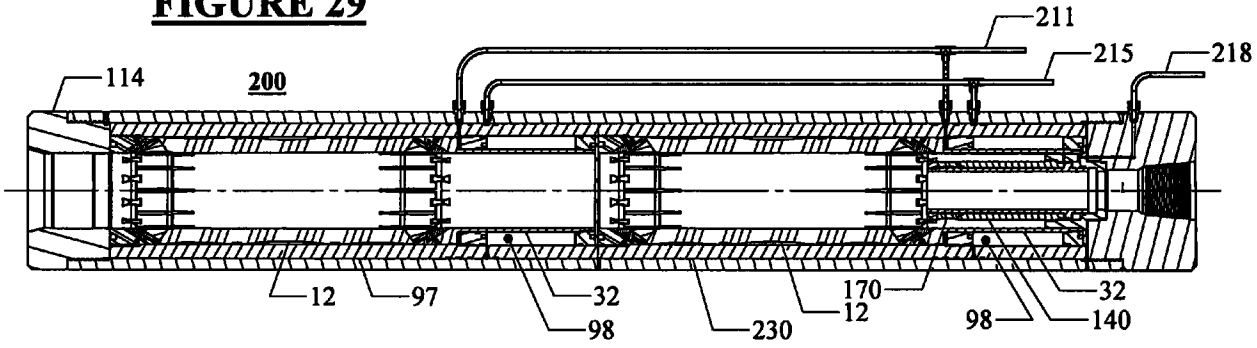
FIG. 29 is a longitudinal sectional view corresponding to FIG. 28, but showing the gripping device in its stretched condition ready for initial engagement with a casing.
Figure 30:
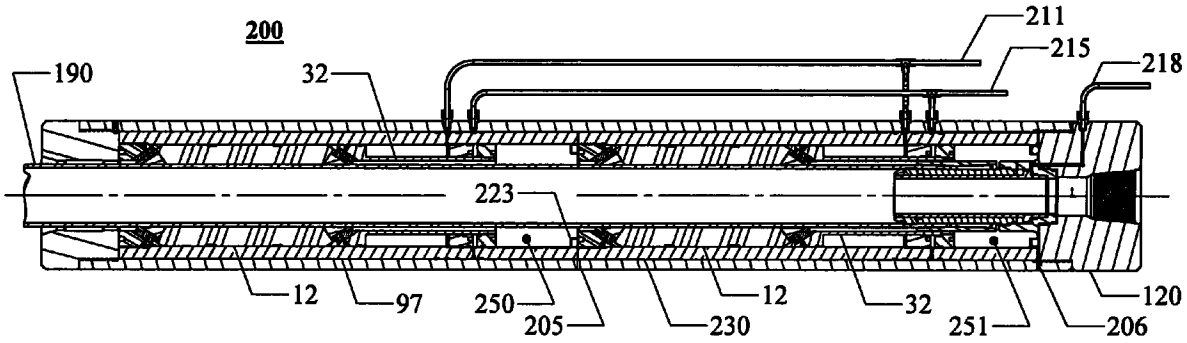
FIG. 30 is a longitudinal sectional view corresponding to FIGS. 28 and 29, but showing the gripping device gripping a casing.
Figure 31:
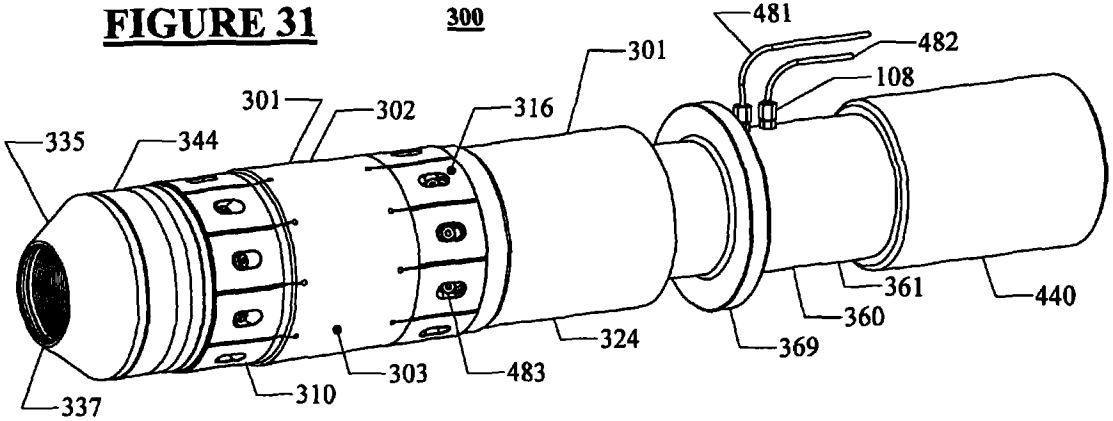
FIG. 31 is an oblique view of a third embodiment of the present invention, wherein the gripping device is configured to use a single gripper module to grip and seal to the internal cylindrical surface of a casing.

The assembled gripping device 200 is shown in FIGS. 28 to 30. Gripping device 200 can be attached to the lower end of a top drive unit or a drilling Kelly (not shown). The top drive or Kelly provides both the lifting force and the torque which will be transmitted to the gripped tubular string by the gripping device 200, as well as drilling fluid for circulation through the bore of the gripping device. The operation of the second embodiment 200 gripping device is very similar to that of the first embodiment 10 in all regards. The only operational differences are firstly that two gripping modules 260 and 261 are simultaneously actuated by the same hydraulic circuit, and secondly that any torque transferred from the lower gripping module 97 flows through the upper gripper module 230 to be transferred to the top drive adaptor 120.

The coaxial gripping modules 230 and 97 of the gripping device 200 are simultaneously actuated by means of selectively operated hydraulic valving (not shown). This simultaneity is due to the fluid interconnection of the first chambers 96 of both gripping modules 230 and 97 with the first hydraulic supply tube 211 and also the separate fluid interconnection of the second chambers 98 of modules 230 and 97 with the second hydraulic supply tube 215. The casing stinger 140 is selectably actuated by the third hydraulic supply tube 218.

In operation, the gripping device 200 with both of its gripping elements 12 stretched is slid over the upper end of a casing 190 by inserting the casing into the guidance bore 116 of the lower cap 114 of the dual gripper housing 201 until its coupling 192 abuts the lower side of the top drive adaptor, as shown in FIG. 29. To insert the casing, it is necessary to apply hydraulic pressure to the second hydraulic supply tube 215 and thereby also to the second chambers 98 of both the upper 230 and lower 97 gripping modules. At the same time, it is also necessary to vent hydraulic fluid from the first hydraulic supply tube 211 and thereby also from the first chambers 96 of both the upper 230 and lower 97 gripping modules. Additionally, it is necessary to stretch the bonded annular seal 170 of the casing stinger 140 by pressurizing the third hydraulic supply line 218. Stretching the seal 170 removes any interference between it and the bore 191 of the casing 190.

Because of the hydraulic interconnection in parallel of the two gripper modules, pressuring the second hydraulic supply tube 215 induces the puller sleeves 34 and their attached piston heads 45 of both gripping modules 230 and 97 to move upwardly. The upward movement of both puller sleeves 34 also causes the upper ends of the gripping elements 12 of both gripping modules 230 and 97 to move upwardly, thereby axially stretching the elastomeric sleeves 13 of both gripping elements.

The tension associated with the stretching of the elastomeric sleeves 13 additionally causes their antiextrusion segments 20 and 26 to move axially as well as outwardly parallel to their sliding contact faces 24, thereby enlarging the central passage through each set of the antiextrusion segments. At the same time, the associated stretching of the elastomeric sleeves 13 of the elastomeric gripping elements 12 causes the sleeve cross-sectional areas to be reduced.

Because of both the outward movement of the bonded-on segmented end rings and the restraints against inward motion of the elastomeric sleeve provided by the bonded-in restraining rings 19, the elastomer is induced by tension to move outwardly to thereby enlarge the central hole through the gripping element 12 and eliminate its interference with the outer diameter of the coupling 192 and the casing 190. Thus tensioning of the gripping elements 12 permits the coupling 192 of the casing as well as the body of the casing 190 to be passed through the resultant enlarged central hole of each gripping element 12 of the gripping modules 230 and 97.

As the casing coupling 192 is nearing abutment against the lower side of the casing stinger support 115, the tubular casing stinger 140 with its stretched seal 170 is stabbed into the bore 191 of the casing 190, rather than being confined within the casing coupling 192. The fully engaged casing 190 will not have its coupling 192 interfering with the upward movement of the puller sleeves 34 of the upper griping module 230, since the through bores 38 of the puller sleeves 34 are larger than the outer diameter of the coupling 192.

When the casing coupling 192 is abutted, the casing 190 may be gripped by venting pressure from both first 211 and second 215 hydraulic supply tubes and hence from the first 96 and second 98 chambers of both the gripping modules 230 and 97. This permits the elastomeric sleeves 13 of the gripping elements 12 to attempt to return to their at rest, unstressed conditions. Following this, the pressure from the third hydraulic supply tube 218 can be vented to permit the bonded seal 170 of the casing stinger 140 to seal against the bore 191 of the casing 190.

Since the untensioned elastomeric sleeves 13 normally would interfere with the outer surface of the casing 190, they will tend to grip the casing tightly as the elastomeric sleeves 13 are progressively relaxed. Additionally, the antiextrusion segments 20 and 26 will be urged tightly against the outer surface of the casing 190 when frictional downward forces resulting from lifting with the gripping device 200 tend to force the elastomeric sleeves 13 more tightly into contact with the outer surface of the casing 190, thereby simultaneously compressing the elastomer. This passive compression of the elastomeric sleeves 13 and the attendant compressing of both the lower antiextrusion segments 20 and the upper antiextrusion segments 26 minimizes extrusion tendencies for the elastomer.

When tension is applied to the upper end of the casing 190, downward frictional forces acting on the elastomeric sleeves 13 will tend to pull the elastomer downwardly against their lower antiextrusion segments 20, thereby increasing the compression of the elastomer and, hence, their gripping power. The axial tension in the tool is transmitted from the casing to the elastomeric sleeves 13 and to the primary bores 62 of the cylinder bodies 61 and 220 and thence into the dual gripper housing 201 through the lower cap 114 and ultimately to the top drive or Kelly which supports the gripping device 200.

This same friction which results from axial tension in the tool also permits the development of torsional shear between the elastomeric sleeves 13 and the outer surface of the casing 190. This resultant torsional frictional shear permits the transfer of torque by the gripping device 200. The path through the gripping device 200 for transmitted torque is as follows. Torque from the casing 190 may be developed on the engaged through bore 14 of the elastomeric sleeve 13 of the gripper element 12 through friction due to the high interfacial contact pressures under axial load. The resultant shear in the elastomeric sleeve 13 is then transferred to the primary bore 62 of the cylinder body 61 of the gripper module 97 or the primary bore of the upper cylinder body 220 of the upper gripper module 230.

Any torque from the cylinder body 61 of the cylinder assembly 60 of the lower gripper module 97 is transferred through the upper dog clutch teeth 76 to the lower dog clutch teeth 223 of the upper cylinder body 220 of the upper gripper module 230. The transferred torque from the lower gripper module 97 and torque developed by contact of the upper gripper module 230 with the casing 190 is then transferred to the top drive adaptor 120 through the intermeshing of the upper dog clutch teeth 76 of the upper gripper module with the downward facing dog clutch teeth 126 of the top drive adaptor 120. This torque can then be transferred out of the gripping device 200 through the API thread 122.

Thus, the second embodiment of the gripping device 200 of the present invention is able to support high loadings in both tension and torsion in a passive manner. Release from the casing 190 is effected simply by repressurizing the second hydraulic supply tube 215 and venting the first hydraulic supply tube 211 while pressurizing the third hydraulic supply tube 218. By doing so, the second chambers 98 are pressurized while the first chambers 96 are vented and the puller sleeves 32 are moved upwardly. This restretches the elastomeric sleeves 13 so that the gripper modules 230 and 97 are retracted outwardly and disengaged from the outer surface of the casing 190. At the same time, the seal 170 of the casing stinger 140 is restretched so that it can be freely removed from the bore 191 of the casing 190. The gripping device 200 can then be removed from the casing 190.

In the event that gripping is impaired by fluids on the interface between the elastomeric sleeves 13 and the casing 190 or is otherwise limited, maintenance of pressure on the first chambers 96 with simultaneous venting of the second chambers 98 can increase the compression on the elastomer so that gripping will be enhanced. This approach is much facilitated by the presence of the antiextrusion segments 20 and 26 for preventing elastomer extrusion.

Fluid flow from the top drive into the bore of the casing 190 can be accomplished in the usual manner because of the isolation of the main portion of the bore of the gripping device 200 from the circulating fluid by the casing stinger 140 and its stretchable bonded seal 170. If desired, the lower bore of the casing stinger 140 can be threaded to accept cementing tools for running and then cementing casing into a well.

Operation of the Third Embodiment 300 of the Gripping Device.

Operation of the gripping device third embodiment 300 of the present invention proceeds as follows. The elastomeric sleeve 303 of the gripping element 302 is tensioned by applying pressure to the second hydraulic supply tube 482 and venting pressure from the first hydraulic supply tube 481. This applies pressurized hydraulic oil to the second chamber 461 and vents oil from the first chamber 460, thereby causing the puller sleeve 324 to move upwardly. The second hydraulic supply tube 482 is connected to the second chamber 461 by way of a fitting 108, second threaded port 373 of the backbone tube 361, fourth radial port 393 and lower flow channel 400 and second radial port 387, all part of the bore liner tube 380, and the second radial port 375 of the backbone tube 361. The first hydraulic supply tube 481 is connected to the first chamber 460 by way of a fitting 108, first threaded port 372 of the backbone tube 361, third radial port 390 and upper flow channel 396 and first radial port 384, all part of the bore liner tube 380, and the first radial port 374 of the backbone tube 361.

As the elastomeric sleeve 303 is tensioned, its cross-section is reduced and the elastomer tends to pull radially inwardly, thereby removing its interference with the casing bore 471 of the casing 470 when it is sufficiently tensioned. The tensioning of the elastomer also causes the respective antiextrusion segments 310 and 316 to be pulled down the frustroconical sliding contact surfaces 340 of the nose piece 335 and 331 of the puller sleeve 324, respectively, thereby reducing the effective outer diameter of the end pieces so that they will not interfere with the bore 471 of the casing 470.

Following this, the gripping device 300 can be inserted into the casing bore 471 until the external flange 369 of the backbone tube 361 abuts the upper end of the casing 470. With the gripping device 300 inserted into the casing 470 so that the stretched elastomeric sleeve 303 of the gripping element 302 may be fully entered within the casing bore 471, the pressure on hydraulic supply tubes 481 and 482 and, hence, the first 460 and second 461 chambers can be bled off in order to cause the elastomeric sleeve 303 and the antiextrusion segments 310 and 316 to be urged to their at-rest, unstressed condition. Since the elastomer now will tend to interfere with the bore 471 of the casing, it will tend to grip the casing 470 tightly.

This passive gripping action is due to stresses in the distorted elastomeric sleeve 303 as it attempts to achieve its zero stress as-molded condition. Additionally, the antiextrusion segments 310 and 316 will be urged tightly against the bore of the casing when frictional downward forces resulting from lifting with the gripping device 300 tend to force the elastomeric sleeve 303 more tightly into contact with the bore 471 of the casing 470 while simultaneously compressing the elastomer. This passive compression of the elastomeric sleeve 303 under tensile load from the casing 470 and the attendant compressing of at least the lower antiextrusion segments 310 minimizes extrusion tendencies for the elastomer. The more compression on the elastomer, the more closely the antiextrusion segments 310 and 316 close on the pipe and eliminate extrusion gaps for the elastomer.

When tension is applied to the upper end of the casing 470, downward frictional forces acting on the elastomeric sleeve 304 will tend to pull the elastomer downwardly against its lower antiextrusion segments 310, thereby increasing the compression of the elastomer and, hence, its gripping power. The axial tension in the tool is transmitted from the elastomeric sleeve 304 to the lower cylindrical surface 368 of the backbone tube 361 and thence to the top drive adaptor 440 and the top drive or kelly which supports the gripping device 300.

This same friction which results from axial tension in the tool 300 also permits the development of rotational shear loads between the elastomeric sleeve 303 and the bore 471 of the casing 470. This resultant frictional shear permits the transfer of torque by the gripping device 300. The path through the gripping device 300 for transmitted torque is the same as for transmitted tension.

Thus, the third embodiment of the gripping device 300 of the present invention is able to support high loadings in tension and torsion in a passive manner. Release from the casing 470 is effected simply by repressurizing the second hydraulic supply tube 482 and venting the first hydraulic supply tube 481, so that the second chamber 461 is pressurized and the puller sleeve 324 is moved upwardly. This restretches the elastomer 303 so that the gripper module 301 is retracted inwardly and disengaged from the bore 471 of the casing 470.

In the event that gripping is impaired by fluids on the interface between the elastomer and the casing or otherwise limited, maintenance of pressure on the first hydraulic supply tube 109 and release of pressure on the second hydraulic supply tube 110 will increase the axial compression on the elastomeric sleeve 303 so that frictionally induced gripping will be enhanced. This approach is much facilitated by the presence of the antiextrusion segments 310 and 316 for preventing elastomer extrusion.

Fluid flow from the top drive into the bore of the casing by way of the through flow passages of the gripping device 300 can be provided in the usual manner because of the sealing isolation of the circulating fluid in the top drive, gripping device 300, and the bore 471 of the casing 470 from the environment above and external to where the casing is gripped by the elastomeric sleeve 303. Both the passive and hydraulically enhanced active gripping of the gripping device 300 are sufficient to also permit the elastomer to serve as a seal while gripping. If desired, cementing tools or other accessories can be attached to the thread 337 at the lower end of the nose piece 335.

ADVANTAGES OF THE INVENTION

The gripping device embodiments shown herein offer several advantages over the current casing gripping devices. A very important advantage of the gripping devices disclosed herein is their simplicity of construction and operation. The relatively short length of the gripping devices of the present invention is also advantageous. The casing is more evenly loaded with circumferentially uniform gripping, and these gripping devices with their antiextrusion segments do not mar the surface of the casing. This is particularly desirable for casing material which is notch sensitive or which will be exposed to severe corrosion conditions in service, particularly hydrogen sulphide or carbon dioxide corrosion. Additionally, the uniformity of the gripping action on the casing minimizes the potential of damage to the casing.

The ability of multiple gripping modules to be run coaxially in order to achieve more load capacity is highly desirable. Although multiple gripping modules for internal gripping of a casing are not shown herein for the present invention, it may be readily understood by those skilled in the art that extension of the bore liner tube with its internal hydraulic conduits down the interior of a longer backbone readily would permit the addition and control of more than one gripping module. The provision of the antiextrusion segments bonded onto the elastomeric element greatly improves the ability of the elastomer to resist extrusion when under high frictionally induced compressive loads. In the event of axial slippage of a casing having an externally upset coupling in the first and second embodiment gripping devices 10 and 200 of the present invention, the gripping device is protected against the stripping out of the coupling through the elastomer by the presence of the upper antiextrusion segments. If such a casing with end couplings slips axially sufficiently, the coupling of the gripped casing will abut the upper end ring segments and be prevented from additional slippage.

The ability of the gripping devices of the present invention to operate passively provides an important safety feature in the event of pressure loss. Should a higher gripping force be required of the elastomeric sleeve, the ability to exert additional pressure by hydraulically forcing the puller sleeve downwardly to enhance compressive forces on the elastomer and hence friction with the casing is an important advantage.

As may be recognized readily by those skilled in the art, minor changes may be made to the gripping apparatus without departing from the spirit of the invention. For instance, the elastomeric gripping element and its segmented end rings can be configured to also grip objects with noncircular cross-sections. Such minor changes in configuration do not depart from the spirit of the present invention.

What is claimed is:

1. A gripping apparatus for gripping tubular objects, the apparatus comprising:
   (a) a structural element;
   (b) an elastomeric gripping element having
      (i) a first end of the gripping element bonded to a first end of a first circumferential array of segmented antiextrusion end rings, wherein a second end of each antiextrusion end ring of the first array is attached to the structural element, and
      (ii) a second end of the gripping element bonded to a first end of a second circumferential array of segmented antiextrusion end rings, wherein a second end of each antiextrusion end ring of the second array is attached to a reciprocably movable end assembly; and
   (c) means for reciprocably moving the movable end assembly axially relative to a second end of the structural element to
      a first position, wherein the elastomeric gripping element is stretched and is selectably coaxially positionable within an internal diameter of a through bore of a tubular object to be gripped and wherein opposed adjacent faces of adjacent antiextrusion end rings of both the first and the second arrays are moved to a first relative position to each other, or
      a second position, wherein the elastomeric gripping element is untensioned and is biased against an interior surface of the through bore of the tubular object and wherein opposed adjacent faces of adjacent antiextrusion end rings of both the first and the second arrays are moved to a second relative position to each other.

2. The gripping apparatus of claim 1, wherein the structural element is a mandrel and the gripping element is connected to an exterior surface of the mandrel.

3. The gripping apparatus of claim 2, wherein whenever the movable end assembly is at the first position an external diameter of the gripping element and the first and second arrays of the end rings is decreased to avoid structural interference with an interior surface of the tubular object and whenever the movable end assembly is at the second position the external diameter of the gripping element and first and second arrays is increased such that the gripping element and the first and second arrays are biased against the interior surface of the tubular object.

4. The gripping apparatus of claim 1, wherein the moving means is one or more hydraulic cylinders.

5. The gripping apparatus of claim 1, wherein each end ring segment of each array of segmented antiextrusion end rings has a frustroconical ramp face axially opposed to the bonded ends of the segmented end rings.

6. The gripping apparatus of claim 5, wherein the gripping apparatus further comprises a first interconnection means capable of transmitting tension between the structural element and the individual end rings of the first array in a manner such that the end rings of the first array only move in a radial plane parallel to the frustroconical ramp faces of the first array of end rings and a second interconnection means capable of transmitting tension between the structural element and the individual end rings of the second array in a manner such that the end rings of the second array only move in a radial plane parallel to the frustroconical ramp faces of the second array of end rings.

7. A gripping apparatus for gripping tubular objects, the apparatus comprising:

(a) a structural element;

(b) a tubular elastomeric gripping element having (i) a first end of the gripping element bonded to a first end of a first circumferential array of segmented antiextrusion end rings, wherein a second end of each antiextrusion end ring of the first array is attached to the structural element proximal a first end of the structural element, and (ii) a second end of the gripping element bonded to a first end of a second circumferential array of segmented antiextrusion end rings, wherein each antiextrusion end ring of the second array is attached to a reciprocably movable end assembly mounted on the structural element;

(c) a reciprocable piston connected to the movable end assembly wherein the piston moves the movable end assembly axially relative to the structural element to a first position, wherein the elastomeric gripping element is stretched, wherein opposed adjacent faces of adjacent antiextrusion end rings of both the first and the second arrays are moved to a first relative position to each other, a second position wherein the elastomeric gripping element is untensioned, wherein opposed adjacent faces of adjacent antiextrusion end rings of both the first and the second arrays are moved to a second relative position to each other, or a third position wherein the elastomeric gripping element is axially compressed, wherein opposed adjacent faces of adjacent antiextrusion end rings of both the first and the second arrays are moved to a third relative position to each other; and (d) a hydraulic cylinder having a first and second hydraulic chamber, wherein when a first hydraulic pressure is applied to the second hydraulic chamber the piston moves the movable end assembly to the first position thereby stretching the elastomeric gripping element, and when a second hydraulic pressure is applied to the first hydraulic chamber the piston moves the movable end assembly to the second position thereby untensioning the gripping element, and when a third hydraulic pressure is added to the second hydraulic pressure in the first hydraulic chamber the piston moves the movable end assembly to the third position thereby compressing the gripping element.

8. The gripping apparatus of claim 7, wherein the structural element is a mandrel and the gripping element is connected to an exterior surface of the mandrel, whereby the gripping element is biased against an interior surface of a tubular object surrounding the gripping element when the gripping element is in the third position.

9. The gripping apparatus of claim 8, wherein whenever the movable end assembly is at the first position an external diameter of the gripping element and the first and second arrays of the end rings is decreased to avoid structural interference with the interior surface of the tubular object and whenever the movable end assembly is at the second and third positions the external diameter of the gripping element and first and second arrays is increased such that the gripping element and the first and second arrays are biased against the interior surface of the tubular object.

10. The gripping apparatus of claim 7, wherein each end ring segment of each array of segmented antiextrusion end rings has a frustroconical ramp face axially opposed to the bonded ends of the segmented end rings.

11. The gripping apparatus of claim 10, wherein the gripping apparatus further comprises a first interconnection means capable of transmitting tension between the structural element and the individual end rings of the first array in a manner such that the end rings of the first array only move in a radial plane parallel to the frustroconical ramp faces of the first array of end rings and a second interconnection means capable of transmitting tension between the structural element and the individual end rings of the second array in a manner such that the end rings of the second array only move in a radial plane parallel to the frustroconical ramp faces of the second array of end rings.

12. A gripping apparatus for internally gripping tubular objects, the apparatus comprising:

(a) a structural element;

(b) a tubular elastomeric gripping element having (i) a first end of the gripping element bonded to a first end of a first circumferential array of segmented antiextrusion end rings, wherein a second end of each antiextrusion end ring of the first array is attached to a static first anchor ring, the first anchor ring being attached to the structural element, (ii) a second end of the gripping element bonded to a first end of a second circumferential array of segmented antiextrusion end rings, wherein a second end of each antiextrusion end ring of the second array is attached to a second anchor ring, the second anchor ring being attached to a reciprocably movable end assembly mounted on the structural element, and (iii) a gripping element bore coaxial with a first antiextrusion end ring bore of the first array and a second antiextrusion end ring bore of the second array, wherein the first and second antiextrusion end ring bores are coaxial and substantially identical and wherein a portion of the structural element is positioned within the gripping element bore and the first and second antiextrusion ring bores;

(c) a reciprocable piston connected to the movable end assembly wherein the piston moves the movable end assembly axially relative to the structural element to a first position, wherein the elastomeric gripping element is stretched, and an external diameter of the gripping element is decreased to avoid structural interference with an interior surface of a through bore of a tubular object as the gripping apparatus is positioned in the through bore of the tubular object, a second position wherein the elastomeric gripping element is untensioned and the external diameter of the gripping element is increased from the external diameter of the gripping element when the end assembly is in the first position, or a third position wherein the elastomeric gripping element is compressed, and the external diameter of the gripping element is increased from the respective external diameter of the gripping element when the end assembly is in the first position or the second position; and (d) a hydraulic cylinder having a first and second hydraulic chamber, wherein when a first hydraulic pressure is applied to the second hydraulic chamber the piston moves the movable end assembly to the first position thereby stretching the elastomeric gripping element, and when a second hydraulic pressure is applied to the first hydraulic chamber the piston moves the movable end assembly to the second position thereby untensioning the gripping element, and when a third hydraulic pressure is added to the second hydraulic pressure in the first hydraulic chamber the piston moves the movable end assembly to the third position thereby biasing the gripping element against the interior surface of the through bore of the tubular object to tightly grip the tubular object.

13. The gripping apparatus of claim 12, wherein each end ring segment of each array of segmented antiextrusion end rings has a frustroconical ramp face axially opposed to the bonded ends of the segmented end rings.

14. The gripping apparatus of claim 13, wherein the gripping apparatus further comprises a first interconnection means capable of transmitting tension between the structural element and the individual end rings of the first array in a manner such that the end rings of the first array only move in a radial plane parallel to the frustroconical ramp faces of the first array of end rings and a second interconnection means capable of transmitting tension between the structural element and the individual end rings of the second array in a manner such that the end rings of the second array only move in a radial plane parallel to the frustroconical ramp faces of the second array of end rings.

* * * * *